US011247253B2

(12) United States Patent
Sako et al.

(10) Patent No.: US 11,247,253 B2
(45) Date of Patent: Feb. 15, 2022

(54) ROLLING MILL AND ROLLING MILL ADJUSTMENT METHOD

(71) Applicant: Primetals Technologies Japan, Ltd., Hiroshima (JP)

(72) Inventors: Akira Sako, Hiroshima (JP); Jiro Hasai, Hiroshima (JP); Tadashi Hiura, Hiroshima (JP); Taroh Satoh, Hiroshima (JP); Toru Takeguchi, Hiroshima (JP); Hideaki Furumoto, Hiroshima (JP); Shinya Kanemori, Hiroshima (JP); Hideki Tonaka, Hiroshima (JP)

(73) Assignee: Primetals Technologies Japan, Ltd., Hiroshima (JP)

( * ) Notice: Subject to any disclaimer, the term of this patent is extended or adjusted under 35 U.S.C. 154(b) by 619 days.

(21) Appl. No.: 15/766,091

(22) PCT Filed: Nov. 7, 2016

(86) PCT No.: PCT/JP2016/082952
§ 371 (c)(1),
(2) Date: Apr. 5, 2018

(87) PCT Pub. No.: WO2018/083794
PCT Pub. Date: May 11, 2018

(65) Prior Publication Data
US 2019/0047028 A1 Feb. 14, 2019

(51) Int. Cl.
*B21B 37/18* (2006.01)
*B21B 37/28* (2006.01)
(Continued)

(52) U.S. Cl.
CPC ..... *B21B 37/18* (2013.01); *B21B 37/28* (2013.01); *B21B 31/20* (2013.01); *B21B 38/00* (2013.01); *B21B 2261/046* (2013.01)

(58) Field of Classification Search
CPC ..... B21B 31/20; B21B 37/18; B21B 37/28; B21B 38/00; B21B 2261/046
See application file for complete search history.

(56) References Cited

U.S. PATENT DOCUMENTS 4,154,080 A * 5/1979 Suzuki ..... B21B 31/02 72/237
5,038,591 A * 8/1991 Tajima ..... B21B 31/22 72/13.4
(Continued)

FOREIGN PATENT DOCUMENTS

CN 201437124 U 4/2010
JP 48-2356 A 1/1973
(Continued)

OTHER PUBLICATIONS

International Search Report of PCT/JP2016/082952 dated Feb. 7, 2017.
(Continued)

*Primary Examiner* — Adam J Eiseman
*Assistant Examiner* — Stephen Floyd London
(74) *Attorney, Agent, or Firm* — Mattingly & Malur, PC

(57) ABSTRACT

There are provided a work-side position measurement device and a drive-side position measurement device for directly measuring positions of roll chocks in a rolling direction, and positions of upper and lower working rolls and upper and lower backup rolls in the rolling direction are adjusted to zero point or predetermined positions. Alternatively, a change caused in the strip wedge due to a minute crossing of the axes of working rolls and backup rolls is calculated, and the quantities of leveling of a work-side rolling reduction cylinder device and a drive-side rolling reduction cylinder device are adjusted to make the strip edge equal to or smaller than a predetermined value. Accordingly, the bilateral asymmetry (strip wedge) of the thickness dis-
(Continued)

tribution of a rolled material is easily adjusted even in the event that the positions of the roll chocks in the rolling direction are changed due to wear on various components.

9 Claims, 34 Drawing Sheets

(51) Int. Cl.
*B21B 31/20* (2006.01)
*B21B 38/00* (2006.01)

(56) References Cited

U.S. PATENT DOCUMENTS 5,768,927 A * 6/1998 Kajiwara ..... B21B 13/023 72/10.1
2002/0023473 A1* 2/2002 Harako ..... B21B 31/02 72/245
2003/0024293 A1* 2/2003 Yamamoto ..... B21B 37/007 72/245
2003/0097866 A1* 5/2003 Hiura ..... B21B 31/18 72/247
2006/0230799 A1* 10/2006 Ogawa ..... B21B 37/28 72/10.4
2007/0245794 A1* 10/2007 Brandenfels ..... B21B 31/02 72/247
2009/0183544 A1* 7/2009 Pawelski ..... B21B 29/00 72/241.2

FOREIGN PATENT DOCUMENTS

JP 63-180313 A 7/1988
JP H0242561 B2 * 9/1990 ..... B21B 13/023
JP 07-290145 A 11/1995
JP 2941555 B2 8/1999
JP 2999075 B2 1/2000
JP 3055838 B2 6/2000
JP 2008-43977 A 2/2008
JP 4962334 B2 6/2012
JP 5929048 B2 6/2016
WO WO-2008001466 A1 * 1/2008 ..... B21B 31/028

OTHER PUBLICATIONS

Indian Office Action received in corresponding Indian Application No. 201817012670 dated Jun. 23, 2020.

* cited by examiner

ROLLING MILL AND ROLLING MILL ADJUSTMENT METHOD

TECHNICAL FIELD

The present invention relates to a rolling mill and a rolling mill adjustment method used to roll a metal strip.

BACKGROUND ART

In a rolling mill, as the number of rolling operations increases, wear of liners, etc. provided between a housing and roll chocks proceeds, resulting in a subtle change in the positions and configuration of the roll chocks inside the rolling mill.

As a result, there are generated a minute crossing of the axes of working rolls and backup rolls and an axial deviation between the upper and lower working rolls, resulting in generation of a bilateral asymmetry (strip wedge) of the thickness distribution of a rolled material. This induces contraction at the time of the passing of the trailing edge, which leads to a serious problem such as roll replacing due to generation of a flaw on the roll surface. Thus, it is necessary to maintain a highly accurate control of the roll chock positions. This maintenance requires an enormous amount of time of the worker on the site, resulting in an increase in cost.

As a conventional method of controlling the roll chock positions, Patent Document 1, for example, discloses a technique in which the working roll both end neck portion positions are measured to detect the cross point deviation amount of the working rolls, adjusting the roll positions to target values.

Further, as a method of adjusting the skew amount between the working rolls and the backup rolls, Patent Document 2 discloses a technique in which the thrust force in the width direction of the working rolls or the backup rolls is measured and in which roll crossing is effected such that the skew amount between the working rolls and the backup rolls is 0. Patent Document 3 discloses a technique in which the differential force during rolling due to meandering and that due to the thrust force are separated from each other and in which the skew amount between the working rolls and the backup rolls is obtained from the differential force due to the thrust force, effecting leveling correction based on the skew amount.

Further, as a method of adjusting an axial deviation between the upper and lower working rolls, Patent Document 4 discloses a technique in which the cross angle is changed in the roll kiss state to obtain quantities of leveling at which the differential force is 0, estimating the offset between the upper and lower working rolls from the quantities of leveling.

Further, as a method of controlling strip wedge, Patent Document 5 discloses a technique in which, in strip wedge control, the difference in support spring constant between the work side and drive side of the backup rolls is taken into consideration to estimate the strip wedge, effecting leveling correction. Patent Document 6 discloses a technique in which the thrust force in the width direction of the backup rolls is measured and in which control is performed to correct the rolling reduction force on the work side and the drive side, thereby controlling the strip wedge.

PRIOR ART DOCUMENT

Patent Document

Patent Document 1: Japanese Patent No. 3055838

Patent Document 2: Japanese Patent No. 5929048

Patent Document 3: Japanese Patent No. 4962334

Patent Document 4: Japanese Patent No. 2999075

Patent Document 5: JP-2008-43977-A

Patent Document 6: Japanese Patent No. 2941555

SUMMARY OF THE INVENTION

Problem to be Solved by the Invention

As described above, to maintain a highly accurate control of the roll chock positions, it is necessary to provide a technique for correcting the minute crossing of the axes of the working rolls and the backup rolls, the axial deviation between the upper and lower working rolls, and the strip wedge.

In Patent Document 1, however, the roll chock position measurement in the rolling direction is only performed on the working rolls, and no chock position measurement is performed on the backup rolls. Thus, in the case where the group of liners of the backup rolls are worn, it is impossible to accurately grasp the backup roll chock positions, and to perform positional adjustment. Thus, there is a fear of a minute crossing of the axes of the working rolls and the backup rolls being generated. Further, in this system, the total stroke in which the working rolls are crossed is measured by a position measurement device, and the stroke is long, so that there are problems in terms of measurement accuracy and the position measurement device maintenance property.

Further, in Patent Document 2, the thrust force in the width direction measured includes an error such as hysteresis due to the bending force of the upper and lower working rolls. Thus, the thrust force measurement accuracy due to the skew between the working rolls and the backup rolls deteriorates, and the estimation accuracy of the minute crossing amount between the working rolls and the backup rolls which is estimated from the result of the measurement is naturally affected, and there is a fear of problems such as defective adjustment of the roll positions and insufficient adjustment of the bilateral asymmetry of the thickness distribution of the rolled material.

In Patent Document 3, an error such as frictional force and hysteresis is also included in the measured rolling force, so that a desired improvement in terms of the skew estimation accuracy is not to be expected even if the differential force due to the thrust is separated.

In Patent Document 4, it is rather difficult for the operator to change the leveling at the actual machine, and a lot of adjustment time is required when replacing the rolls. Thus, an easier method is demanded.

In Patent Document 5, the change in the strip wedge due to the thrust force generated as a result of the minute crossing of the axes of the working rolls and the backup rolls is not taken into consideration, so that a further improvement is required.

In Patent Document 6, the change in the strip wedge due to the difference in spring constant between the support springs on the work side and the drive side of the backup rolls is not taken into consideration, and, regarding the strip wedge estimation, the influence of both the thrust force and the difference in spring constant between the support springs on the work side and the drive side of the backup rolls is not taken into consideration. Thus, a further improvement is required.

The present invention has been made in view of the above circumstances. It is an object of the present invention to provide a rolling mill and a rolling mill adjustment method making it possible to easily adjust the bilateral asymmetry (strip wedge) of the thickness distribution of the rolled material even if the positions of the roll chocks in the rolling direction are changed due to wear on various components including the group of liners provided between the roll chocks, the housing, and the pressing device.

Means for Solving the Problem

To achieve the above object, the present invention adopts, for example, the structure as claimed in the appended claims.

The present invention includes a plurality of means for achieving the above object, an example of which is a rolling mill including: a work-side housing and a drive-side housing; a pair of upper and lower working rolls each supported rotatable by the work-side and drive-side housings via a work-side roll chock and a drive-side roll chock; a pair of upper and lower backup rolls each supported rotatable by the work-side and drive-side housings via a work-side roll chock and a drive-side roll chock and each supporting the pair of upper and lower working rolls; a plurality of pressing devices that are arranged, with respect to the pair of upper and lower working rolls and the pair of upper and lower backup rolls, at following positions: at least one of positions between an input side in a rolling direction of the work-side housing and the work-side roll chock and between an output side in the rolling direction of the work-side housing and the work-side roll chock; and at least one of positions between an input side of the drive-side housing and the drive-side roll chock and between an output side of the drive-side housing and the drive-side roll chock, the plurality of pressing devices pressing the roll chock at each position in the rolling direction or an anti-rolling direction; liners each provided at contact portions of the plurality of pressing devices and corresponding roll chocks; a work-side position measurement device for the work-side roll chock, the work-side position measurement device configured to measure a position, including wear of the liners, of the work-side roll chock in the rolling direction between the work-side roll chock and the work-side housing at a position free from an influence of the wear of the liners; a drive-side position measurement device for the drive-side roll chock, the drive-side position measurement device configured to measure a position, including wear of the liners, of the drive-side roll chock in the rolling direction between the drive-side roll chock and the drive-side housing at a position free from an influence of the wear of the liners; and a strip wedge suppression device configured to control a strip wedge change amount after rolling to be equal to or less than a predetermined value on the basis of measurement results of the work-side and drive-side position measurement devices.

Further, according to another example of the present invention, there is provided a rolling mill adjustment method for adjusting a rolling mill, the rolling mill including: a work-side housing and a drive-side housing; a pair of upper and lower working rolls each supported rotatable by the work-side and drive-side housings via a work-side roll chock and a drive-side roll chock; a pair of upper and lower backup rolls each supported rotatable by the work-side and drive-side housings via a work-side roll chock and a drive-side roll chock and each supporting the pair of upper and lower working rolls; a plurality of pressing devices that are arranged, with respect to the pair of upper and lower working rolls and the pair of upper and lower backup rolls, at least at following two positions: between an input side of the work-side housing and the work-side roll chock and between an output side of the work-side housing and the work-side roll chock, and at least between an input side of the drive-side housing and the drive-side roll chock and between an output side of the drive-side housing and the drive-side roll chock, the plurality of pressing devices pressing the roll chock at each position in the rolling direction or an anti-rolling direction; and liners each provided at contact portions of the plurality of pressing devices and corresponding roll chocks, the method including the steps of: measuring, with respect to the work-side roll chock, a position including wear of the liners in the rolling direction of the work-side roll chock between the work-side roll chock and the work-side housing at a position free from an influence of the wear of the liners by a work-side position measurement device configured to measure, with respect to the drive-side roll chock, a position including wear of the liners in the rolling direction of the drive-side roll chock between the drive-side roll chock and the drive-side housing at a position free from an influence of the wear of the liners by a drive-side position measurement device; and controlling a strip wedge change amount after rolling to be equal to or less than a predetermined value on the basis of a measurement result of the position in the rolling direction of the work-side roll chock and a measurement result of the position in the rolling direction of the drive-side roll chock.

Effect of the Invention

According to the present invention, the bilateral asymmetry of the thickness distribution of the rolled material can be easily adjusted even if the positions of the roll chocks in the rolling direction are changed due to wear of various components including a group of liners. The problems, structures and effects other than those mentioned above will be clarified by the description of the following embodiments.

MODES FOR CARRYING OUT THE INVENTION

In the following, embodiments of the rolling mill and the rolling mill adjustment method will be described with reference to the drawings.

In the following embodiments, when the rolling mill is seen from the front side, the drive side means the side where an electric motor for driving the working rolls is installed and the work side means the side opposite the same.

Embodiment 1

Figure 1:
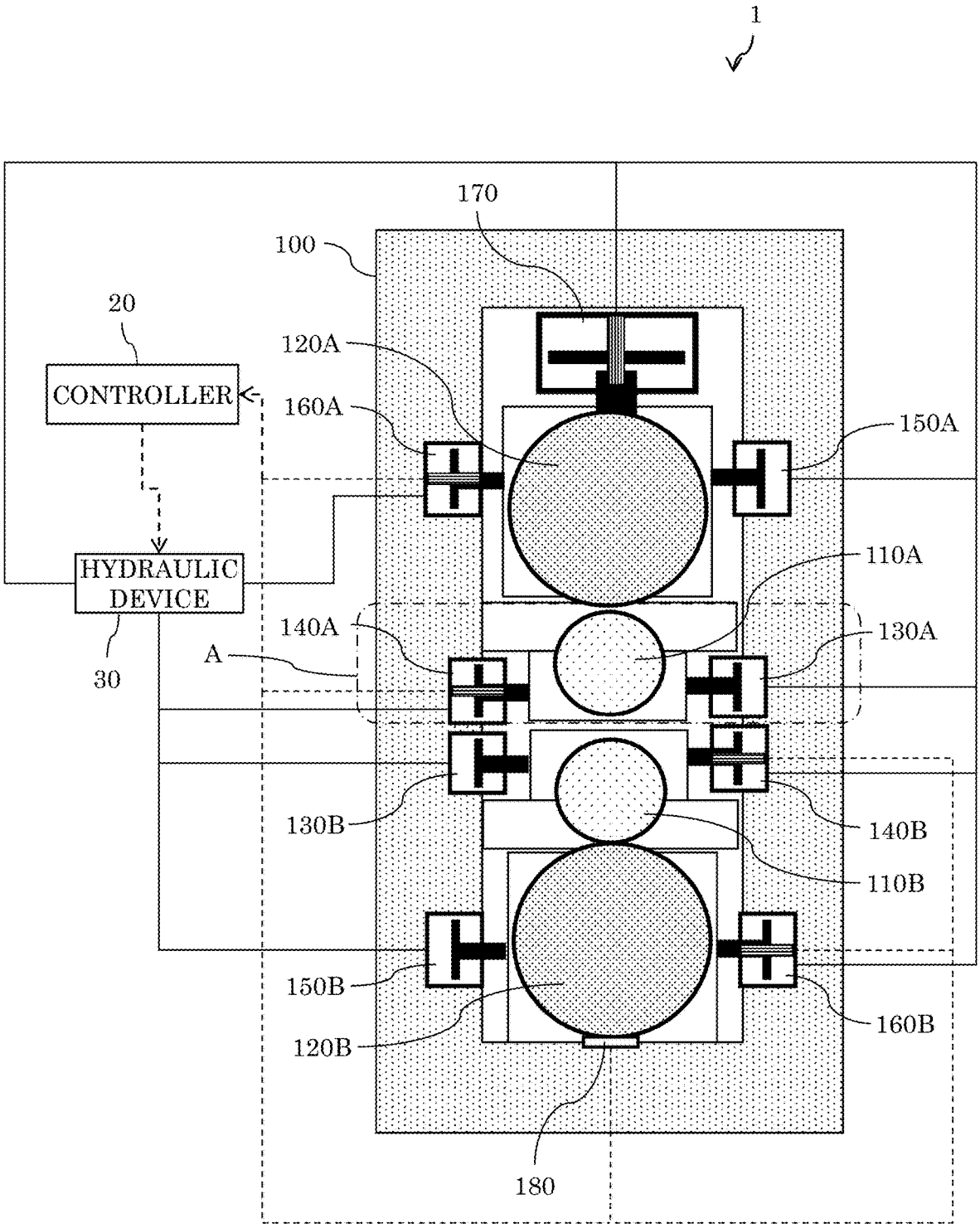
FIG. 1 is a front view of a rolling mill according to embodiment 1 of the present invention, which is a 4-stage rolling mill provided with a hydraulic device on one side and a position control device on the other side.
Figure 2:
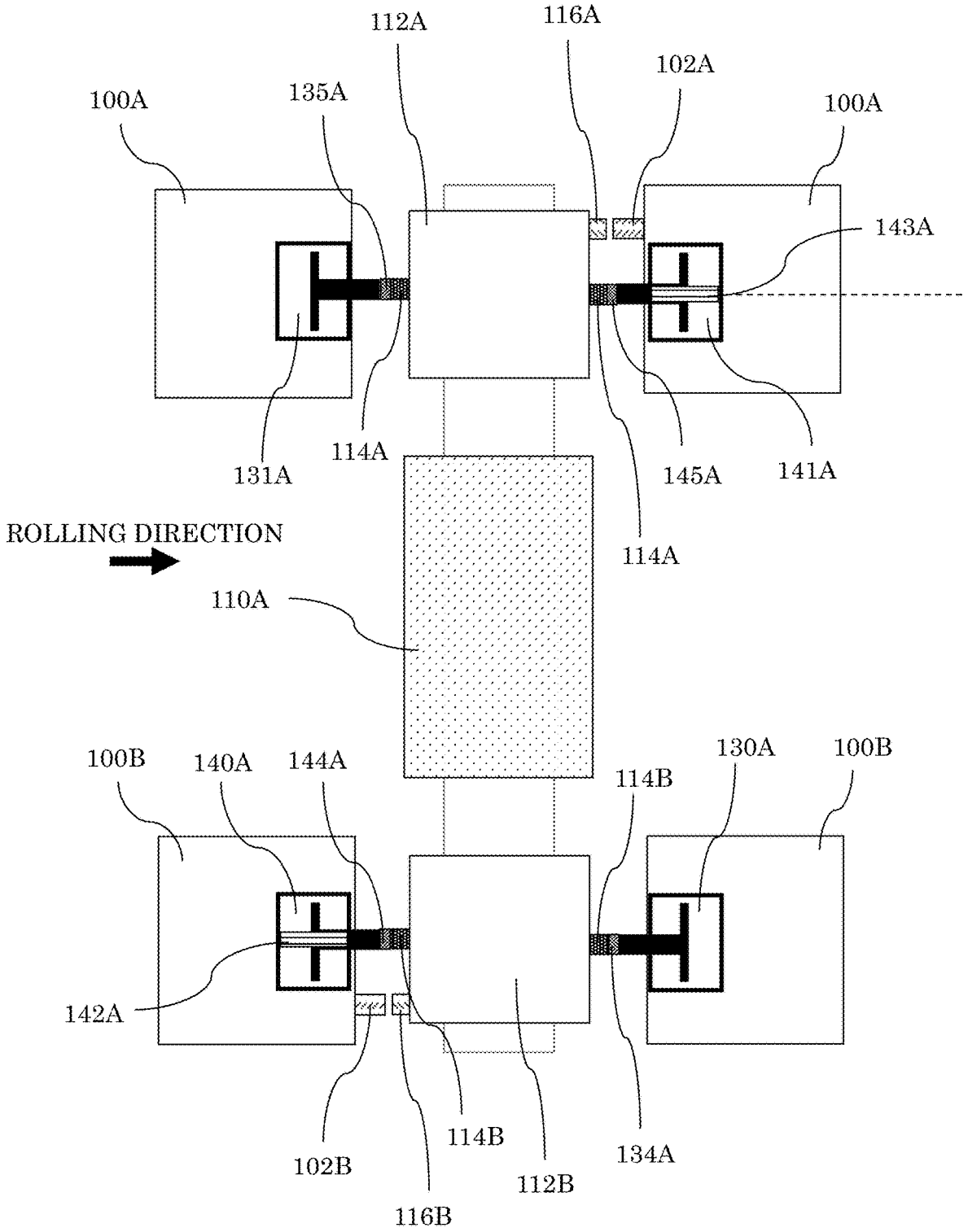
FIG. 2 is a partly enlarged top view of the rolling mill of embodiment 1.

The rolling mill and the rolling mill adjustment method according to embodiment 1 of the present invention will be described with reference to FIGS. 1 through 7. FIGS. 1 and 2 show a 4-stage rolling mill according to the present embodiment. FIG. 1 is a front view of the 4-stage rolling mill of the present embodiment, and FIGS. 2 through 7 are top views of the region A of FIG. 1.

In FIG. 1, a rolling mill 1 is a 4-stage cross roll rolling mill rolling a rolled material, and has a housing 100, a controller 20, and a hydraulic device 30. The rolling mill is not restricted to a 1-stand type rolling mill as shown in FIG. 1. It may also be a rolling mill composed of 2 stands or more.

The housing 100 is equipped with an upper working roll 110A and a lower working roll 110B and upper and lower backup rolls 120A and 120B supporting the working rolls 110A and 110B.

A rolling reduction cylinder 170 is a cylinder which presses the upper backup roll 120A, thereby imparting a rolling reduction force to the upper backup roll 120A, the upper working roll 110A, the lower working roll 110B, and the lower backup roll 120B. The rolling reduction cylinder 170 is provided in each of a work-side housing 100A and a drive-side housing 100B.

A load cell 180 is provided in the bottom portion of the housing 100 as rolling force measurement means measuring the rolling force on the rolled material due to the working rolls 110A and 110B, and outputs measurement result to the controller 20.

The hydraulic device 30 is connected to hydraulic cylinders of working roll pressing devices 130A and 130B and of working roll position control devices 140A and 140B, and this hydraulic device 30 is connected to the controller 20. Similarly, the hydraulic device 30 is connected to hydraulic cylinders of backup roll pressing devices 150A and 150B and of backup roll position control devices 160A and 160B.

Input to the controller 20 are measurement signals from position measurement devices of the load cell 180, working roll position control devices 140A and 140B, and the backup roll position control devices 160A and 160B.

The controller 20 controls the operation of the hydraulic device 30, and supplies/discharges a hydraulic fluid to/from the hydraulic cylinders of the working roll pressing devices 130A and 130B and the working roll position control devices 140A and 140B, thereby controlling the operation of the working roll pressing devices 130A and 130B and the working roll position control devices 140A and 140B. Similarly, the controller 20 controls the operation of the hydraulic device 30, and supplies/discharges a hydraulic fluid to/from the hydraulic cylinders of the backup roll pressing devices 150A and 150B and the backup roll position control devices 160A and 160B, thereby controlling the operation of the backup roll pressing devices 150A and 150B and the backup roll position control devices 160A and 160B.

Each pressing device constitutes a pressing device. In the present invention, the pressing device means a device in which a hydraulic cylinder is pressed in the expanding direction, without the cylinder stroke of the hydraulic cylinder being controlled. It is also called a mill stabilizing device.

Next, the description will center on the structure related to the upper working roll 110A as a representation with reference to FIG. 2. The upper backup roll 120A, the lower working roll 110B, and the lower backup roll 120B are of a structure equivalent to that of the upper working roll 110A, and a detailed description thereof, which is substantially the same as that of the upper working roll 110A, will be left out.

As shown in FIG. 2, a work-side housing 100A and a drive-side housing 100B are on both sides of the upper working roll 110A of the rolling mill 1, and the work-side housing 100A and the drive-side housing 100B are erected perpendicularly with respect to the roll shaft of the upper working roll 110A.

The upper working roll 110A is supported rotatable by the work-side housing 100A and the drive-side housing 100B respectively via a work-side roll chock 112A and a drive-side roll chock 112B.

A working roll pressing device 131A is arranged between the input side of the work-side housing 100A and the work-side roll chock 112A, and presses the roll chock 112A of the upper working roll 110A in the rolling direction. At contact portions of the working roll pressing device 131A and the work-side roll chock 112A, there are respectively provided a pressing device liner 135A and a roll chock side liner 114A.

A working roll position control device 141A is arranged between the output side of the work-side housing 100A and the work-side roll chock 112A, and has a hydraulic cylinder (pressing device) pressing the roll chock 112A of the upper working roll 110A in the anti-rolling direction. The working roll position control device 141A is equipped with a position measurement device 143A measuring the operation amount of the hydraulic cylinder, and performs positional control on the hydraulic cylinder. At contact portions of the working roll position control device 141A and the work-side roll chock 112A, there are respectively provided a position control device liner 145A and the roll chock side liner 114A.

Here, the position control device means a device which measures a hydraulic fluid column position of the hydraulic cylinder as the pressing device by using a position measurement device contained in the device (the position measurement device 143A in the case of the working roll position control device 141A), and control the hydraulic fluid column position until a predetermined hydraulic fluid column position is attained. This also applies to all the position control devices described below.

A working roll position control device 140A is arranged between the input side of the drive-side housing 100B and the drive-side roll chock 112B, and has a hydraulic cylinder (pressing device) pressing the roll chock 112B of the upper working roll 110A in the rolling direction. The working roll position control device 140A is equipped with a position measurement device 142A measuring the operation amount of the hydraulic cylinder, and performs positional control on the hydraulic cylinder. At contact portions of the working roll position control device 140A and the drive-side roll chock 112B, there are respectively provided a position control device liner 144A and the roll chock side liner 114B.

The working roll position control devices 140A and 141A constitute a position control device.

A working roll pressing device 130A is arranged between the output side of the drive-side housing 100B and the drive-side roll chock 112B, and presses the roll chock 112B of the upper working roll 110A in the rolling direction or in the anti-rolling direction. At contact portions of the working roll pressing device 130A and the drive-side roll chock 112B, there are respectively provided a pressing device liner 134A and a roll chock side liner 114B.

With respect to the work-side roll chock 112A, there is provided a work-side position measurement device which measures the position in the rolling direction of the work-side roll chock 112A between the work-side roll chock 112A and the work-side housing 100A including wear of the roll chock side liner 114A, the pressing device liner 135A, and the position control device liner 145A at a position free from an influence of the wear of the roll chock side liner 114A and the position control device liner 145A.

The work-side position measurement device is formed by a roll reference member (first reference member) 116A provided on the work-side roll chock 112A and having a first reference surface, a rolling mill reference member (second reference member) 102A provided on the work-side housing 100A and having a second reference surface capable of coming into contact with the first reference surface of the roll reference member 116A, and the above-mentioned position measurement device 143A.

Usually, in the rolling mill 1 shown in FIG. 1, rolling is performed within a cross angle range of approximately 0° and 1.2°. In view of this, the roll reference member 116A and the rolling mill reference member 102A are provided at roll cross positions that are not usually adopted at the time of rolling (where the first reference surface of the roll reference member 116A and the second reference surface of the rolling mill reference member 102A come into contact with each other when the cross angle is −0.1°). As a result, the reference surfaces do not come into contact with each other during rolling. The roll reference member 116A and the rolling mill reference member 102A are formed of a material which is very hard and which is resistant to corrosion such as stainless steel. They do not suffer wear even if the reference surfaces come into contact with each other or if they are exposed to steam and heat for a long period of time.

Also with respect to the drive-side roll chock 112B, there is provided a drive-side position measurement device which measures the position in the rolling direction of the drive-side roll chock 112B between the drive-side roll chock 112B and the drive-side housing 100B including wear of the roll chock side liner 114B, the pressing device liner 134A, and the position control device liner 144A at a position free from an influence of the wear of the roll chock side liner 114B and the position control device liner 144A.

The drive-side position measurement device is formed by a roll reference member (first reference member) 116B provided on the drive-side roll chock 112B and having a first reference surface, a rolling mill reference member (second reference member) 102B provided on the drive-side housing 100B and having a second reference surface capable of coming into contact with the first reference surface, and the above-mentioned position measurement device 142A.

Also regarding the roll reference member 116B and the rolling mill reference member 102B, they are provided within the rolling mill 1 and at roll cross positions that are not usually adopted at the time of rolling (where the first reference surface of the roll reference member 116B and the second reference surface of the rolling mill reference member 102B come into contact with each other when the cross angle is −0.1°). The roll reference member 116B and the rolling mill reference member 102B are also formed of a material which is very hard and which is resistant to corrosion such as stainless steel. They do not suffer wear even if the reference surfaces come into contact with each other or if they are exposed to steam and heat for a long period of time.

Next, an adjustment method for the rolling mill of the present embodiment will be described in connection with the upper working roll 110A with reference to FIGS. 3 through 7. In the present embodiment, the roll position of each roll is adjusted to zero point (the roll axis is adjusted to the proper, correct position).

The zero point adjustment of the working roll 110A described below is also applicable to the zero point adjustment of the upper backup roll 120A, the lower working roll 110B, and the lower backup roll 120B.

The adjustment method of the rolling mill according to the present embodiment is mainly performed immediately after the replacement of the working rolls 110A and 110B and the backup rolls 120A and 120B.

Figure 3:
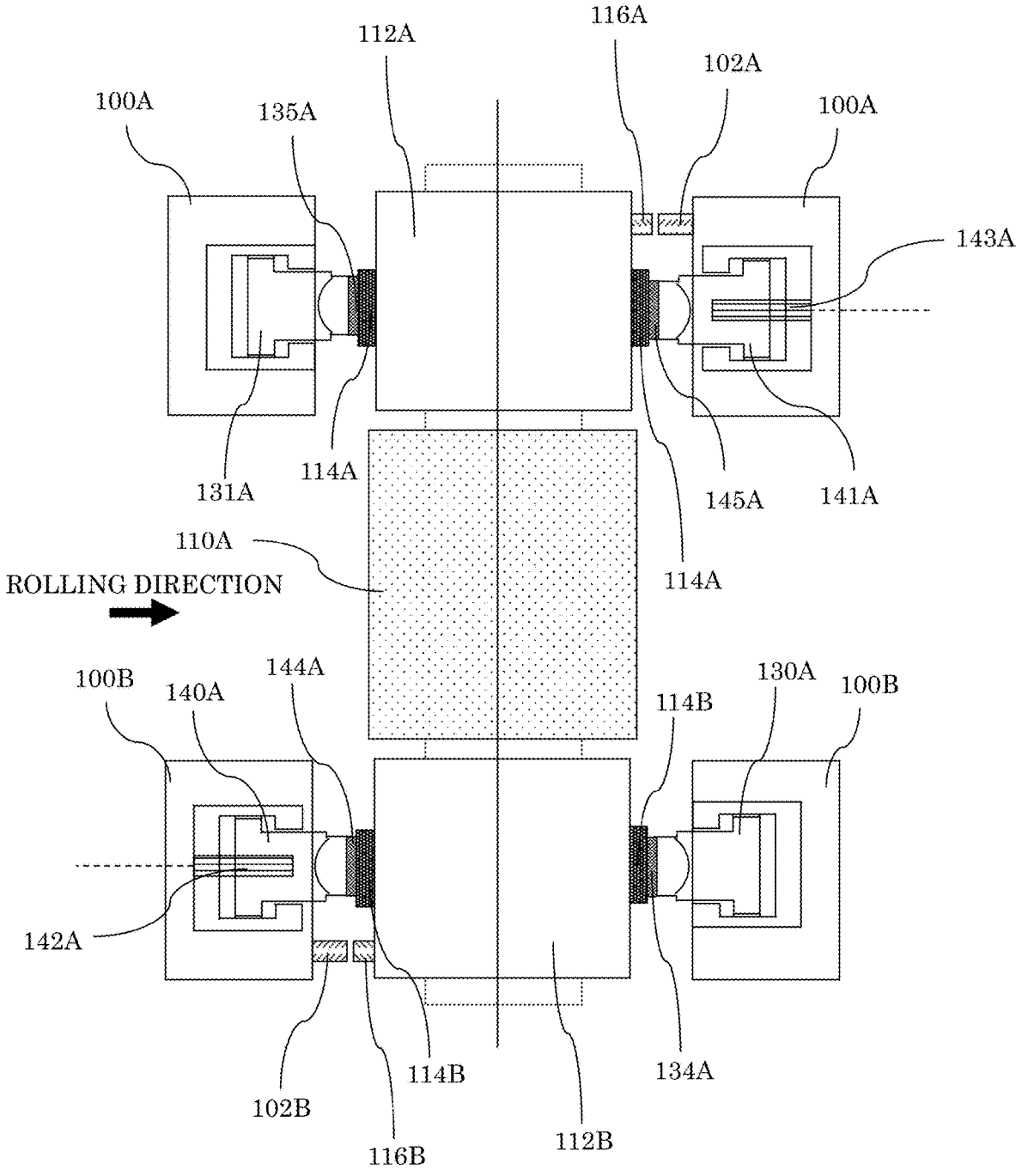
FIG. 3 is a diagram illustrating a roll position adjustment method for the rolling mill of embodiment 1.

FIG. 3 is a diagram illustrating the upper working roll 110A immediately after the replacement (at a cross angle of 0° (temporary)).

More specifically, first, in the state in which the upper working roll 110A has been replaced as shown in FIG. 3, the cross angle is 0° (temporary).

Figure 4:
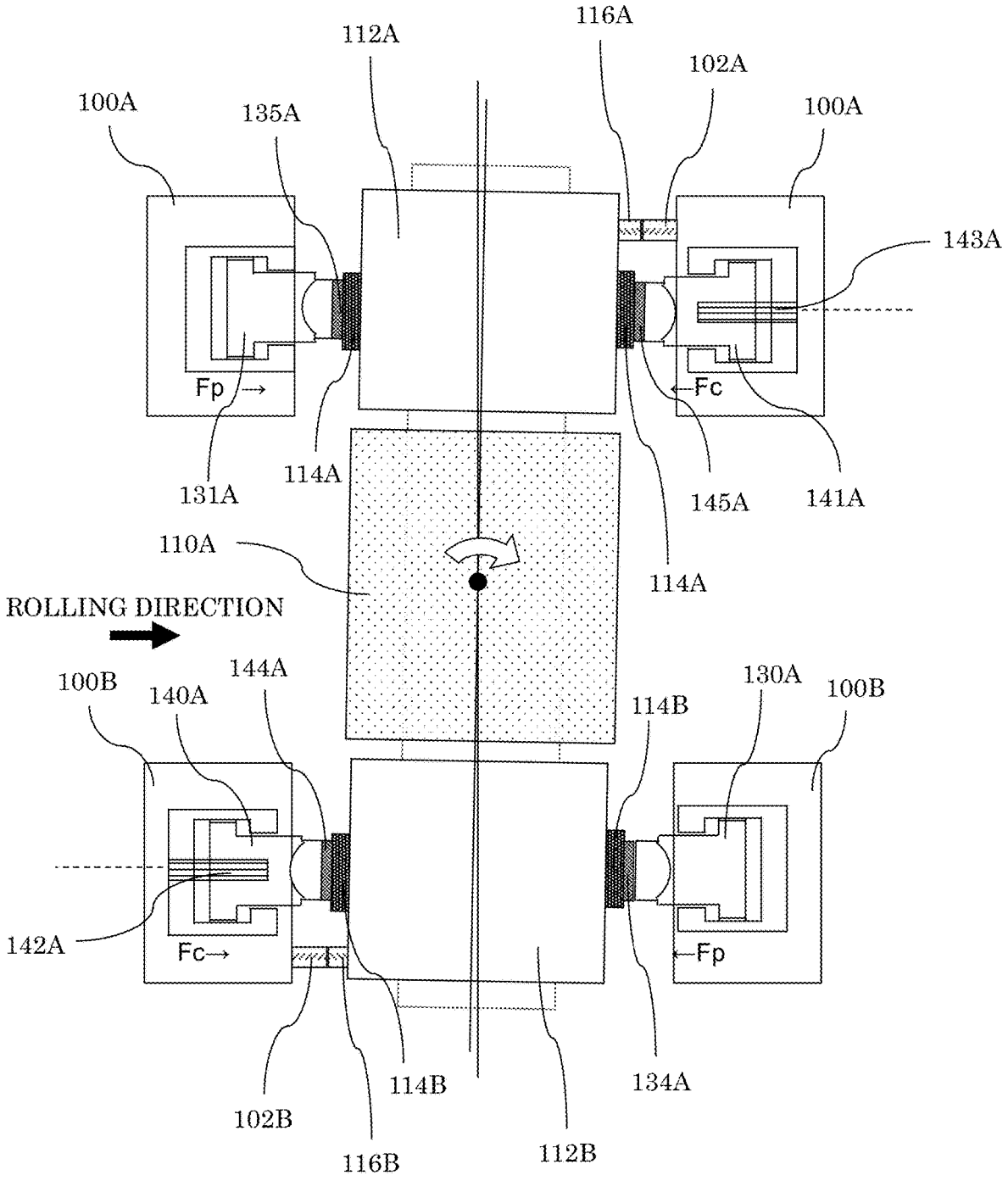
FIG. 4 is a diagram illustrating a roll position adjustment method for the rolling mill of embodiment 1.

Next, as shown in FIG. 4, the roll chock 112A is pressed by the working roll pressing device 131A in a direction opposite the direction in which roll crossing is usually effected (cross angle=−0.1°) until the first reference surface of the roll reference member 116A and the second reference surface of the rolling mill reference member 102A come into contact with each other. Similarly, the roll chock 112B is pressed by the working roll pressing device 130A in a direction opposite the direction in which roll crossing is usually effected until the first reference surface of the roll reference member 116B and the second reference surface of the rolling mill reference member 102B come into contact with each other. In this process, the pressing force Fc of the hydraulic cylinders of the working roll position control devices 140A and 141A is made smaller than the pressing force Fp of the hydraulic cylinders of the working roll pressing devices 130A and 131A.

Figure 5:
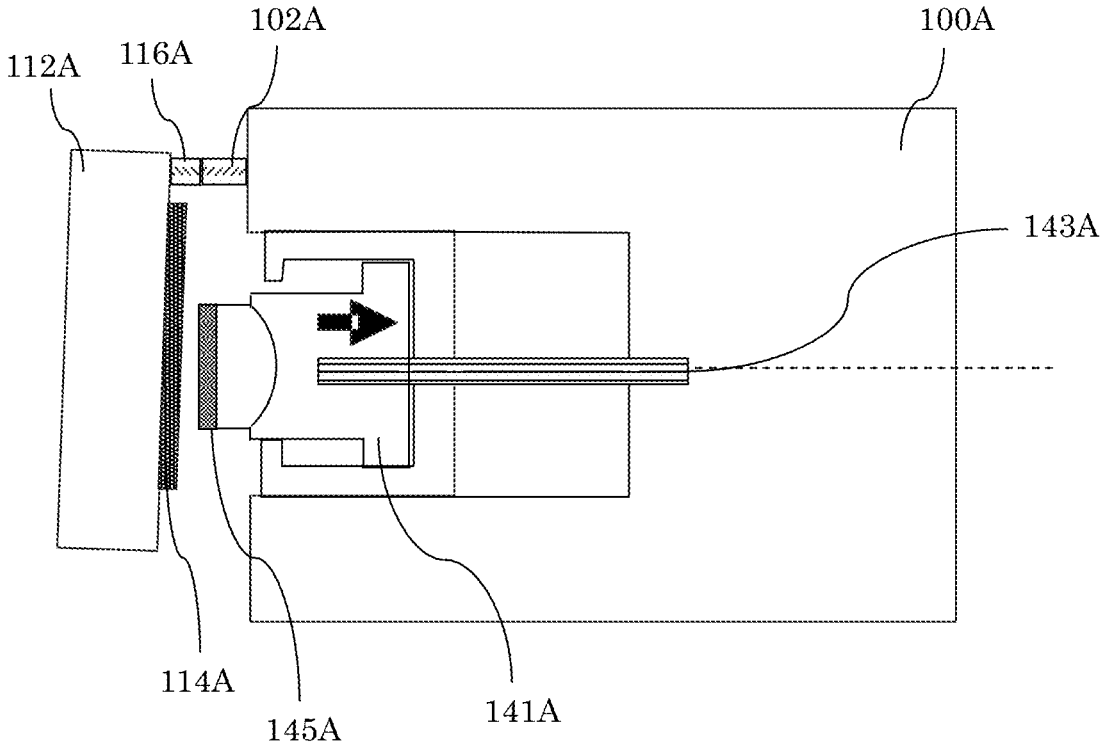
FIG. 5 is a diagram illustrating a roll position adjustment method for the rolling mill of embodiment 1.

When the cross angle of −0.1°, at which the first reference surfaces of the roll reference members 116A and 116B and the second reference surfaces of the rolling mill reference members 102A and 102B respectively come into contact with each other, as shown in FIG. 5, there is generated a gap between the roll chock side liner 114A and the position control device liner 145A due to the wear of the group of liners between the work-side roll chock 112A and work-side housing 100A. Similarly, there is also generated a gap between the roll chock side liner 114B and the position control device liner 144A due to the wear of the group of liners between the drive-side roll chock 112B and drive-side housing 100B. When this deviation in the rolling direction is neglected, it becomes impossible to adjust the cross angle with high accuracy, so that it is necessary to measure this wear amount.

Figure 6:
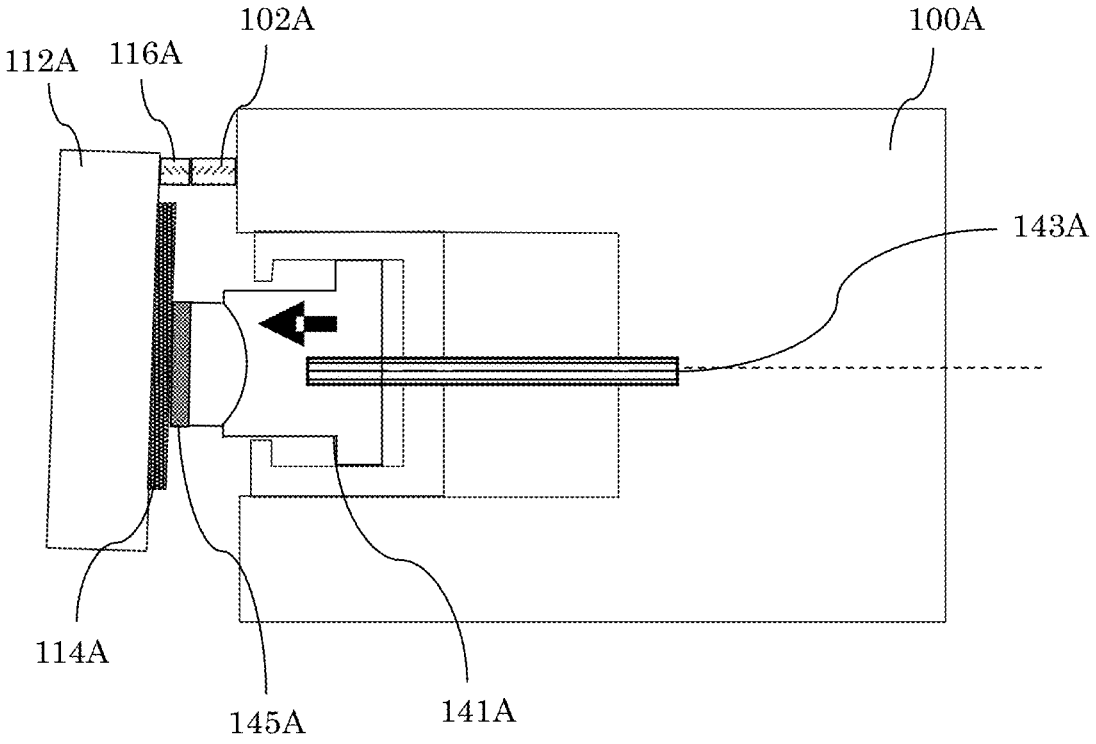
FIG. 6 is a diagram illustrating a roll position adjustment method for the rolling mill of embodiment 1.

In view of this, as shown in FIG. 6, the hydraulic cylinder of the working roll position control device 141A is caused to advance until the position control device liner 145A comes into contact with the roll chock side liner 114A. The advancing amount at this time is measured by the position measurement device 143A. This advancing amount constitutes the correction amount by which the roll positional deviation due to the wear generated between the roll chock side liner 114A and the position control device liner 145A is corrected. Similarly, the advancing amount of the hydraulic cylinder of the working roll position control device 140A until the position control device liner 144A comes into contact with the roll chock side liner 114B is measured by the position measurement device 142A. This advancing amount constitutes the correction amount by which the roll positional deviation due to the wear generated between the roll chock side liner 114B and the position control device liner 144A is corrected. In this way, the positions in the rolling direction of both ends of the chock of the upper working roll 110A are measured, whereby it is possible to calculate the deviation amount in the rolling direction of the chock position. Further, it is possible to calculate the roll axis of the upper working roll 110A.

Next, the hydraulic device 30 is controlled by the controller (strip wedge suppression device) 20, whereby the hydraulic cylinders of the working roll position control devices 140A and 141A are controlled based on the advancing amount of each hydraulic cylinder measured by the position measurement devices 142A and 143A. Through this arrangement, the positions in the rolling direction of the work-side roll chock 112A and the drive-side roll chock 112B are controlled to adjust the roll position of the upper working roll 110A to zero point. The zero point is a position where the cross angle is 0°, and where the upper and lower working rolls 110A and 110B and the upper and lower backup rolls 120A and 120B are perpendicular to the rolling direction.

Further, when positional deviation in the rolling direction is generated between the upper and lower working rolls 110A and 110B, there is generated bilateral asymmetry of the thickness distribution of the rolled material. Similarly, generation of an offset amount between the upper and lower working rolls 110A and 110B and the upper and lower backup rolls 120A and 120B which is different from a predetermined offset amount is not desirable for the rolling mill 1.

In view of this, also with respect to the lower working roll 110B, the operation as shown in FIGS. 4 through 6 is conducted, whereby adjustment to zero point is effected by the working roll position control device 140B. Similarly, also with respect to the upper and lower backup rolls 120A and 120B, the operation shown in FIGS. 4 through 6 is conducted, whereby adjustment to zero point is effected by the backup roll position control devices 160A and 160B. In this way, also with respect to the lower working roll 110B and the upper and lower backup rolls 120A and 120B, the positions in the rolling direction of both ends of the chock are measured, whereby it is possible to obtain axial deviation in the rolling direction between the upper and lower working rolls 110A and 110B and axial deviation between the upper and lower working rolls 110A and 110B and the upper and lower backup rolls 120A and 120B, making it possible to make the working roll axis and the backup roll axis parallel to each other and to perform roll position adjustment (zero point adjustment).

Wear is naturally also generated between the working roll pressing device 131A and the work-side housing 100A and between the working roll pressing device 130A and the drive-side housing 100B. Here, as described above, the working roll pressing devices 130A and 131A are one-direction pressing devices, so that the pressing amount increases by the wear amount. However, the positions in the rolling direction of the work-side roll chock 112A and the drive-side roll chock 112B are adjusted by the working roll position control devices 140A and 141A, so that there is no need to adjust the increase amount of the pressing amount on the working roll pressing devices 130A and 131A side.

Figure 7:
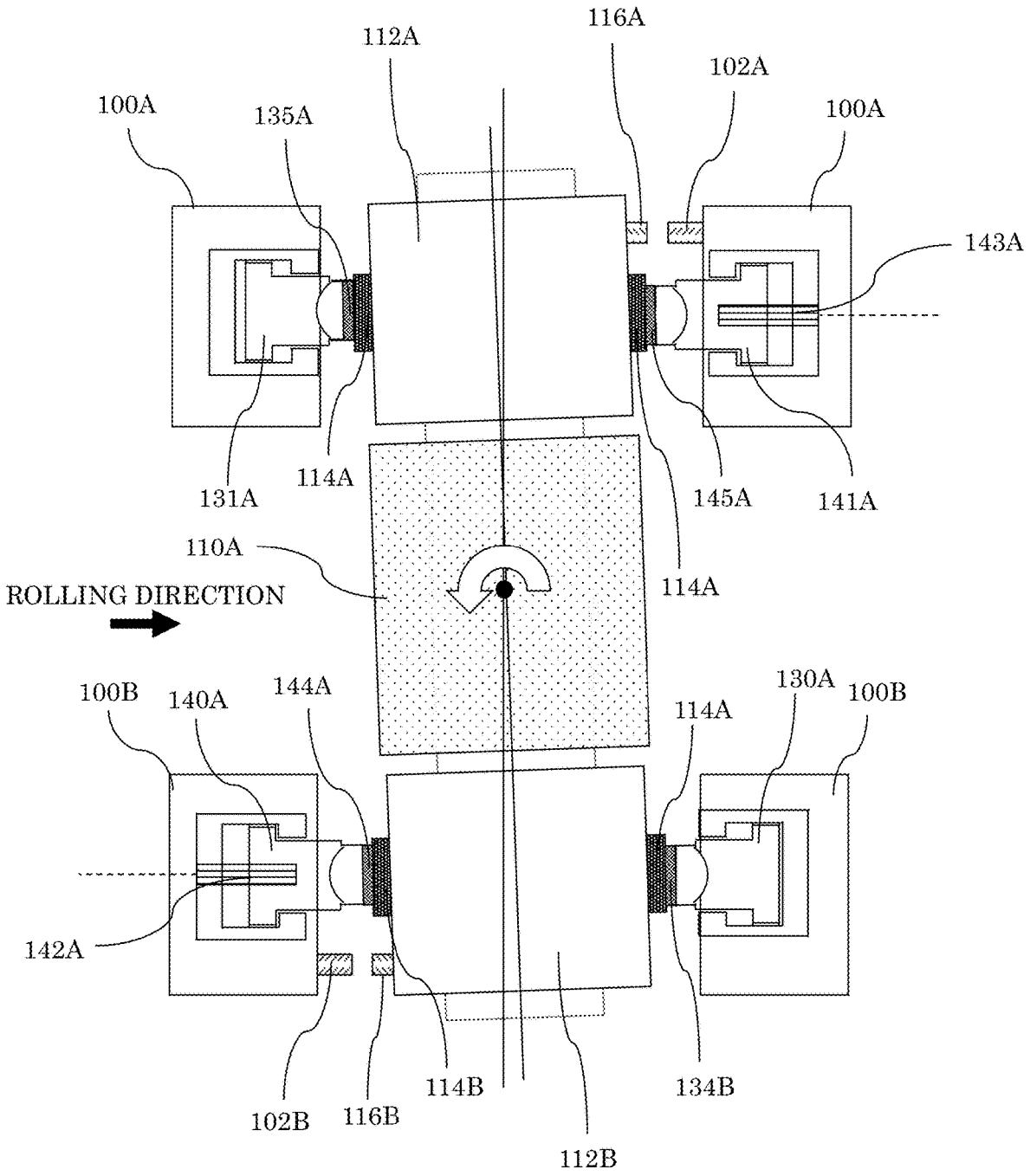
FIG. 7 is a diagram schematically illustrating how rolling is performed by the rolling mill of embodiment 1.

During rolling, the controller 20 controls each hydraulic cylinder such that a normal, desired cross angle is attained as shown in FIG. 7 in the state after the zero point adjustment through the above operational flow.

Next, the effect of the present embodiment will be described.

In embodiment 1 of the present invention described above, the positions in the rolling direction of the chocks of the working rolls 110A and 110B and the backup rolls 120A and 120B are directly measured by the position measurement devices 142A and 143A in the state in which the working rolls 110A and 110B and the backup rolls 120A and 120B are pressed in the rolling direction against the reference surface provided in the rolling mill 1, whereby it is possible to measure the roll chock positions with high accuracy even if the group of liners of the working rolls 110A and 110B and the backup rolls 120A and 120B are worn, making it possible to easily measure the liner wear amount. Further, in the usually adopted range where the cross angle is 0° to approximately 1.2°, the reference surfaces and the roll chock do not come into contact with each other, so that there is no interference between the reference surfaces and the chocks during operation.

Thus, it is possible to measure with high accuracy the positions in the rolling direction of the working rolls 110A and 110B and the backup rolls 120A and 120B without being affected by the wear of the group of liners in the rolling mill 1, so that it is possible to constantly stabilize the positions in the rolling direction of the working rolls 110A and 110B and the backup rolls 120A and 120B by the working roll position control devices 140A and 141A and the backup roll position control devices 160A and 160B. Thus, it is possible to eliminate the minute crossing of the working rolls 110A and 110B and the backup rolls 120A and 120B, making it possible to suppress generation of strip wedge and to achieve an improvement in terms of strip passing property.

Further, in a rolling mill, the chock side and the housing side, in particular, abut each other, so that the abutted portions are subject to wear and breakage. In particular, the impact force when the strip leading edge portion gets engaged with the rolling mill is exerted greatly, so that the wear of the liners is likely to proceed. While in the rolling mill 1 of the present embodiment it is possible to mitigate the impact force to a certain degree by the pressing devices, it is impossible to completely absorb the impact force.

Thus, when the chocks and the housing are directly allowed to abut each other, the repair thereof is troublesome, so that the rolling mill is provided with liners that can be replaced if worn. In an ironworks, the wear of the liners is measured and controlled. However, the inspection of the wear of the liners on the housing side, in particular, requires measurement of the liners on the inner side of the housing, so that it involves a very difficult operation.

In contrast, in the rolling mill and the rolling mill adjustment method of the present embodiment, it is possible to directly measure the positions in the rolling directions of the chocks of the working rolls 110A and 110B and the backup rolls 120A and 120B, so that it is possible to very easily measure and control the wear of the group of liners of the working rolls 110A and 110B and the backup rolls 120A and 120B. Thus, it is advantageously possible to substantially reduce the maintenance time, and to substantially reduce the management of the wear of the group of liners.

The rolling mill and the rolling mill adjustment method of the present embodiment are not restricted to the above-described ones. For example, the present embodiment is also suitably applicable to a rolling mill equipped solely with working rolls and having no backup rolls. Also in the rolling mill equipped solely with working rolls, there is generated offset attributable to positional deviation in the rolling direction of the upper and lower working rolls due to wear, with the result that strip wedge of the rolled material is generated. In the present invention, however, zero point adjustment of the positions in the rolling direction of the upper and lower working rolls is possible, making it possible to suppress strip wedge of the rolled material.

There are no restrictions regarding the positions where the work-side position measurement device and the drive-side position measurement device are provided. They can be provided at a position between the work-side roll chock 112A and the work-side housing 100A free from an influence of the wear, and at a position between the drive-side roll chock 112B and the drive-side housing 100B free from an influence of the wear.

Further, the position control device is not restricted to a hydraulic device equipped with a position measurement device. It may also be a worm reduction gear or the like as described in connection with embodiment 2 described below.

Modification of Embodiment 1

Figure 8:
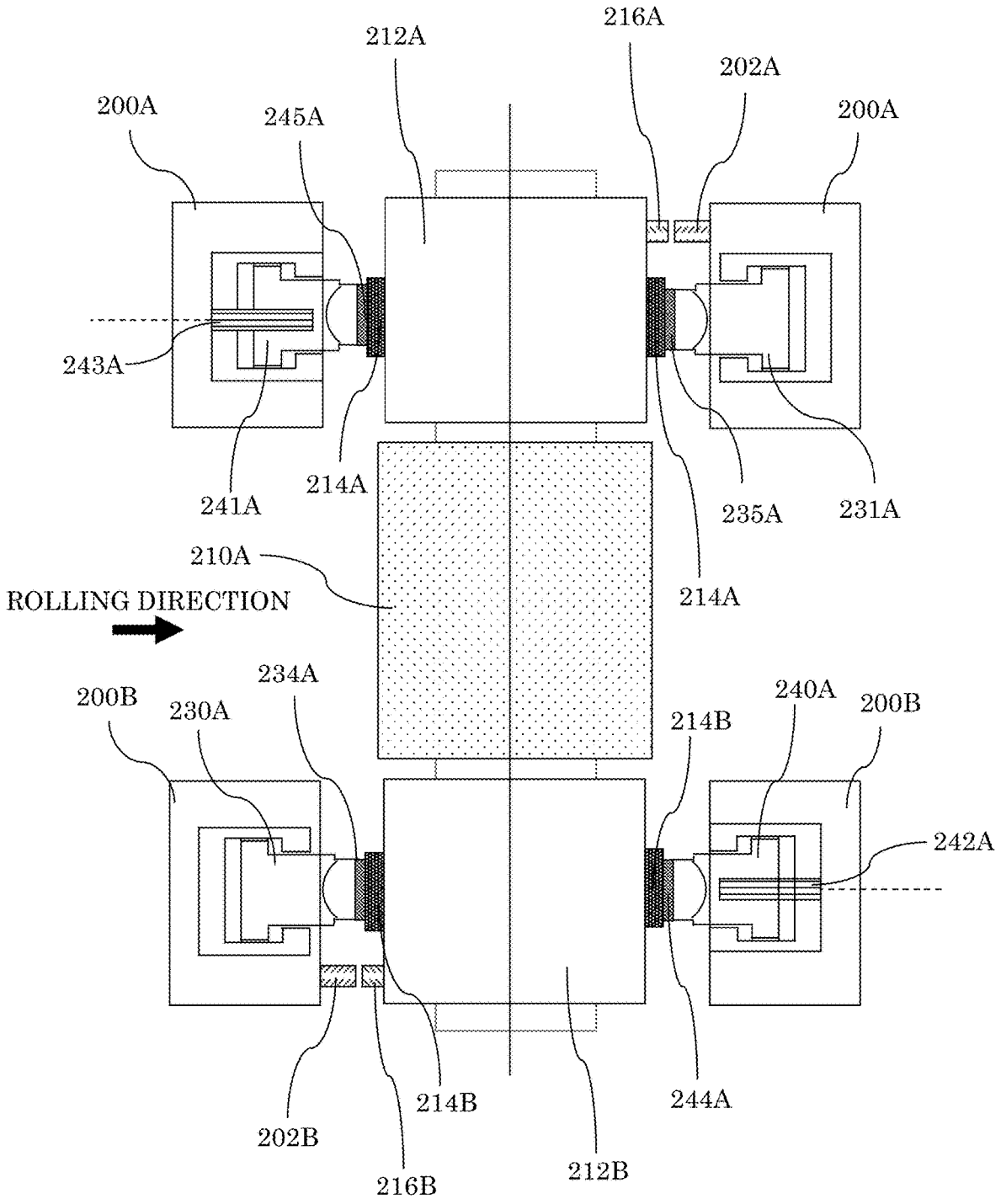
FIG. 8 is a diagram illustrating a roll position adjustment method for a rolling mill according to a modification of embodiment 1 of the present invention.
Figure 9:
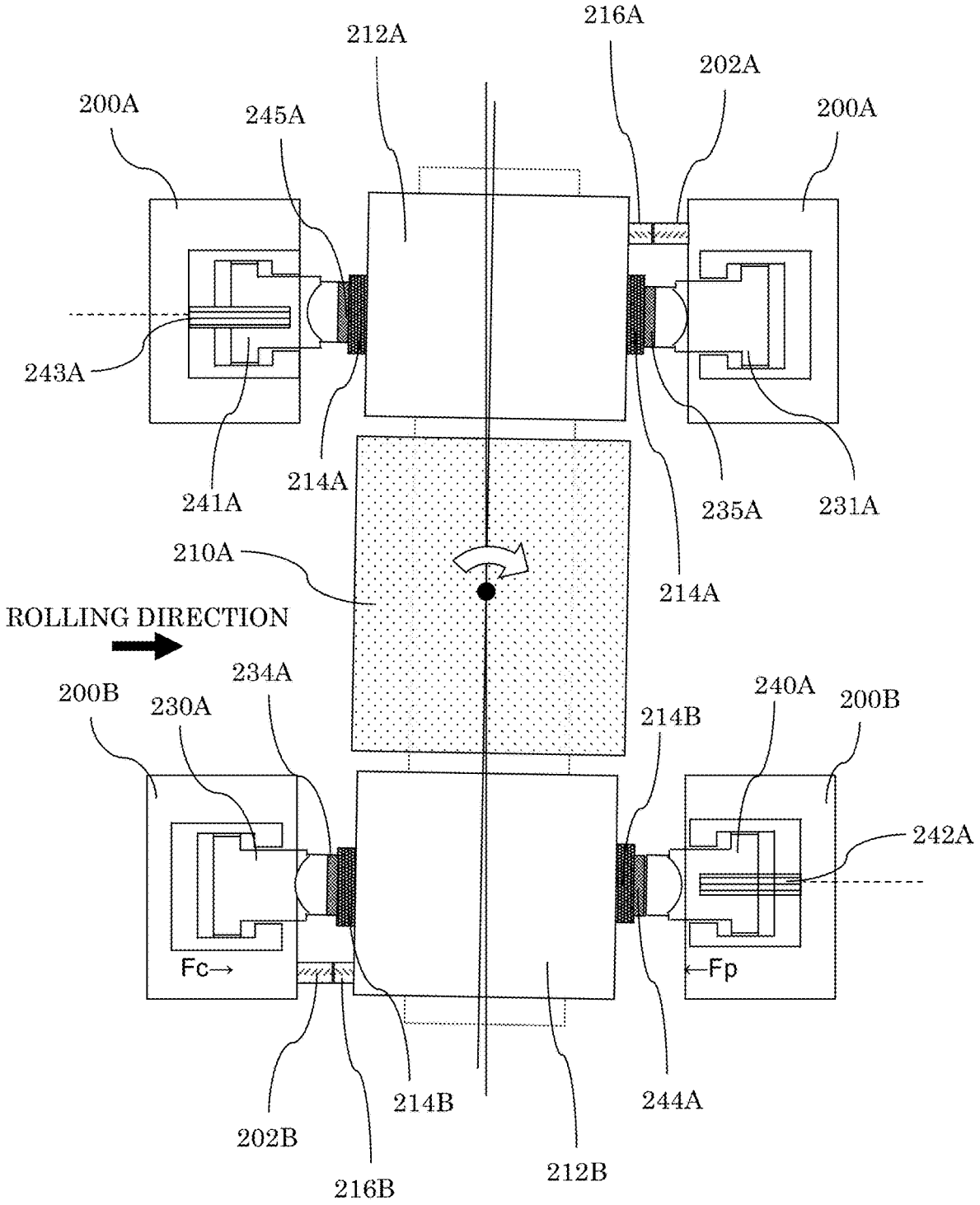
FIG. 9 is a diagram illustrating a roll position adjustment method for a rolling mill according to a modification of embodiment 1.
Figure 10:
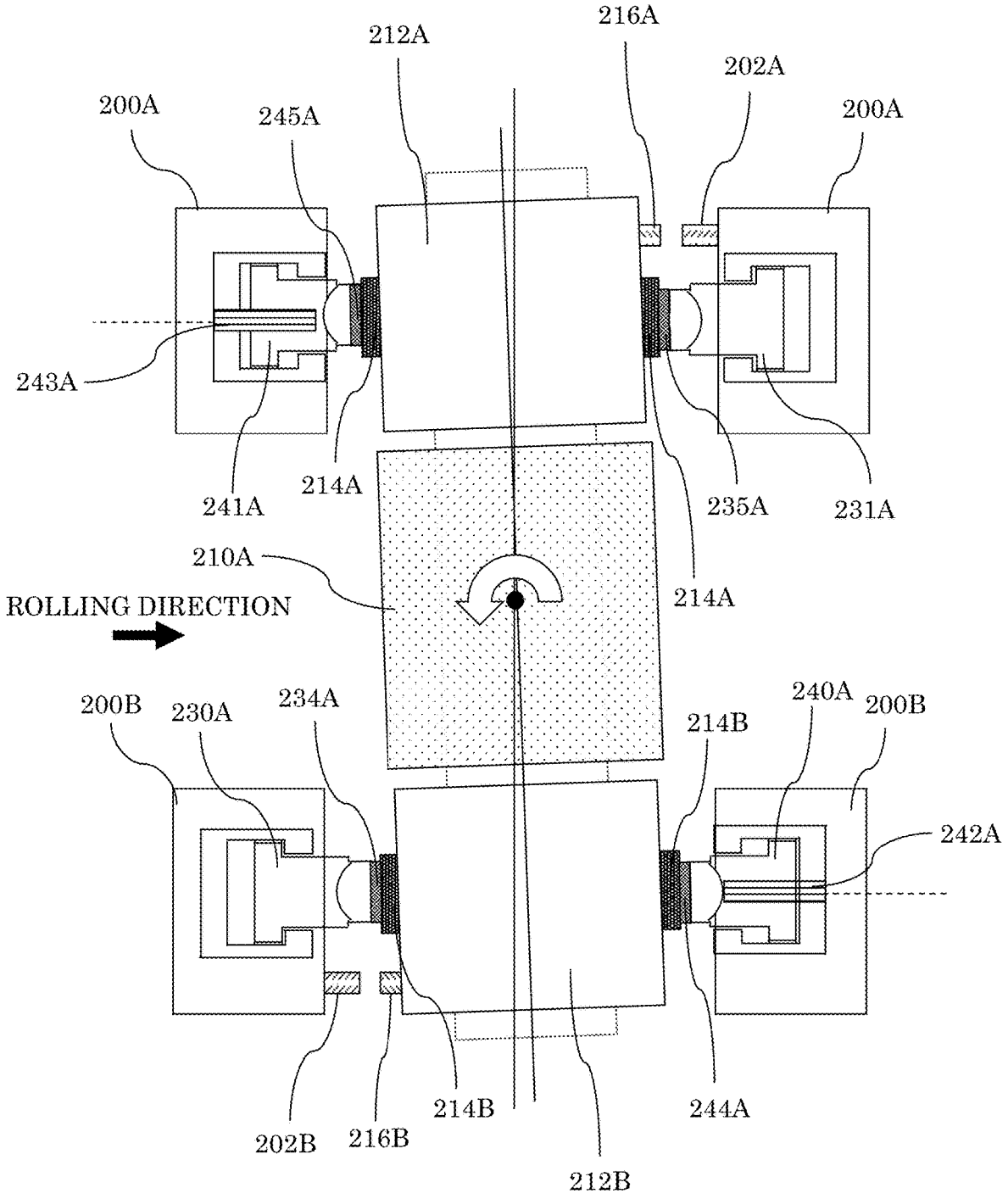
FIG. 10 is a diagram schematically illustrating how rolling is performed by the rolling mill according to a modification of embodiment 1.

Next, a rolling mill and a rolling mill adjustment method according to a modification of embodiment 1 of the present invention will be described with reference to FIGS. 8 through 10. FIGS. 8 through 10 are top views of a portion equivalent to the region A of FIG. 1 of the present modification of embodiment 1 of the rolling mill of the present invention.

As shown in FIG. 8, in the rolling mill of the modification of embodiment 1, a working roll position control device 241A is arranged between the input side of a work-side housing 200A and a work-side roll chock 212A. The working roll position control device 241A is equipped with a position measurement device 243A, and performs positional control on a hydraulic cylinder. At contact portions of the working roll position control device 241A and the work-side roll chock 212A, there are respectively provided a position control device liner 245A and a roll chock side liner 214A.

A working roll pressing device 231A is arranged between the output side of the work-side housing 200A and the work-side roll chock 212A. At contact portions of the working roll pressing device 231A and the work-side roll chock 212A, there are respectively provided a pressing device liner 235A and a roll chock side liner 214A.

A working roll pressing device 230A is arranged between the input side of the drive-side housing 200B and the drive-side roll chock 212B. At contact portions of the working roll pressing device 230A and the work-side roll chock 212B, there are respectively provided a pressing device liner 234A and a roll chock side liner 214B.

A working roll position control device 240A is arranged between the output side of the drive-side housing 200B and the drive-side roll chock 212B. The working roll position control device 240A is equipped with a position measurement device 242A measuring the operation amount of the hydraulic cylinder, and performs positional control on the hydraulic cylinder. At contact portions of the working roll position control device 240A and the drive-side roll chock 212B, there are respectively provided a position control device liner 244A and a roll chock side liner 214B.

With respect to the work-side roll chock 212A, there is provided a work-side position measurement device which measures the position in the rolling direction of the work-side roll chock 212A between the work-side roll chock 212A and the work-side housing 200A including wear of the roll chock side liner 214A, the pressing device liner 235A, and the position control device liner 245A at a position free from an influence of the wear of the roll chock side liner 214A and the position control device liner 245A.

The work-side position measurement device is formed by a roll reference member (first reference member) 216A provided on the work-side roll chock 212A and having a first reference surface, a rolling mill reference member (second reference member) 202A provided on the work-side housing 200A and having a second reference surface capable of coming into contact with the first reference surface of the roll reference member 216A, and the above-mentioned position measurement device 243A.

The roll reference member 216A and the rolling mill reference member 202A are provided at roll cross positions that are not usually adopted at the time of rolling (where the first reference surface of the roll reference member 216A and the second reference surface of the rolling mill reference member 202A come into contact with each other when the cross angle is −0.1°).

Also with respect to the drive-side roll chock 212B, there is provided a drive-side position measurement device which measures the position in the rolling direction of the drive-side roll chock 212B between the drive-side roll chock 212B and the drive-side housing 200B including wear of the roll chock side liner 214B, the pressing device liner 234A, and the position control device liner 244A at a position free from an influence of the wear of the roll chock side liner 214B and the position control device liner 244A.

The drive-side position measurement device is formed by a roll reference member (first reference member) 216B provided on the drive-side roll chock 212B and having a first reference surface, a rolling mill reference member (second reference member) 202B provided on the drive-side housing 200B and having a second reference surface capable of coming into contact with the first reference surface, and the above-mentioned position measurement device 242A.

The roll reference member 216B and the rolling mill reference member 202B are provided at roll cross positions that are not usually adopted at the time of rolling (where the first reference surface of the roll reference member 216B and the second reference surface of the rolling mill reference member 202B come into contact with each other when the cross angle is −0.1°).

Next, a rolling mill adjustment method according to the present modification will be described with reference to FIGS. 8 through 10. In the present modification also, the roll position of each roll is adjusted to zero point (the roll axis is adjusted to the proper, correct position). Also the rolling mill adjustment method of the present modification is mainly conducted immediately after the roll replacement.

As shown in FIG. 9, the roll chock 212A is pressed by the working roll position control device 241A in a direction opposite the direction in which roll crossing is usually effected (cross angle=−0.1°) until the first reference surface of the roll reference member 216A and the second reference surface of the rolling mill reference member 202A come into contact with each other. Similarly, the roll chock 212B is pressed by the working roll position control device 240A in a direction opposite the direction in which roll crossing is usually effected until the first reference surface of the roll reference member 216B and the second reference surface of the rolling mill reference member 202B come into contact with each other. In this process, the working roll pressing devices 230A and 231A are not used.

When the cross angle of −0.1° is attained, the advancing amount of the hydraulic cylinders of the working roll position control devices 240A and 241A assumes a value different from that before the generation of wear due to the wear of the group of liners between the work-side roll chock 212A and the work-side housing 200A and between the drive-side roll chock 212B and the drive-side housing 200B. Then, the positional deviation of the roll due to the wear is corrected based on this advancing amount.

Next, the hydraulic device is controlled by the controller, whereby the hydraulic cylinders of the working roll position control devices 240A and 241A are controlled based on the advancing amounts of the hydraulic cylinders measured by the position measurement devices 242A and 243A. Through this arrangement, the positions in the rolling direction of the work-side roll chock 212A and the drive-side roll chock 212B are controlled to adjust the roll position of the upper working roll 210A to zero point, and to perform cross rolling as shown in FIG. 10.

Otherwise, this modification is substantially of the same structure and operation as those of the rolling mill and the rolling mill adjustment method of embodiment 1 described above, so a detailed description thereof will be left out.

Also in the rolling mill and the rolling mill adjustment method according to the modification of embodiment 1 of the present invention, it is possible to achieve substantially the same effect as the rolling mill and the rolling mill adjustment method according to embodiment 1 described above.

The present modification is also applicable to a rolling mill which is not equipped with any backup rolls and which is solely equipped with working rolls.

The arrangement of the position control devices and the pressing devices is not restricted to that of the present modification and embodiment 1. The position control devices may be arranged on the work side and drive side of the input side of the rolling mill, and the pressing devices may be arranged on the work side and drive side of the output side of the rolling mill. Further, the position control devices may be arranged on the work side and drive side of the output side of the rolling mill, and the pressing devices may be arranged on the work side and drive side of the input side of the rolling mill.

Similarly, there are no restrictions regarding the positions where the work-side position measurement device and the drive-side position measurement device are provided. They may be provided at a position free from an influence of wear between the work-side roll chock 212A and the work-side housing 200A and at a position free from an influence of wear between the drive-side roll chock 212B and the drive-side housing 200B.

Embodiment 2

Figure 11:
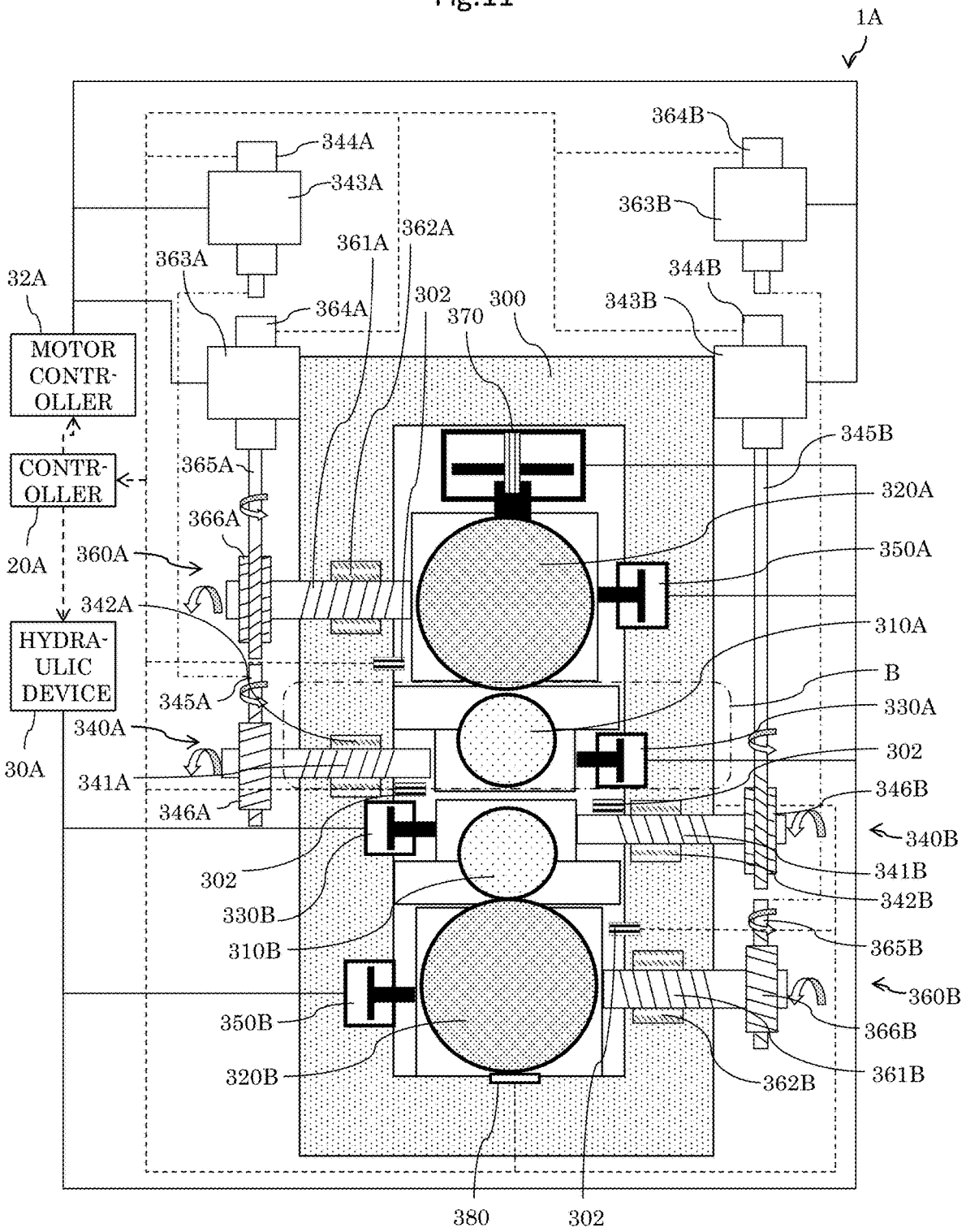
FIG. 11 is a front view of a rolling mill according to embodiment 2 of the present invention, which is a 4-stage rolling mill provided with a hydraulic device on one side and a mechanical position control device, and a short-range position measurement device on the other side.
Figure 12:
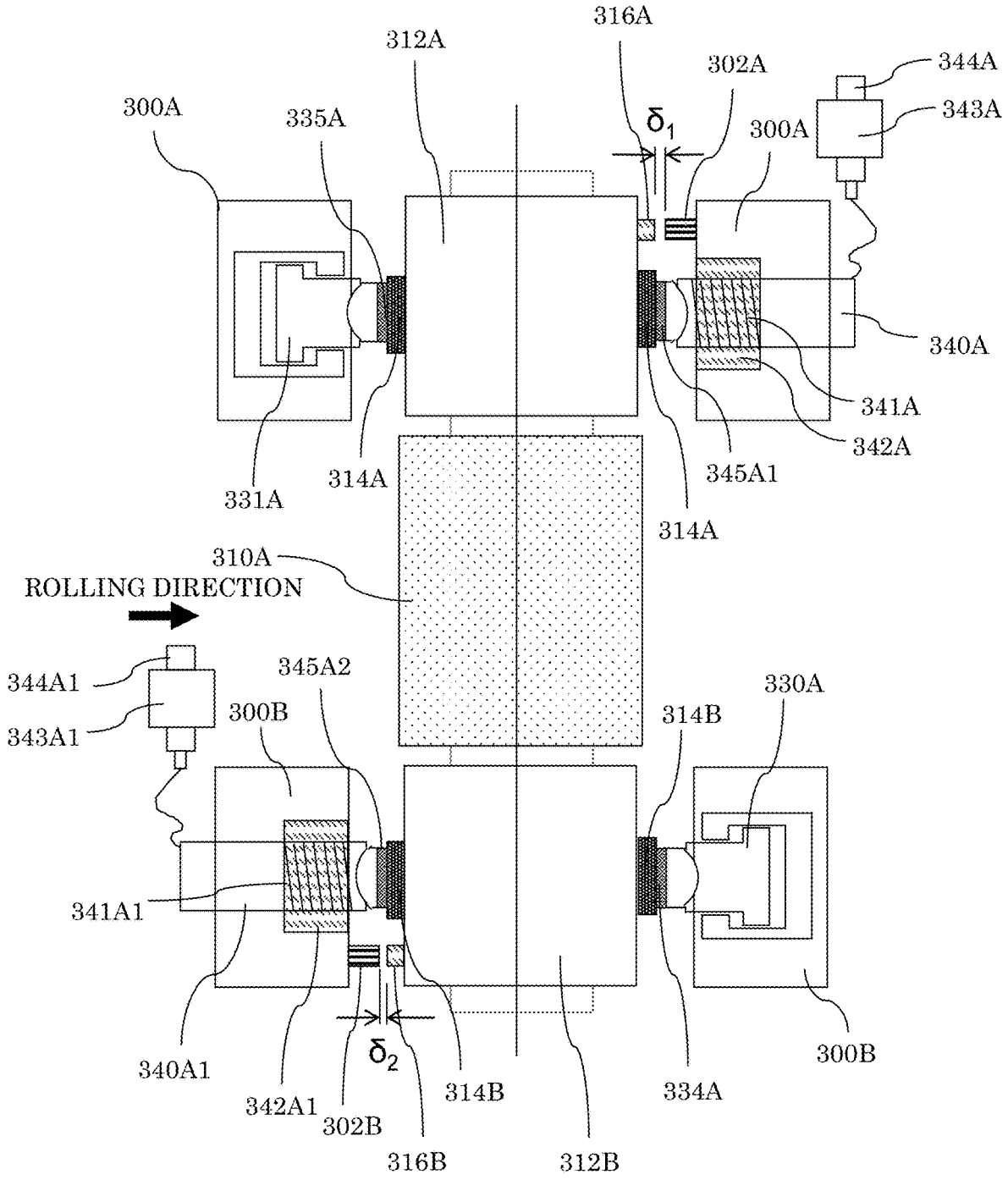
FIG. 12 is a diagram illustrating a roll adjustment method in the case where there is a minute crossing between working rolls and backup rolls in the rolling mill of embodiment 2.
Figure 13:
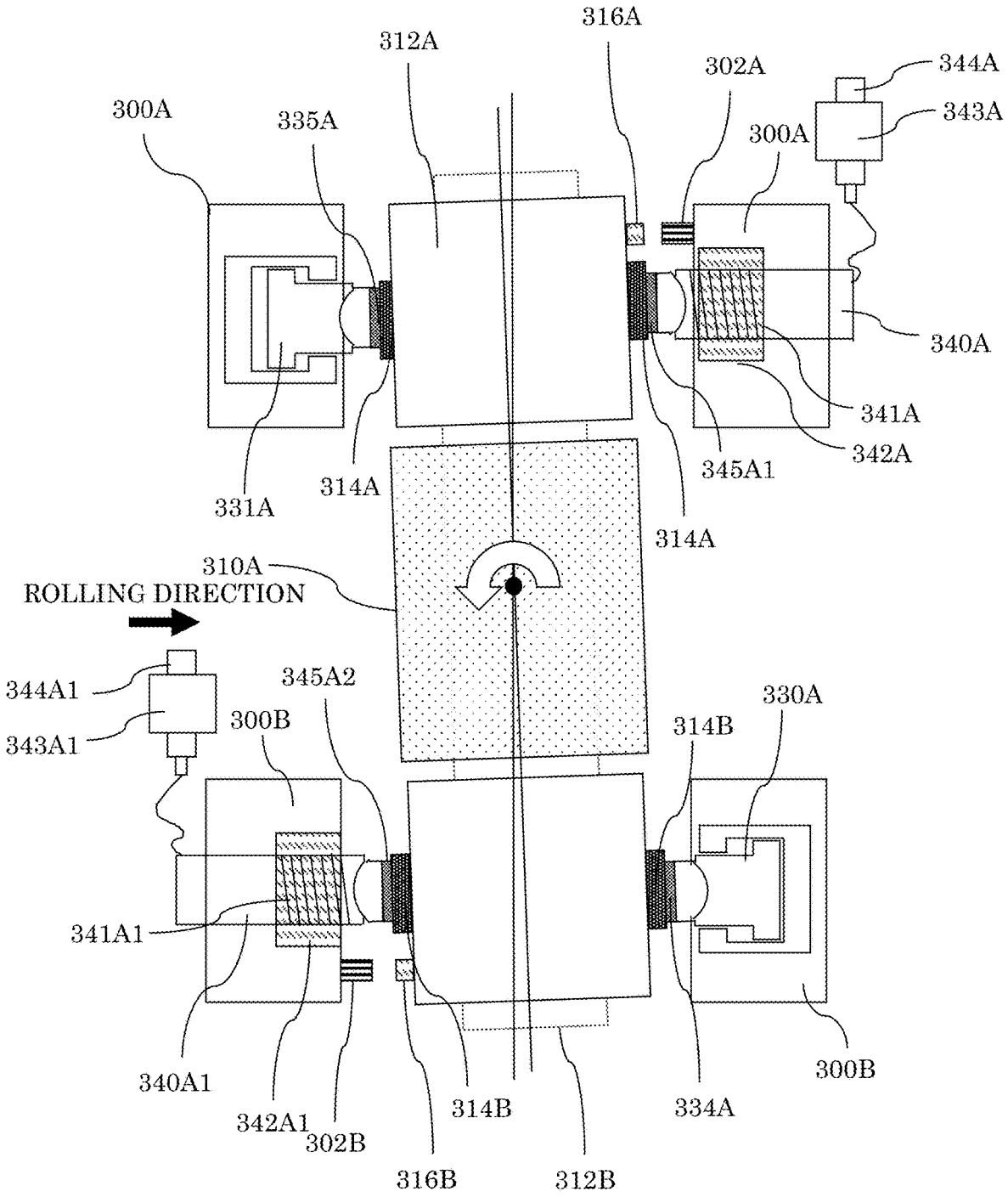
FIG. 13 is a diagram illustrating a roll adjustment method in the case where there is a minute crossing between working rolls and backup rolls in the rolling mill of embodiment 2.

The rolling mill and the rolling mill adjustment method according to embodiment 2 of the present invention will be described with reference to FIGS. 11 through 13. FIG. 11 is a front view of a 4-stage rolling mill according to the present embodiment, and FIGS. 12 and 13 are top views of the region B of FIG. 11.

In FIG. 11, a rolling mill 1A is a 4-stage cross roll rolling mill rolling a rolled material, and has a housing 300, a controller 20A, a hydraulic device 30A, and a motor controller 32A.

The housing 300 is equipped with an upper working roll 310A and a lower working roll 310B, and upper and lower backup rolls 320A and 320B supporting the working rolls 310A and 310B.

A rolling reduction cylinder 370 is a cylinder imparting a rolling reduction force to the upper backup roll 320A, the upper working roll 310A, the lower working roll 310B, and the lower backup roll 320B.

A load cell 380 is provided in the bottom portion of the housing 300 as rolling force measurement means measuring the rolling force on the rolled material due to the working rolls 310A and 310B.

The hydraulic device 30A is connected to the hydraulic cylinders of working roll pressing devices 330A and 330B and of backup roll pressing devices 350A and 350B, and this hydraulic device 30A is connected to the controller 20A.

The motor controller 32A is respectively connected to motors 343A, 343B, 363A, and 363B of working roll position control devices 340A and 340B and backup roll position control devices 360A and 360B.

Input to the controller 20A are measurement signals from rotational angle measurement devices 344A, 344B, 364A, and 364B for the working roll position control devices 340A and 340B and the backup roll position control devices 360A and 360B, a short-range position measurement device 302, and the load cell 380.

The controller 20A controls the operation of the hydraulic device 30A, and supplies/discharges a hydraulic fluid to/from the hydraulic cylinders of the working roll pressing devices 330A and 330B and the backup roll pressing devices 350A and 350B, thereby controlling the operation of the working roll pressing devices 330A and 330B and the backup roll pressing devices 350A and 350B.

Similarly, the controller 20A controls the operation of the motor controller 32A, and outputs a motor drive command to motors 343A, 343B, 363A, and 363B of the working roll position control devices 340A and 340B and the backup roll position control devices 360A and 360B, thereby controlling the operation of the working roll position control devices 340A and 340B and the backup roll position control devices 360A and 360B.

The working roll position control device 340A is a device generally referred to as a worm reduction gear, and is equipped with a screw 341A, a nut 342A, a motor 343A, a rotational angle measurement device 344A, a shaft 345A, and a cogwheel 346A. Through the driving of the motor 343A, the shaft 345A one end of which is mounted to the motor 343A rotates, and the cogwheel 346A mounted to the other end of the shaft 345A rotates, with the result that the screw 341A advances or retreats within the nut 342A fixed to the housing 300, whereby the position in the rolling direction of the upper working roll 310A is controlled to a predetermined position. The working roll position control device 340A indirectly measures the position in the rolling direction of a position control device liner 345A1 described below by the rotational angle measurement device 344A. The working roll position control device 340A1 is a device generally referred to as a worm reduction gear, and is equipped with a screw 341A1, a nut 342A1, a motor 343A1, a rotational angle measurement device 344A1, a shaft, and a cogwheel. The operation thereof is substantially the same as that of the working roll position control device 340A.

The working roll position control device 340B is equipped with a screw 341B, a nut 342B, a motor 343B, a rotational angle measurement device 344B, a shaft 345B, and a cogwheel 346B. The backup roll position control device 360A is equipped with a screw 361A, a nut 362A, a motor 363A, a rotational angle measurement device 364A, a shaft 365A, and a cogwheel 366A. The backup roll position control device 360B is equipped with a screw 361B, a nut 362B, a motor 363B, a rotational angle measurement device 364B, a shaft 365B, and a cogwheel 366B. The operation thereof is substantially the same as that of the working roll position control device 340A.

Next, the structure around the upper working roll 310A will be described with reference to FIG. 12. The upper backup roll 320A, the lower working roll 310B, and the lower backup roll 320B are of a structure equivalent to that of the upper working roll 310A, so a detailed description thereof will be left out.

As shown in FIG. 12, the upper working roll 310A is supported rotatable by the work-side housing 300A and the drive-side housing 300B via the work-side roll chock 312A and the drive-side roll chock 312B, respectively.

The working roll pressing device 331A is arranged between the input side of the work-side housing 300A and the work-side roll chock 312A, and presses the roll chock 312A of the upper working roll 310A in the rolling direction. At the contact portions of the working roll pressing device 331A and the work-side roll chock 312A, there are respectively provided a pressing device liner 335A and a roll chock side liner 314A.

The working roll position control device 340A is arranged between the output side of the work-side housing 300A and the work-side roll chock 312A, and presses the roll chock 312A of the upper working roll 310A in the anti-rolling direction. At the contact portions of the working roll position control device 340A and the work-side roll chock 312A, there are respectively provided a position control device liner 345A1 and a roll chock side liner 314A. The working roll position control device 340A is equipped with the rotational angle measurement device 344A for indirectly measuring the position in the rolling direction of the position control device liner 345A1.

The working roll position control device 340A1 is arranged between the input side of the drive-side housing 300B and the drive-side roll chock 312B, and presses the roll chock 312B of the upper working roll 310A in the rolling direction. At the contact portions of the working roll position control device 340A1 and the drive-side roll chock 312B, there are respectively provided a position control device liner 345A2 and a roll chock side liner 314B. The working roll position control device 340A1 is equipped with a rotational angle measurement device 344A1 for indirectly measuring a position in the rolling direction of the position control device liner 345A2.

The working roll pressing device 330A is arranged between the output side of the drive-side housing 300B and the drive-side roll chock 312B, and presses the roll chock 312B of the upper working roll 310A in the rolling direction or the anti-rolling direction. At contact portions of the working roll pressing device 330A and the drive-side roll chock 312B, there are respectively provided a pressing device liner 334A and a roll chock side liner 314B.

With respect to the work-side roll chock 312A, there is provided a work-side position measurement device configured to measure the position in the rolling direction of the work-side roll chock 312A between the work-side roll chock 312A and the work-side housing 300A including wear of the roll chock side liner 314A, the pressing device liner 335A, and the position control device liner 345A1 at a position free from an influence of the wear of the roll chock side liner 314A and the position control device liner 345A1.

The work-side position measurement device is formed by a roll reference member 316A provided on the work-side roll chock 312A and having a reference surface, and a short-range position measurement device 302A provided on the work-side housing 300A and measuring a distance to the reference surface of the roll reference member 316A.

The roll reference member 316A and the short-range position measurement device 302A are provided inside the rolling mill 1A, and are arranged at positions where they do not suffer from wear even during rolling.

The roll reference member 316A and the short-range position measurement device 302A do not come into contact with each other even during roll chock position measurement, and do not suffer from wear.

The short-range position measurement device 302A is, for example, an eddy current type distant measurement device. In the case where the cross angle is moved from 0° to 1.2°, the movement amount of the roll chock is as large as approximately 55 mm. In the roll chock position measurement, however, it is only necessary for the minute positional deviation amount at the time of roll adjustment to zero point to be measured, and a measurement range of 10 mm or less suffices. Thus, it is possible to perform high accuracy measurement, and the maintenance is facilitated.

Also with respect to the drive-side roll chock 312B, there is provided a drive-side position measurement device configured to measure the position in the rolling direction of the drive-side roll chock 312B between the drive-side roll chock 312B and the drive-side housing 300B including wear of the roll chock side liner 314B, the pressing device liner 334A, and the position control device liner 345A2 at a position free from an influence of the wear of the roll chock side liner 314B and the position control device liner 345A2.

The drive-side position measurement device is formed by a roll reference member 316B provided on the drive-side roll chock 312B and having a reference surface, and a short-range position measurement device 302B provided on the drive-side housing 300B and measuring a distance to a reference surface of the roll reference member 316B.

The roll reference member 316B and the short-range position measurement device 302B are also provided inside the rolling mill 1A, and are arranged at positions where they do not suffer from wear even during rolling. The roll reference member 316B and the short-range position measurement device 302B do not come into contact with each other even during roll chock position measurement, and do not suffer from wear. Also for the short-range position measurement device 302B, a measurement range of 10 mm or less suffices, and it is, for example, an eddy current type short range distance measurement device.

Next, a rolling mill adjustment method according to the present embodiment will be described. Also in the present embodiment, the roll position of each roll is adjusted to zero point (the roll axis is adjusted to the proper, correct position).

Also the rolling mill adjustment method of the present embodiment is also mainly executed immediately after the replacement of the working rolls 310A and 310B and the backup rolls 320A and 320B.

More specifically, first, in the state in which the upper working roll 310A has been replaced as shown in FIG. 12, the cross angle is 0° (temporary).

Next, regarding the working roll position control device 340A, the roll chock 312A provided with the roll reference member 316A is pressed by the working roll position control device 340A such that the distance 51 to the reference surface of the roll reference member 316A measured by the short-range position measurement device 302A is a predetermined distance (the distance before the wear of the liner), whereby the position in the rolling direction of the roll chock 312A is directly adjusted to zero point.

Also regarding the working roll position control device 340A1, the roll chock 312B provided with the roll reference member 316B is pressed by the working roll position control device 340A1 such that the distance $\delta_2$ to the reference surface of the roll reference member 316B measured by the short-range position measurement device 302B is a predetermined distance (the distance before the wear of the liner), whereby the position in the rolling direction of the roll chock 312B is directly adjusted to zero point.

The positions in the rolling direction of the position control device liners 345A1 and 345A2 in these processes are respectively indirectly measured by the rotational angle measurement devices 344A and 344A1 for measuring the rotational angles of the motors 343A and 343A1, and are recorded.

Similarly, also regarding the lower working roll 310B, adjustment to zero point is effected by the working roll position control device 340B. Also the upper and lower backup rolls 320A and 320B are adjusted to zero point by the backup roll position control devices 360A and 360B. In this way, also with respect to the lower working roll 310B and the upper and lower backup rolls 320A and 320B, the positions in the rolling direction of both ends of the chock are measured, whereby it is possible to obtain the axial deviation in the rolling direction between the upper and lower working rolls 310A and 310B and the axial deviation in the rolling direction between the upper and lower working rolls 310A and 310B and the upper and lower backup rolls 320A and 320B.

In this way, by means of the short-range position measurement device 302, there are directly measured the positions in the rolling direction of both ends of the chock of the working rolls 310A and 310B and the positions in the rolling direction of both ends of the chock of the backup rolls 320A and 320B. Further, by connecting the measured roll chock both end positions by a straight line, the respective roll axes are calculated, and the axial deviation (minute crossing) of the working rolls 310A and 310B and the backup rolls 320A and 320B is calculated. Further, the axial deviation in the rolling direction between the upper and lower working rolls 310A and 310B is obtained.

During rolling, the controller 20A controls each roll position control device such that a usual, desired cross angle is attained as shown in FIG. 13 by utilizing the parameters at the time of zero point adjustment through the flow as described above.

Otherwise, the present embodiment is substantially of the same structure and operation as those of the rolling mill and the rolling mill adjustment method of embodiment 1 described above, so a detailed description thereof will be left out.

Also in the rolling mill and the rolling mill adjustment method of embodiment 2 of the present invention, it is possible to achieve substantially the same effect as that of the rolling mill and the rolling mill adjustment method of embodiment 1 described above.

Further, also in a rolling mill in which the reference member cannot be installed, it is possible to accurately grasp the roll chock position by installing short-range position measurement devices 302A and 302B directly measuring the position in the rolling direction of the roll chock.

Also embodiment 2 is applicable to a rolling mill which is equipped with no backup rolls and which is solely equipped with working rolls.

Further, also in the present embodiment 2, there are no restrictions regarding the positional relationship between the position control device and the pressing device and the positional relationship between the work-side position measurement device and the drive-side position measurement device, and positional exchange is allowed as appropriate.

Modification of Embodiment 2

Figure 14:
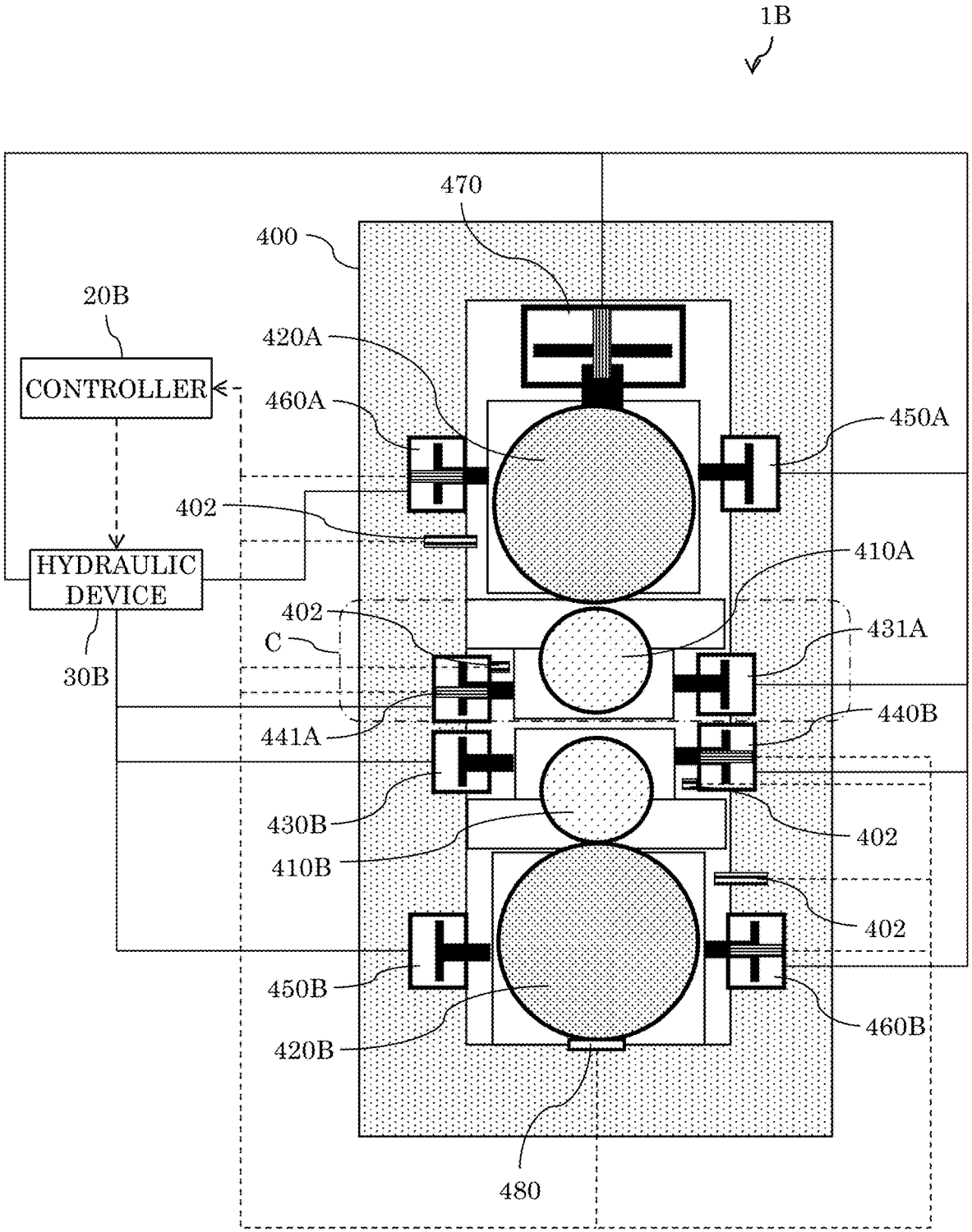
FIG. 14 is a front view of a rolling mill according to a modification of embodiment 2 of the present invention, which is a 4-stage rolling mill in which hydraulic devices are provided on both sides thereof and a short-range position measurement device is provided.
Figure 15:
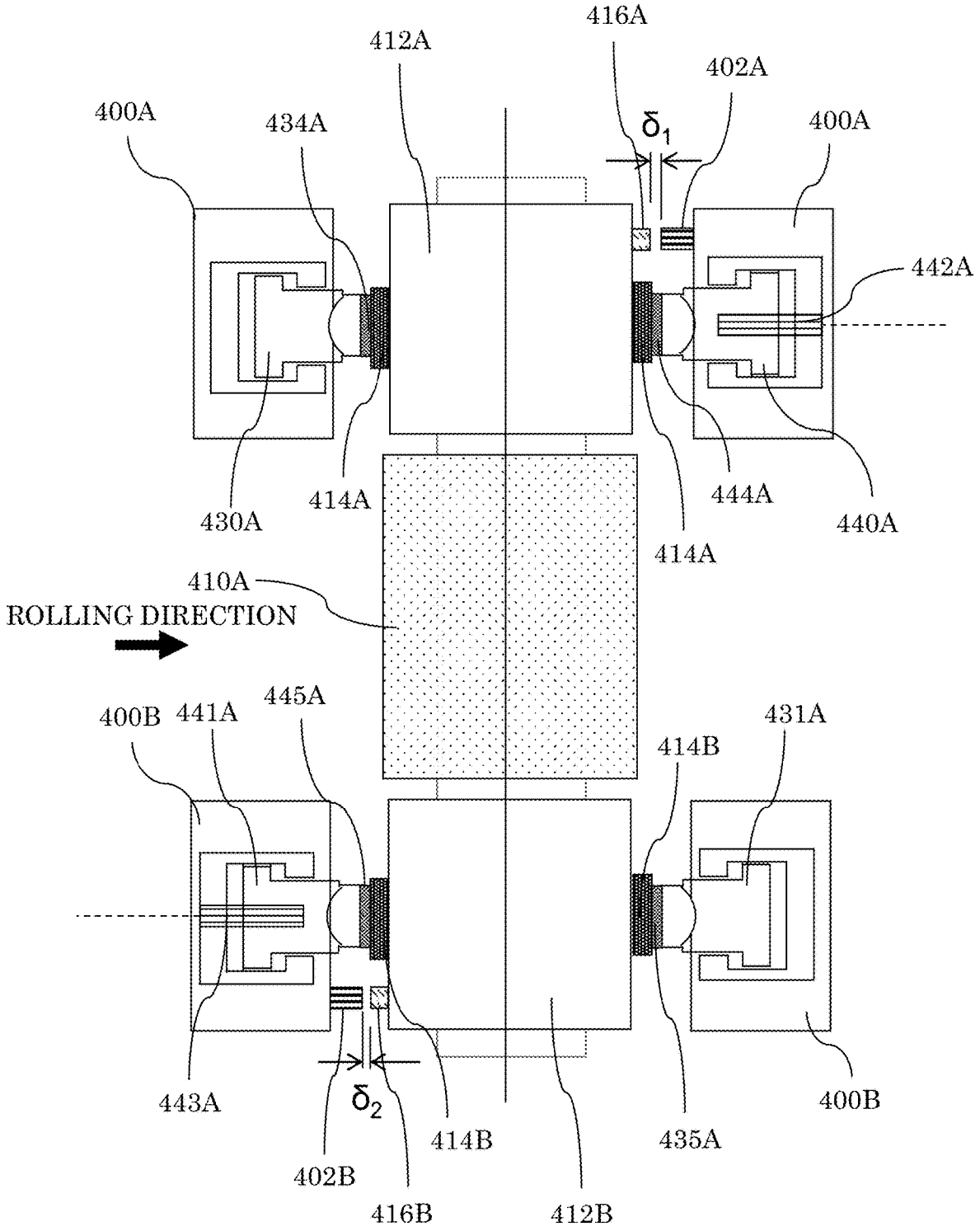
FIG. 15 is a diagram illustrating a roll adjustment method in the case where there is a minute crossing between the working rolls and the backup rolls in a rolling mill according to a modification of embodiment 2.
Figure 16:
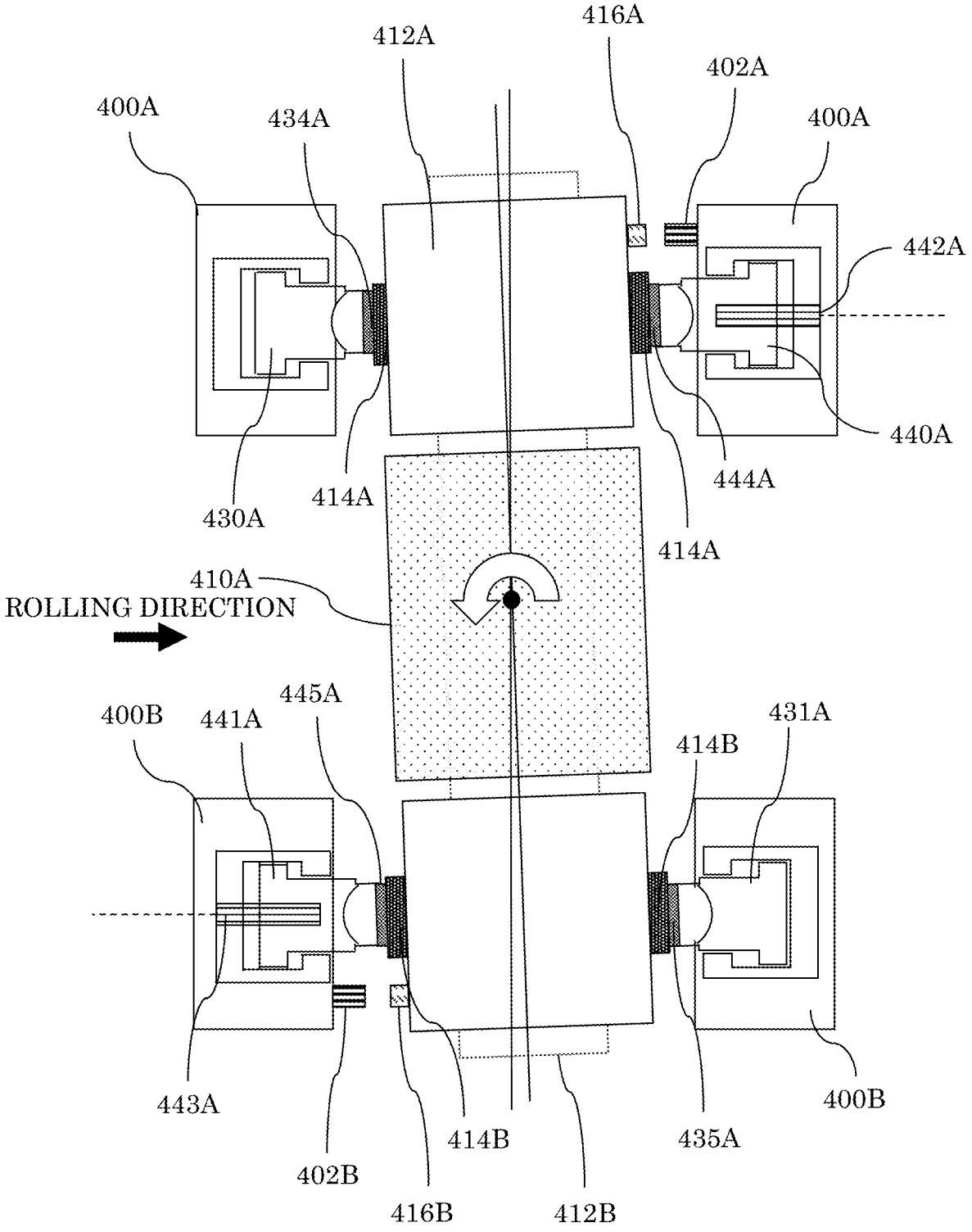
FIG. 16 is a diagram illustrating a roll adjustment method in the case where there is a minute crossing between the working rolls and the backup rolls in a rolling mill according to a modification of embodiment 2.

Next, the rolling mill and the rolling mill adjustment method according to a modification of embodiment 2 of the present invention will be described with reference to FIGS. 14 through 16. FIG. 14 is a front view of a 4-stage rolling mill according to the present embodiment, and FIGS. 15 and 16 are top views of the region C of FIG. 14.

In FIG. 14, a rolling mill 1B is a 4-stage cross roll rolling mill rolling a rolled material, and has a housing 400, a controller 20B, and a hydraulic device 30B.

The housing 400 is equipped with a short-range position measurement device 402, working rolls 410A and 410B, backup rolls 420A and 420B, working roll pressing devices 431A and 430B, working roll position control devices 441A and 440B, backup roll pressing devices 450A and 450B, backup roll position control devices 460A and 460B, a rolling reduction cylinder device 470, and a load cell 480.

Input to the controller 20B are measurement signals from the short-range position measurement device 402, the working roll position control devices 441A and 440B, and the backup roll position control devices 460A and 460B.

As shown in FIG. 15, the rolling mill 1B is equipped with a work-side housing 400A, a drive-side housing 400B, a working roll 410A, working roll pressing devices 430A and 431A, working roll position control devices 440A and 441A, roll chocks 412A and 412B, roll chock side liners 414A and 414B, roll reference members 416A and 416B, pressing device liners 434A and 435A, position control device liners 444A and 445A, position measurement devices 442A and 443A, and short-range position measurement devices 402A and 402B.

In the rolling mill 1B, instead of the roll reference member 116A, the rolling mill reference member 102A, and the position measurement device 143A provided in the rolling mill 1 shown in FIG. 1, there is provided a work-side position measurement device formed by a roll reference member 416A provided on the work-side roll chock 412A and having a reference surface and a short-range position measurement device 402A provided on the work-side housing 400A and measuring a distance to a reference surface of the roll reference member 416A.

Similarly, instead of the roll reference member 116B, the rolling mill reference member 102B, and the position measurement device 142A, there is provided a drive-side position measurement device formed by a roll reference member 416B provided on the drive-side roll chock 412B and having a reference surface and a short-range position measurement device 402B provided on the drive-side housing 400B and measuring a distance to a reference surface of the roll reference member 416B.

Also the short-range position measurement devices 402A and 402B are, for example, eddy-current type measurement devices.

Next, the rolling mill adjustment method according to the present embodiment will be described. Also in the present embodiment, the roll position of each roll is adjusted to zero point (the roll axis is adjusted to the proper, correct position). Also the rolling mill adjustment method of the present embodiment is mainly conducted immediately after the replacement of the working rolls 410A and 410B and the backup rolls 420A and 420B.

More specifically, first, in the state in which the upper working roll 410A has been replaced as shown in FIG. 15, the cross angle is 0° (temporary).

Next, regarding the working roll position control device 440A, the roll chock 412A provided with the roll reference member 416A is pressed by the working roll position control device 440A such that the distance $\delta 1$ to the reference surface of the roll reference member 416A measured by the short-range position measurement device 402A is a predetermined distance (the distance before the wear of the liner), whereby the position in the rolling direction of the roll chock 412A is directly adjusted to zero point. Also regarding the working roll position control device 441A, the roll chock 412B provided with the roll reference member 416B is pressed by the working roll position control device 441A such that the distance $\delta_2$ to the reference surface of the roll reference member 416B measured by the short-range position measurement device 402B is a predetermined distance (the distance before the wear of the liner), whereby the position in the rolling direction of the roll chock 412B is directly adjusted to zero point.

During rolling, the controller 20B controls each hydraulic cylinder such that a usual, desired cross angle is attained as shown in FIG. 16 by utilizing the parameters at the time of zero point adjustment through the flow as described above.

Otherwise, the present modification is substantially of the same structure and operation as those of the rolling mill and the rolling mill adjustment method of embodiment 2 described above, so a detailed description thereof will be left out.

Also in the rolling mill and the rolling mill adjustment method of the modification of embodiment 2 of the present invention, it is possible to achieve substantially the same effect as that of the rolling mill and the rolling mill adjustment method of embodiment 2 described above.

Also the modification of embodiment 2 is applicable to a rolling mill which is equipped with no backup rolls and which is solely equipped with working rolls.

Further, also in the present modification, there are no restrictions regarding the positional relationship between the position control device and the pressing device and the positional relationship between the work-side position measurement device and the drive-side position measurement device, and positional exchange is allowed as appropriate.

Embodiment 3

Figure 17:
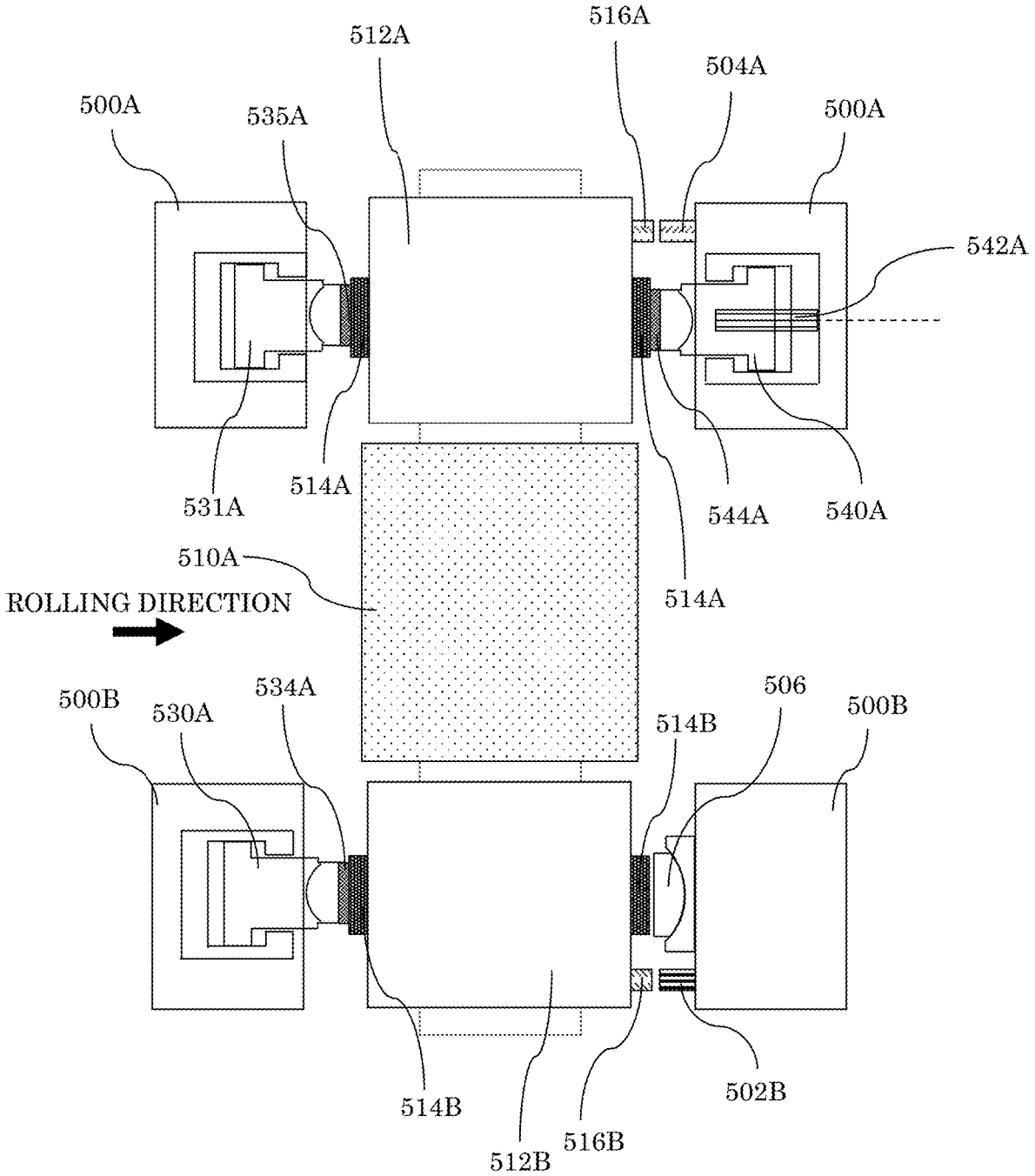
FIG. 17 is a diagram illustrating a roll adjustment method for a rolling mill according to embodiment 3 of the present invention, which is a 4-stage rolling mill in which one of a work-side roll chock and a drive-side roll chock is provided with a hydraulic device solely on the input side or the output side.
Figure 18:
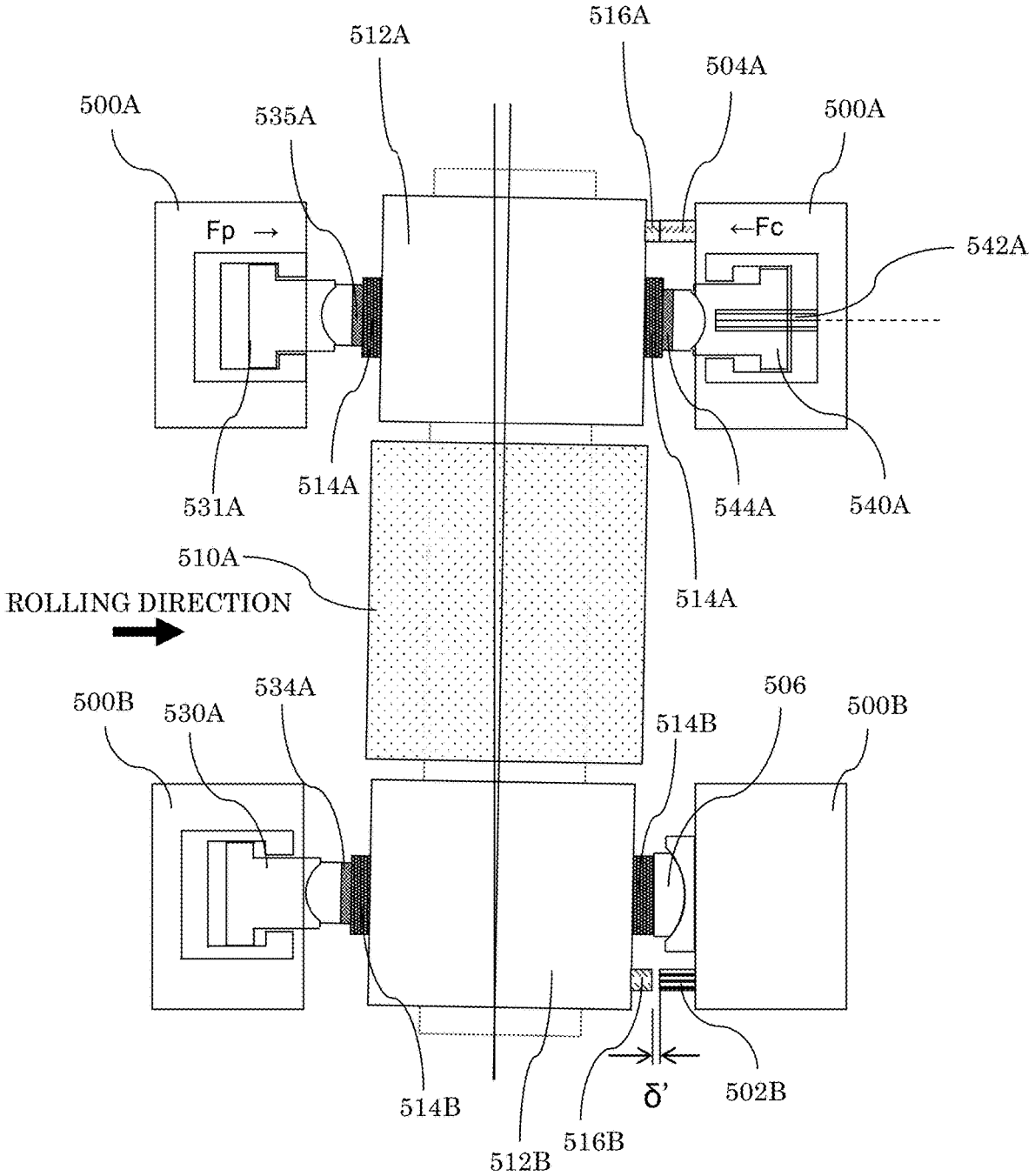
FIG. 18 is a diagram illustrating a roll adjustment method for the rolling mill according to embodiment 3.
Figure 19:
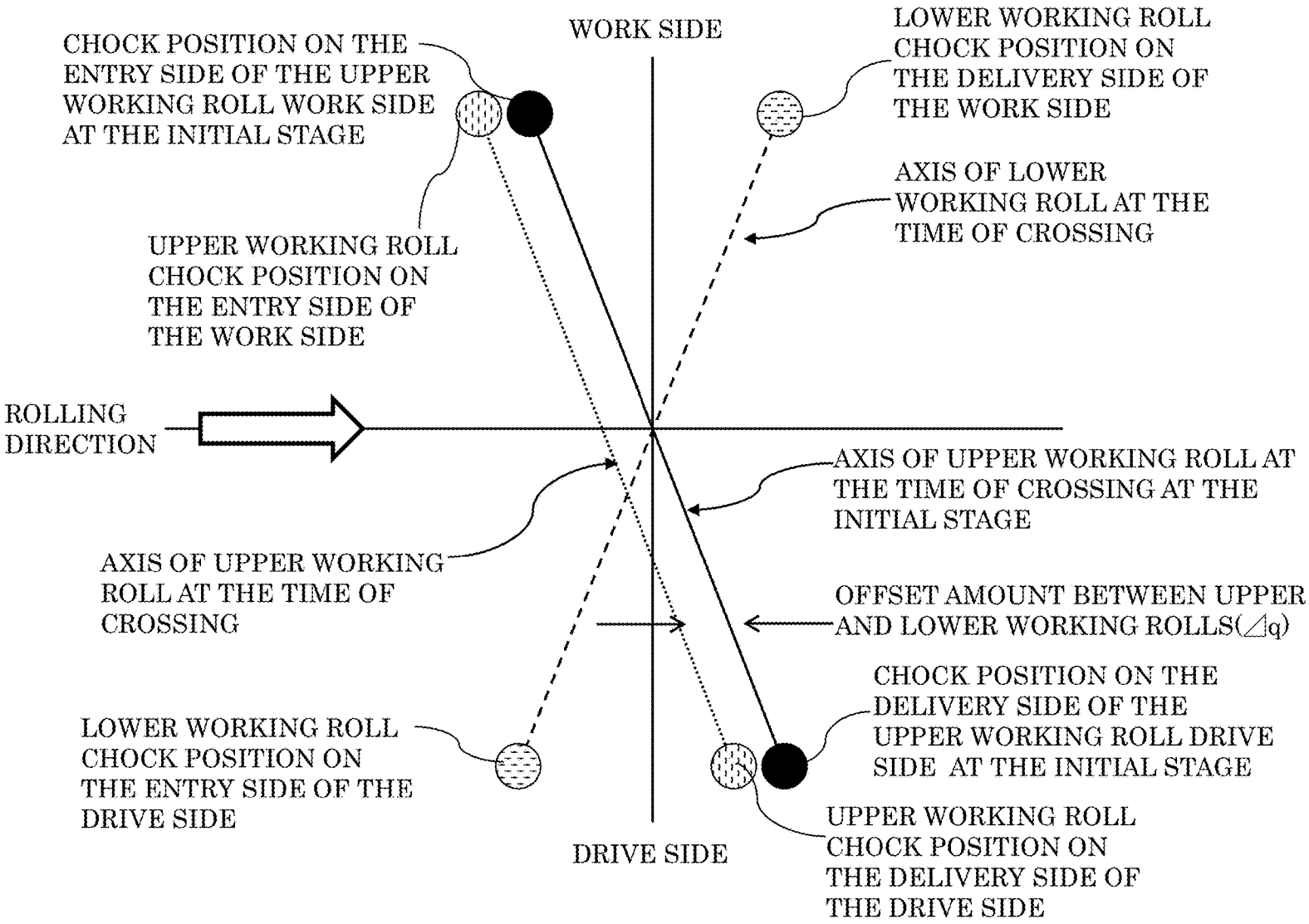
FIG. 19 is a diagram schematically illustrating offset between upper and lower working rolls in a rolling mill.
Figure 20:
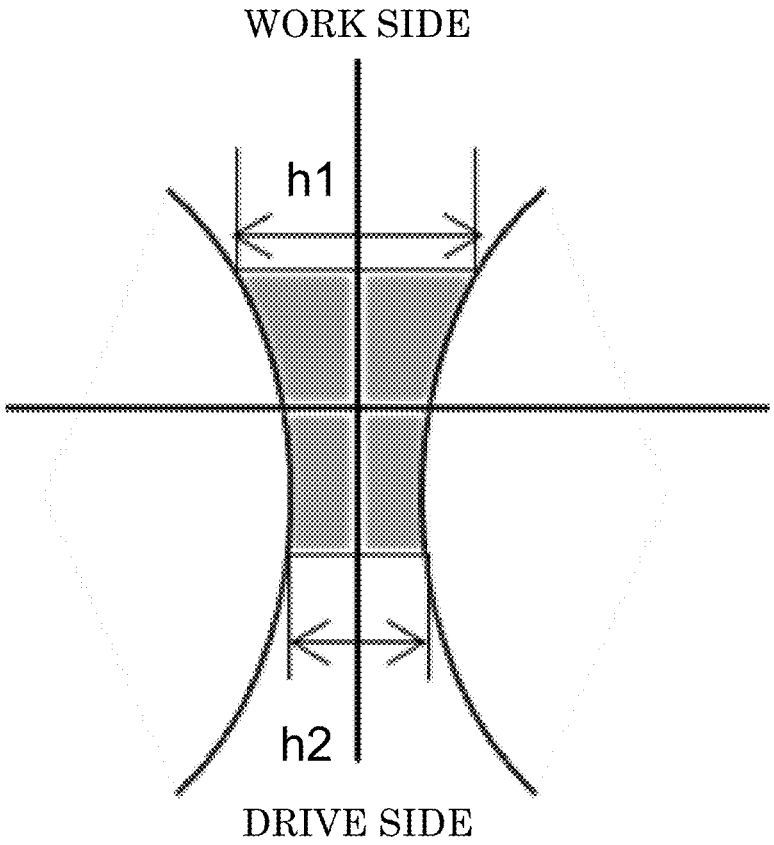
FIG. 20 is a diagram illustrating how a gap is generated between the upper and lower working rolls at the time of offset between the upper and lower working rolls in a rolling mill.

The rolling mill and the rolling mill adjustment method according to embodiment 3 of the present invention will be described with reference to FIGS. 17 through 20. FIGS. 17 and 18 are top views of the rolling mill of the present embodiment, illustrating a portion equivalent to the region A of the rolling mill of embodiment 1 shown in FIG. 1. FIG. 19 is a diagram schematically illustrating offset between the upper and lower working rolls in the rolling mill, and FIG. 20 is a diagram illustrating how a gap is generated between the upper and lower working rolls at the time of offset between the upper and lower working rolls in the rolling mill.

As shown in FIG. 17, in the rolling mill of embodiment 3, an upper working roll 510A is supported rotatable by a work-side housing 500A and a drive-side housing 500B via a work-side roll chock 512A and a drive side roll chock 512B, respectively.

A working roll pressing device 531A is arranged between the input side of the work-side housing 500A and the work-side roll chock 512A, and presses the roll chock 512A of the upper working roll 510A in the rolling direction. At the contact portions of the working roll pressing device 531A and the work-side roll chock 512A, there are respectively provided a pressing device liner 535A and a roll chock side liner 514A.

A working roll position control device 540A is arranged between the output side of the work-side housing 500A and the work-side roll chock 512A, and has a hydraulic cylinder (pressing device) pressing the roll chock 512A of the upper working roll 510A in the anti-rolling direction. The working roll position control device 540A is equipped with a position measurement device 542A measuring the operation amount of the hydraulic cylinder, and performs positional control on the hydraulic cylinder. At the contact portions of the working roll position control device 540A and the work-side roll chock 512A, there are respectively provided a position control device liner 544A and a roll chock side liner 514A.

A working roll pressing device 530A is arranged between the input side of the drive-side housing 500B and the drive-side roll chock 512B, and presses the roll chock 512B of the upper working roll 510A in the rolling direction. At the contact portions of the working roll pressing device 530A and the drive-side roll chock 512B, there are respectively provided a pressing device liner 534A and a roll chock side liner 514B.

A pivot block 506 is arranged between the output side of the drive-side housing 500B and the drive-side roll chock 512B, and retains the working roll 510A pressed toward the drive-side housing 500B by the working roll pressing device 530A via the roll chock side liner 514B of the drive-side roll chock 512B.

With respect to the work-side roll chock 512A, there is provided a work-side position measurement device which measures the position in the rolling direction of the work-side roll chock 512A between the work-side roll chock 512A and the work-side housing 500A including wear of the roll chock side liner 514A, the pressing device liner 535A, and the position control device liner 544A at a position free from an influence of the wear of the roll chock side liner 514A and the position control device liner 544A.

The work-side position measurement device is formed by a roll reference member (first reference member) 516A provided on the work-side roll chock 512A and having a first reference surface, a rolling mill reference member (second reference member) 504A provided on the work-side housing 500A and having a second reference surface capable of coming into contact with the first reference surface of the roll reference member 516A, and the above-mentioned position measurement device 542A.

The roll reference member 516A and the rolling mill reference member 504A are provided at roll cross positions that are not usually adopted at the time of rolling (where the first reference surface of the roll reference member 516A and the second reference surface of the rolling mill reference member 504A come into contact with each other when the cross angle is −0.1°). As a result, the reference surfaces do not come into contact with each other during rolling. The roll reference member 516A and the rolling mill reference member 504A are formed of a material which is very hard and which is resistant to corrosion such as stainless steel. They do not suffer wear even if the reference surfaces come into contact with each other or if they are exposed to steam and heat for a long period of time.

Also with respect to the drive-side roll chock 512B, there is provided a drive-side position measurement device which measures the position in the rolling direction of the drive-side roll chock 512B between the drive-side roll chock 512B and the drive-side housing 500B including wear of the roll chock side liner 514B, the pressing device liner 534A, and the pivot block 506 at a position free from an influence of the wear of the roll chock side liner 514B and the pivot block 506.

The drive-side position measurement device is formed by a roll reference member (third reference member) 516B provided on the drive-side roll chock 512B and having a third reference surface, and a short-range position measurement device 502B (short-range position sensor) provided on the drive-side housing 500B and measuring the distance to the third reference surface.

Also the roll reference member 516A and the short-range position measurement device 502B are provided inside the rolling mill, and are arranged at positions where the do not suffer wear during normal rolling.

Next, the rolling mill adjustment method according to the present embodiment will be described. In the present embodiment, it is possible to measure both end positions of the roll chocks 512A and 512B, and to calculate axial deviation of the working roll 510A and the backup roll. On the drive side, however, there is provided no position control device, so that it is impossible to adjust the working roll 510A and the backup roll to zero point. In view of this, the position measurement value on the work-side roll chock 512A side is adjusted through position adjustment of the working roll 510A and the backup roll by the working roll position control device 540A in order to be adapted to the position of the drive-side roll chock 512B having no position control device, whereby the axial deviation of the working roll 510A and the backup roll is adjusted.

More specifically, first, in the state in which the upper working roll 510A has been replaced as shown in FIG. 17, the cross angle is 0° (temporary).

Next, as shown in FIG. 18, the roll chock 512A is pressed by the working roll pressing device 531A in a direction opposite the direction in which roll crossing is usually effected (cross angle=−0.1°) until the first reference surface of the roll reference member 516A and the second reference surface of the rolling mill reference member 504A come into contact with each other. In this process, the pressing force Fc of the hydraulic cylinder of the working roll position control device 540A is made smaller than the pressing force Fp of the hydraulic cylinder of the working roll pressing device 531A. After the contact, the hydraulic cylinder of the working roll position control device 540A is caused to advance until the position control device liner 544A comes into contact with the roll chock side liner 514A. An advancing amount at this time is measured by the position measurement device 542A. Simultaneously, a distance δ' to the third reference surface of the roll reference member 516B is measured by the drive-side short-range position measurement device 502B.

After this, the hydraulic device is controlled by the controller (strip wedge suppression device), whereby the hydraulic cylinder of the working roll position control device 540A is controlled based on the advancing amount of each hydraulic cylinder measured by the position measurement device 542A and the control amount corresponding to δ'−δ (the distance before the wear of the liner) measured by the short-range position measurement device 502B. Through this control, the position in the rolling direction of the work-side roll chock 512A is controlled to adjust the roll axis of the upper working roll 510A in order to make it parallel to the rolling direction (adjustment to a predetermined position).

Similarly, also with respect to the lower working roll and the upper and lower backup rolls, the roll axis is adjusted in order to make it parallel to the rolling direction by the same method. When, in this process, the axial deviation of the upper working roll 510A and the upper backup roll is larger than a predetermined amount, it is desirable to adjust as appropriate the adjustment amount of the position in the rolling direction such that this axial deviation is equal to or less than the predetermined amount. Also when the axial deviation of the lower working roll and the lower backup roll is larger than a predetermined amount, it is desirable to adjust as appropriate the adjustment amount of the position in the rolling direction such that the axial deviation is equal to or less than the predetermined amount.

In the present embodiment, it is possible to make the axes of the rolls parallel by the above-described rolling mill adjustment method. However, since no position control devices are provided on the input and output sides of the rolling mill, there is the possibility of an axial deviation in the rolling direction (offset between the upper and lower working rolls) being generated between the upper working roll and the lower working roll.

In the case where there is no axial deviation between the upper and lower working rolls (no offset between the upper and lower working rolls), there is no deviation in the cross point of the upper and lower working rolls. However, when as shown, for example, in FIG. 19, the upper working roll is offset to the input side in the rolling direction with respect to the lower working roll, there is generated a deviation in the cross point of the upper and lower working rolls. As a result, as shown in FIG. 20, at the strip end position, the drive-side inter-roll gap h2 becomes smaller than the work-side inter-roll gap h1. Thus, there is generated a difference in the inter-roll gap between the work-side and drive-side rolls, and there is the possibility of strip wedge being generated in the rolled material.

Thus, in the adjustment method of the present embodiment, it is desirable to correct the axial difference between the upper and lower working rolls also by some other means. In view of this, in the controller of the rolling mill of the present embodiment, the strip wedge change amount generated due to the roll gap difference between the work side and the drive side generated due to the axial deviation in the rolling direction of the upper and lower working rolls is estimated, and the rolling reduction cylinder position (leveling) on the work side and the drive side is adjusted such that the strip wedge change amount becomes equal to or less than a predetermined value. In this way, it is desirable to further suppress generation of strip wedge.

While the details of the principle will be described below in connection with embodiment 5, in the controller of the present embodiment, by using the offset amount Δq [mm] between the upper and lower working rolls, the cross angle θ [rad], the working roll diameter D. [mm], and the strip width b [mm], the roll gap difference (strip end) ΔG [mm] between the work side and the drive side is obtained by the relationship shown by the following equation (1).

$$\Delta G = \frac{2b \cdot \tan\theta \cdot \Delta q}{D_w} \tag{1}$$

After this, based on the relationship of the following equation (2), the hydraulic fluid column position difference (leveling) of the rolling reduction cylinders on the work side and the drive side is calculated.

$$\Delta S = \frac{L_c}{b}\Delta G \tag{2}$$

In equation (2), ΔS is the leveling correction amount (mm), and $L_c$ is the inter-cylinder distance (mm) of the work side and the drive side.

The controller controls the work-side rolling reduction cylinder and the drive-side rolling reduction cylinder such that the desired hydraulic fluid column position difference is obtained, thereby reducing the inter-roll gap difference on the work side and the drive side and further suppressing generation of strip wedge.

Otherwise, the present embodiment is of substantially the same structure and operation as the rolling mill and the rolling mill adjustment method of embodiment 1 described above, so a detailed description thereof will be left out.

Also in the rolling mill and the rolling mill adjustment method of embodiment 3 of the present invention, it is possible to attain substantially the same effect as that of the rolling mill and the rolling mill adjustment method of embodiment 1 described above. That is, the positions in the rolling direction of both ends of the working roll chock and the backup roll chock are measured, whereby it is possible to calculate the working roll axis and the backup roll axis and to evaluate the axis minute crossing amount of the working roll and the backup roll. Further, the roll position is adjusted by the position control device, whereby it is possible to eliminate the minute crossing between the working roll and the backup roll, and to suppress the rolling load difference attributable to the axial thrust force. As a result, it is possible to contribute to an improvement in terms of strip passing property through a reduction in the strip wedge change amount.

The present embodiment 3 can also be applied to a rolling mill equipped with no backup rolls and having solely the working rolls.

Further, also in the present embodiment 3, the arrangement of the position control device and the pressing device and the position where the work-side position measurement device and the drive-side position measurement device are provided are not restricted to those of embodiment 3 described above.

Modification of Embodiment 3

Figure 21:
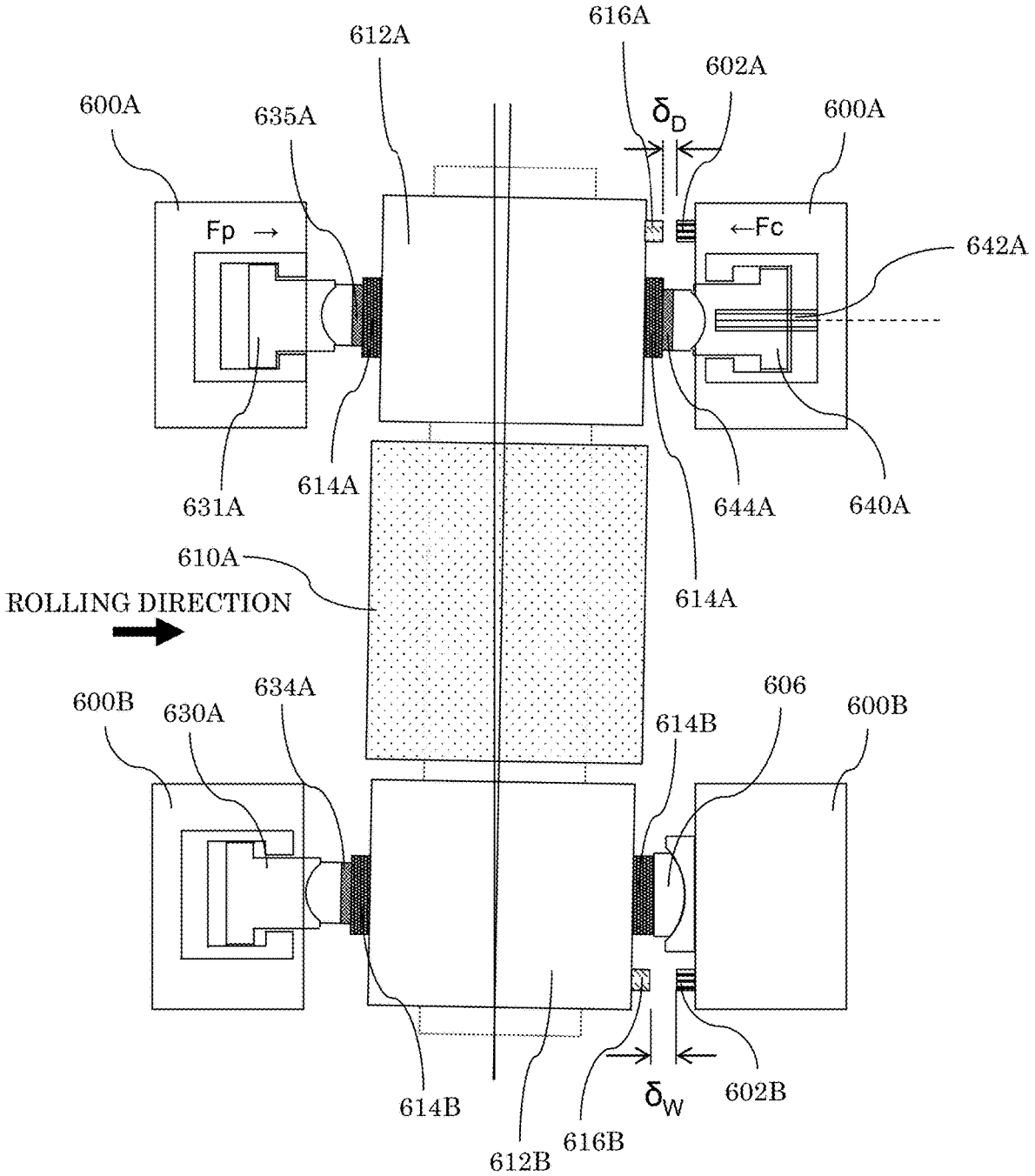
FIG. 21 is a diagram illustrating a roll adjustment method for a rolling mill according to a modification of embodiment 3 of the present invention, which is a 4-stage rolling mill in which one of the work-side roll chock and the drive-side roll chock is provided with a hydraulic device solely on the input side or the output side.
Figure 22:
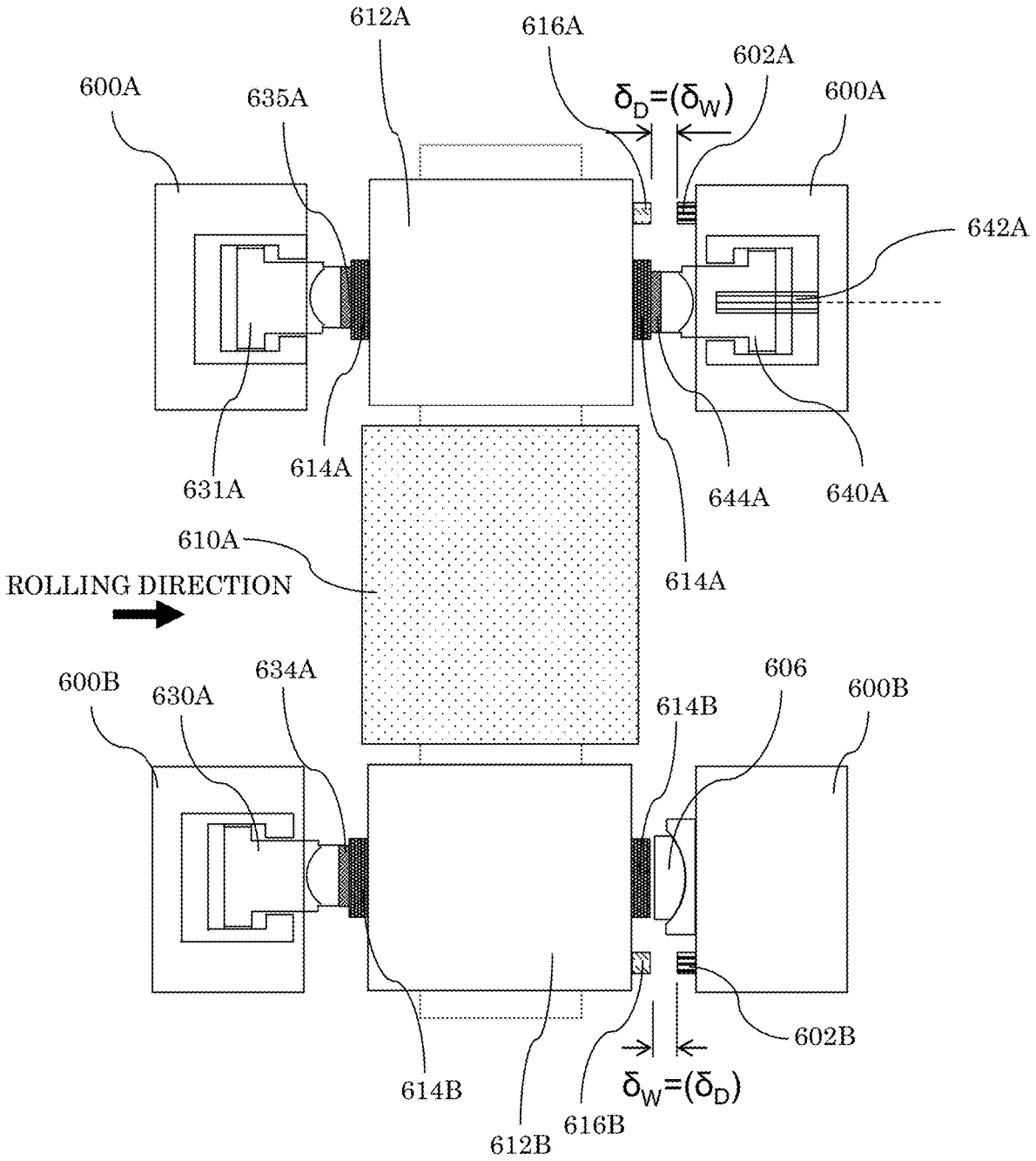
FIG. 22 is a diagram illustrating a roll adjustment method for a rolling mill according to a modification of embodiment 3.

The rolling mill and the rolling mill adjustment method according to a modification of embodiment 3 of the present invention will be described with reference to FIGS. 21 and 22. FIGS. 21 and 22 are top views of the portion of the rolling mill of the present embodiment equivalent to the region A of FIG. 1.

As shown in FIG. 21, the rolling mill of the present modification is equipped with a work-side housing (cross side) 600A, a drive-side housing (pivot side) 600B, a working roll 610A, working roll pressing devices 630A and 631A, a working roll position control device 640A, a pivot block 606, roll chocks 612A and 612B, roll chock side liners 614A and 614B, roll reference members 616A and 616B, pressing device liners 634A and 635A, a position measurement device 642A, a position control device liner 644A, and short-range position measurement devices 602A and 602B.

In the rolling mill of the present embodiment, instead of the roll reference member 516A, the rolling mill reference member 504A, and the position measurement device 542A, the work-side position measurement device in the rolling mill of embodiment 3 is formed by a roll reference member (third reference member) 616A provided on the work-side roll chock 612A and having a third reference surface, and a short-range position measurement device 602A (short-range position sensor) provided on the work-side housing 600A and measuring the distance to the third reference surface. The roll reference member 616A and the short-range position measurement device 602A are also provided in the rolling mill, and are arranged at positions where they do not suffer wear even during rolling.

Otherwise, the present modification is substantially of the same structure as embodiment 3, so a detailed description thereof will be left out.

Next, the rolling mill adjustment method according to the present modification will be described. Also in the present modification, the position measurement value on the work-side roll chock 612A side is adjusted through positional adjustment of the working roll 610A and the backup roll by the working roll f position control device 640A in order to adapt it to the position of the drive-side roll chock 612B having no position control device, whereby the axial deviation of the working roll 610A and the backup roll is adjusted.

More specifically, first, in the state in which the upper working roll 610A has been replaced, the cross angle is 0° (temporary).

Next, as shown in FIG. 22, the distance $\delta_D$ to the third reference surface of the roll reference member 616A is measured by the work-side short-range position measurement device 602A. Similarly, the distance $\delta_W$ to the third reference surface of the roll reference member 616B is measured by the drive-side short-range position measurement device 602B.

After this, the hydraulic device is controlled by the controller (the strip wedge suppression device), whereby the hydraulic cylinder of the working roll position control device 640A is controlled such that $\delta_D$ measured by the short-range position measurement device 602A coincides with $\delta_W$ measured by the short-range position measurement device 602B. Through this process, the position in the rolling direction of the work-side roll chock 612A is controlled to adjust the roll axis of the upper working roll 610A to be parallel to the rolling direction (adjustment to a predetermined position).

Similarly, control is also performed on the lower working roll and the upper and lower backup rolls by the same method to adjust the roll axis to parallel.

Further, also in the present modification, there is the possibility of axial deviation in the rolling direction of the upper working roll and the lower working roll (offset between the upper and lower working rolls) being generated, so that the strip wedge change amount generated due to the roll gap difference between the work side and the drive side generated due to the axial deviation in the rolling direction of the upper and lower working rolls is estimated, and the positions of the work-side and drive-side rolling reduction cylinders (leveling) are adjusted such that the strip wedge change amount is equal to or less than a predetermined value.

Otherwise, the operation in this modification is substantially the same as that for the rolling mill and the rolling mill adjustment method according to embodiment 3 described above, so a detailed description thereof will be omitted.

Also in the rolling mill and the rolling mill adjustment method according to the modification of embodiment 3 of the present invention, it is possible to attain substantially the same effect as that of the rolling mill and the rolling mill adjustment method according to embodiment 3 described above.

The modification of the present embodiment 3 is also applicable to a rolling mill which is equipped with no backup rolls and which has only working rolls. Further, the arrangement of the position control device and the pressing device and the position where the work-side position measurement device and the drive-side position measurement device are provided are not restricted to those of the modification of embodiment 3 described above.

Embodiment 4

Figure 23:
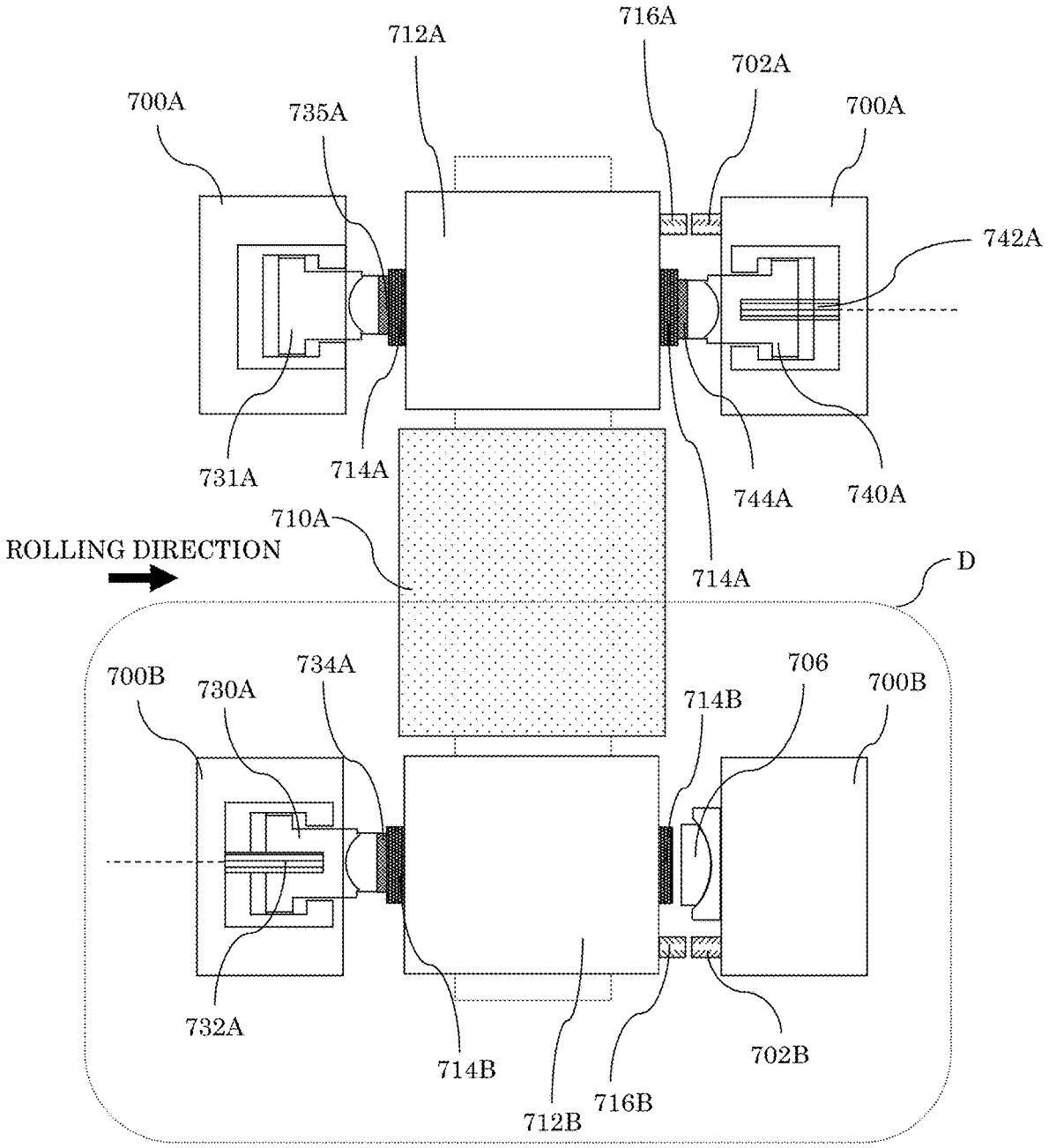
FIG. 23 is a diagram illustrating a reference surface positional relationship at the time of roll adjustment in a rolling mill according to embodiment 4 of the present invention in which one of the work-side roll chock and the drive-side roll chock is provided with a hydraulic device solely on the input side or the output side, with a reference surface being provided inside the 4-stage rolling mill.
Figure 24:
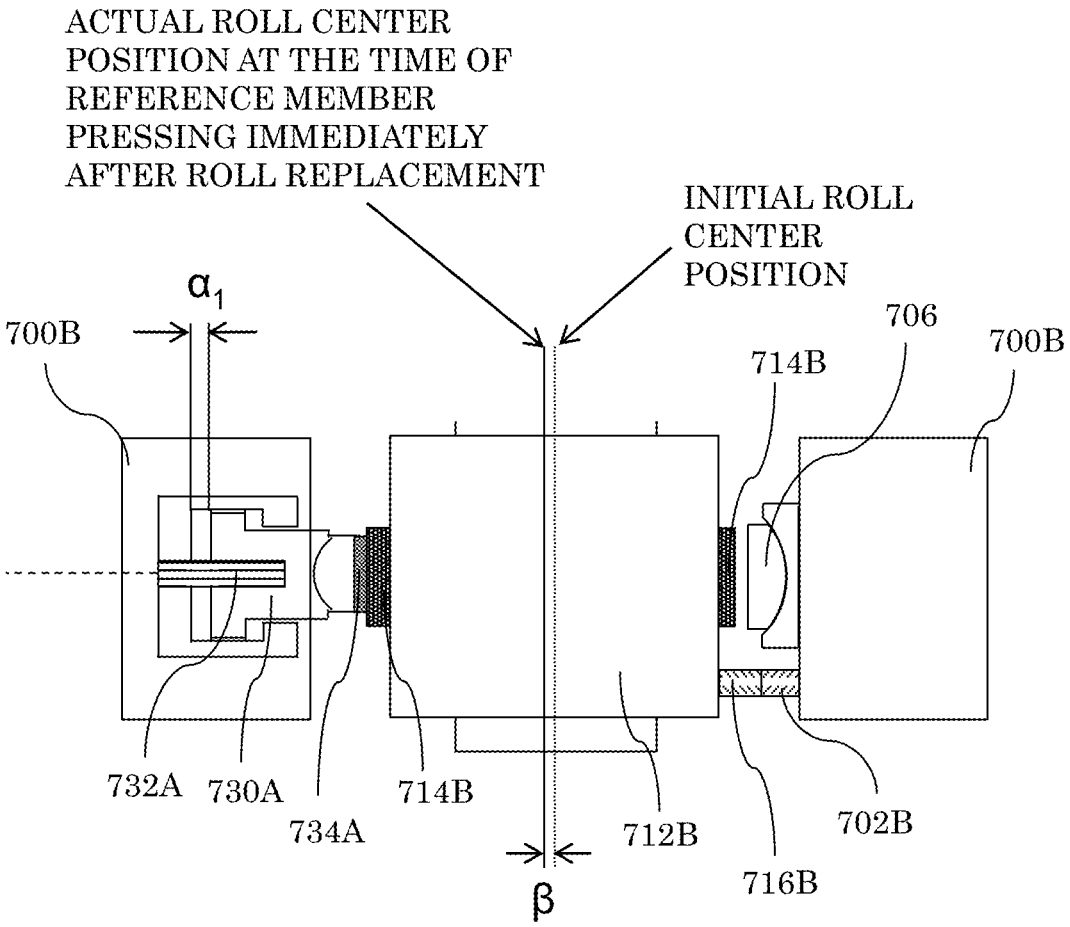
FIG. 24 is a diagram illustrating the reference surface positional relationship at the time of roll adjustment in the rolling mill of embodiment 4 of the present invention.
Figure 25:
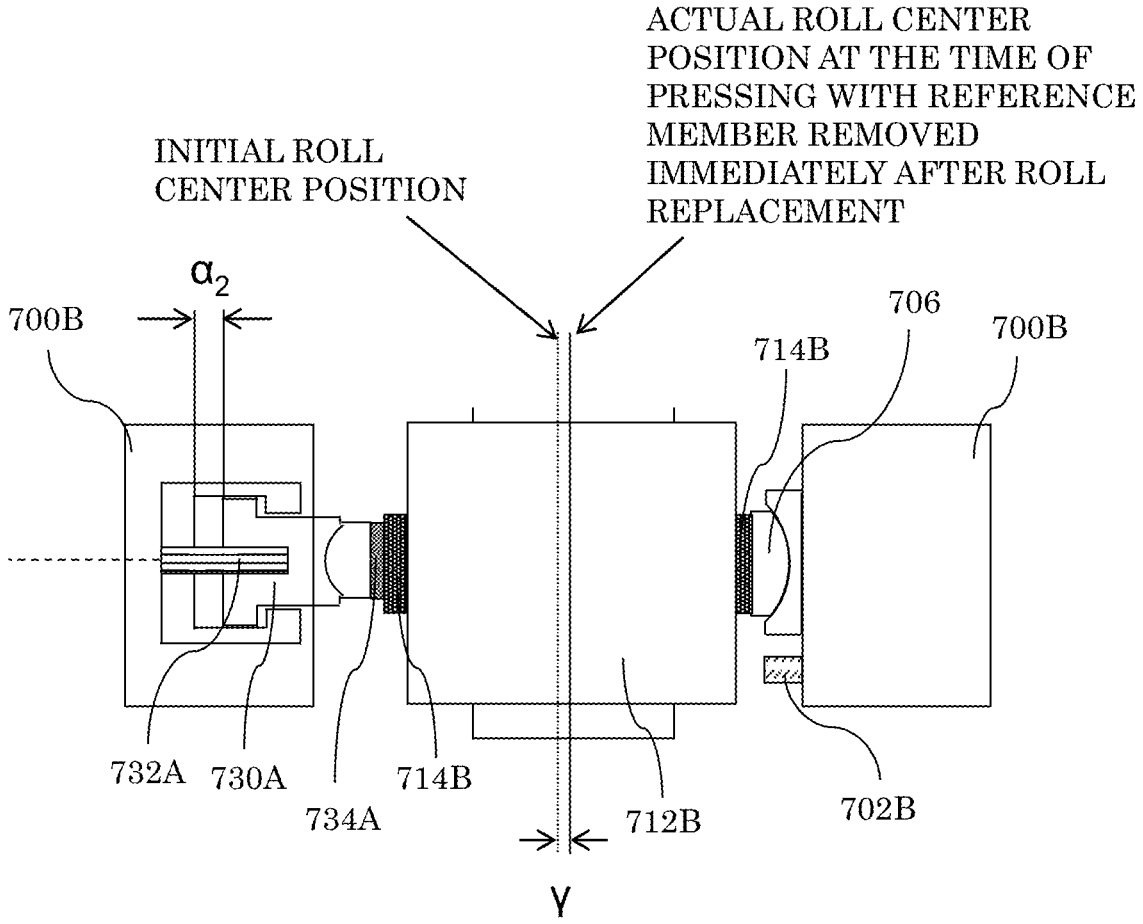
FIG. 25 is a diagram illustrating the reference surface positional relationship at the time of roll adjustment in the rolling mill of embodiment 4 of the present invention.

The rolling mill and the rolling mill adjustment method according to embodiment 4 of the present invention will be described with reference to FIGS. 23 through 25. FIG. 23 is a top view of the rolling mill of the present embodiment, illustrating a portion equivalent to the region A of the rolling mill of embodiment 1 shown in FIG. 1, and FIGS. 24 and 25 are enlarged views of the region D of FIG. 23.

As shown in FIG. 23, in the rolling mill of embodiment 4, an upper working roll 710A is supported rotatable by a work-side housing 700A and a drive-side housing 700B via a work-side roll chock 712A and a drive-side roll chock 712B, respectively.

A working roll pressing device 731A is arranged between the input side of the work-side housing 700A and the work-side roll chock 712A, and presses the roll chock 712A of the upper working roll 710A in the rolling direction. At the contact portions of the working roll pressing device 731A and the work-side roll chock 712A, there are respectively provided a pressing device liner 735A and a roll chock side liner 714A.

A working roll position control device 740A is arranged between the output side of the work-side housing 700A and the work-side roll chock 712A, and has a hydraulic cylinder (pressing device) pressing the roll chock 712A of the upper working roll 710A in the anti-rolling direction. The working roll position control device 740A is equipped with a position measurement device 742A measuring the operation amount of the hydraulic cylinder, and performs positional control on the hydraulic cylinder. At the contact portions of the working roll position control device 740A and the work-side roll chock 712A, there are respectively provided a position control device liner 744A and a roll chock side liner 714A.

A working roll pressing device 730A is arranged between the input side of the drive-side housing 700B and the drive-side roll chock 712B, and presses the roll chock 712B of the upper working roll 710A in the rolling direction. The working roll pressing device 730A is equipped with a position measurement device 732A measuring the operation amount of the hydraulic cylinder. At the contact portions of the working roll pressing device 730A and the drive-side roll chock 712B, there are respectively provided a pressing device liner 734A and a roll chock side liner 714B.

A pivot block 706 is arranged between the output side of the drive-side housing 700B and the drive-side roll chock 712B, and retains the working roll 710A pressed toward the drive-side housing 700B by the working roll pressing device 730A via the roll chock side liner 714B of the drive-side roll chock 712B.

With respect to the work-side roll chock 712A, there is provided a work-side position measurement device which measures the position in the rolling direction of the work-side roll chock 712A between the work-side roll chock 712A and the work-side housing 700A including wear of the roll chock side liner 714A, the pressing device liner 735A, and the position control device liner 744A at a position free from an influence of the wear of the roll chock side liner 714A and the position control device liner 744A.

The work-side position measurement device is formed by a roll reference member (first reference member) 716A provided on the work-side roll chock 712A and having a first reference surface, a rolling mill reference member (second reference member) 702A provided on the work-side housing 700A and having a second reference surface capable of coming into contact with the first reference surface of the roll reference member 716A, and the above-mentioned position measurement device 742A.

The roll reference member 716A and the rolling mill reference member 702A are provided in the rolling mill, and the roll reference member 716A and the rolling mill reference member 702A are provided at roll cross positions that are not usually adopted at the time of rolling (where the first reference surface of the roll reference member 716A and the second reference surface of the rolling mill reference member 702A come into contact with each other when the cross angle is −0.1°). As a result, the reference surfaces do not come into contact with each other during rolling. The roll reference member 716A and the rolling mill reference member 702A are formed of a material which is very hard and which is resistant to corrosion such as stainless steel. They do not suffer wear even if the reference surfaces come into contact with each other or if they are exposed to steam and heat for a long period of time.

Also with respect to the drive-side roll chock 712B, there is provided a drive-side position measurement device which measures the position in the rolling direction of the drive-side roll chock 712B between the drive-side roll chock 712B and the drive-side housing 700B including wear of the roll chock side liner 714B, the pressing device liner 734A, and the pivot block 706 at a position free from an influence of the wear of the roll chock side liner 714B and the pivot block 706.

The drive-side position measurement device is formed by a roll reference member (fourth reference member) 716B provided on the drive-side roll chock 712B and having a fourth reference surface, a rolling mill reference member (fifth reference member) 702B provided on the drive-side housing 700B and having a fifth reference surface capable of coming into contact with the fourth reference surface, and the above-mentioned position measurement device 732A.

The roll reference member 716B and the rolling mill reference member 702B are provided within the rolling mill and the roll reference member 716B is detachable with respect to the drive-side roll chock 712B. The rolling mill reference member 702B can be made detachable with respect to the drive-side housing 700B, and both the roll reference member 716B and the rolling mill reference member 702B can be made detachable. As a result, the reference surfaces do not come into contact with each other during rolling. The roll reference member 716B and the rolling mill reference member 702B are formed of a material which is very hard and which is resistant to corrosion such as stainless steel. They do not suffer wear even if the reference surfaces come into contact with each other or if they are exposed to steam and heat for a long period of time.

Next, the rolling mill adjustment method according to the present embodiment will be described. The position measurement value on the work-side roll chock 712A side is adjusted by the working roll position control device 740A through position adjustment of the working roll 710A and the backup roll in order to be adapted to the position of the drive-side roll chock 712B having no position control device, whereby the axial deviation of the working roll 710A and the backup roll is adjusted.

More specifically, first, in the state in which the upper working roll 710A has been replaced, the cross angle is 0° (temporary).

Next, the roll chock 712A is pressed by the working roll pressing device 731A in a direction opposite the direction in which roll crossing is usually effected (cross angle=−0.1°) until the first reference surface of the roll reference member 716A and the second reference surface of the rolling mill reference member 702A come into contact with each other. After the contact, the hydraulic cylinder of the working roll position control device 740A is caused to advance until the position control device liner 744A comes into contact with the roll chock side liner 714A. The advancing amount at this time is measured by the position measurement device 742A.

As shown in FIG. 24, before and after this, after the roll reference member 716B is mounted to the drive-side roll chock 712B, the drive-side roll chock 712B is pressed by the working roll pressing device 730A in the direction in which roll crossing is usually effected until the fourth reference surface of the roll reference member 716B and the fifth reference surface of the rolling mill reference member 702B come into contact with each other, whereby the reference position is set. By measuring the stroke $\alpha_1$ of the hydraulic cylinder at the time of contact by the position measurement device 732A, the position of the roll chock 712B is measured. Here, the roll center position at the time of contact between the fourth reference surface and the fifth reference surface and the roll center position in the initial state are known values obtained at the time of design. Thus, the difference $\beta$ between the actual roll center position at the time of reference member pressing immediately after the roll replacement and the initial roll center position is also already known. The amount $\alpha_1+\beta$ is a pressing amount reflecting the wear amount between the working roll pressing device 730A and the drive-side roll chock 712B.

After this, the upper working roll 710A is extracted from the rolling mill and the roll reference member 716B is detached from the drive side roll chock 712B. Due to this arrangement, the roll chock does not come into contact with the reference surface during rolling, so that it is always possible to measure the roll chock position with high accuracy.

Next, as shown in FIG. 25, the upper working roll 710A is mounted to the rolling mill again, and the roll chock 712B is pressed by the working roll pressing device 730A until the roll chock 712B provided with the roll reference member 716B comes into contact with the pivot block 706 to thereby set the reference position again. The position of the roll chock 712B is measured by measuring the stroke $\alpha_2$ of the hydraulic cylinder at the time of contact by the position measurement device 732A. Assuming that the difference which is the amount to be actually corrected between the initial roll center position and the actual roll center position at the time of pressing with the roll reference member 716B removed immediately after the replacement of the roll is $\gamma$, the stroke $\alpha_2$ of the hydraulic cylinder at this time is represented such that $\alpha_2$=(the pressing amount reflecting the wear amount between the working roll pressing device 730A and the drive-side roll chock 712B)+(the pressing amount reflecting the wear amount between the pivot block 706 and the drive-side roll chock 712B)=$(\alpha_1+\beta)+(\gamma)$. From this relationship, $\gamma$ can be obtained as follows: $\gamma=\alpha_2-\alpha_1-\beta$.

After this, the hydraulic device is controlled by the controller (the strip wedge suppression device), whereby the advancing amount of the hydraulic cylinder measured by the position measurement device 742A and the deviation amount $\gamma$ of the actual roll center position from the correct roll center position are controlled. As a result, the position in the rolling direction of the work-side roll chock 712A is controlled to adjust the roll axis of the upper working roll 710A in order to make it parallel to the rolling direction (adjustment to the predetermined position).

Similarly, control is also performed on the lower working roll and the upper and lower backup rolls to make the roll axes parallel to the rolling direction by a similar method.

Further, also in the present embodiment, there is the possibility of axial deviation in the rolling direction of the upper working roll and the lower working roll (offset between the upper and lower working rolls) being generated, so that the strip wedge change amount generated due to the roll gap difference between the work side and the drive side generated due to the axial deviation in the rolling direction of the upper and lower working rolls is estimated, and the rolling reduction cylinder positions (leveling) on the work side and the drive side are adjusted such that the strip wedge change amount is equal to or less than a predetermined amount.

Otherwise, the present embodiment is of substantially the same structure and operation as those of the rolling mill and the rolling mill adjustment method of embodiment 3 described above, so a detailed description thereof will be left out.

Also in the rolling mill and the rolling mill adjustment method of embodiment 4 of the present invention, it is possible to achieve substantially the same effect as that of the rolling mill and the rolling mill adjustment method of embodiment 3 described above.

Also the present embodiment 4 is applicable to a rolling mill which is equipped with no backup rolls and which has only working rolls.

Further, also in the present embodiment 4, the arrangement of the position control device and the pressing device and the positions where the work-side position measurement device and the drive-side position measurement device are provided are not restricted to those of embodiment 4 described above.

Embodiment 5

The rolling mill and the rolling mill adjustment method according to embodiment 5 of the present invention will be described with reference to FIGS. 26 through 33. The rolling mill of the present embodiment is not provided with a position control device adjusting the roll position. In the rolling mill and the rolling mill adjustment method of the present embodiment, the positions in the rolling direction of both ends of the working roll and the backup roll chocks are measured to suppress strip wedge of the rolled material generated due to axial deviation between the working roll and the backup roll.

Figure 26:
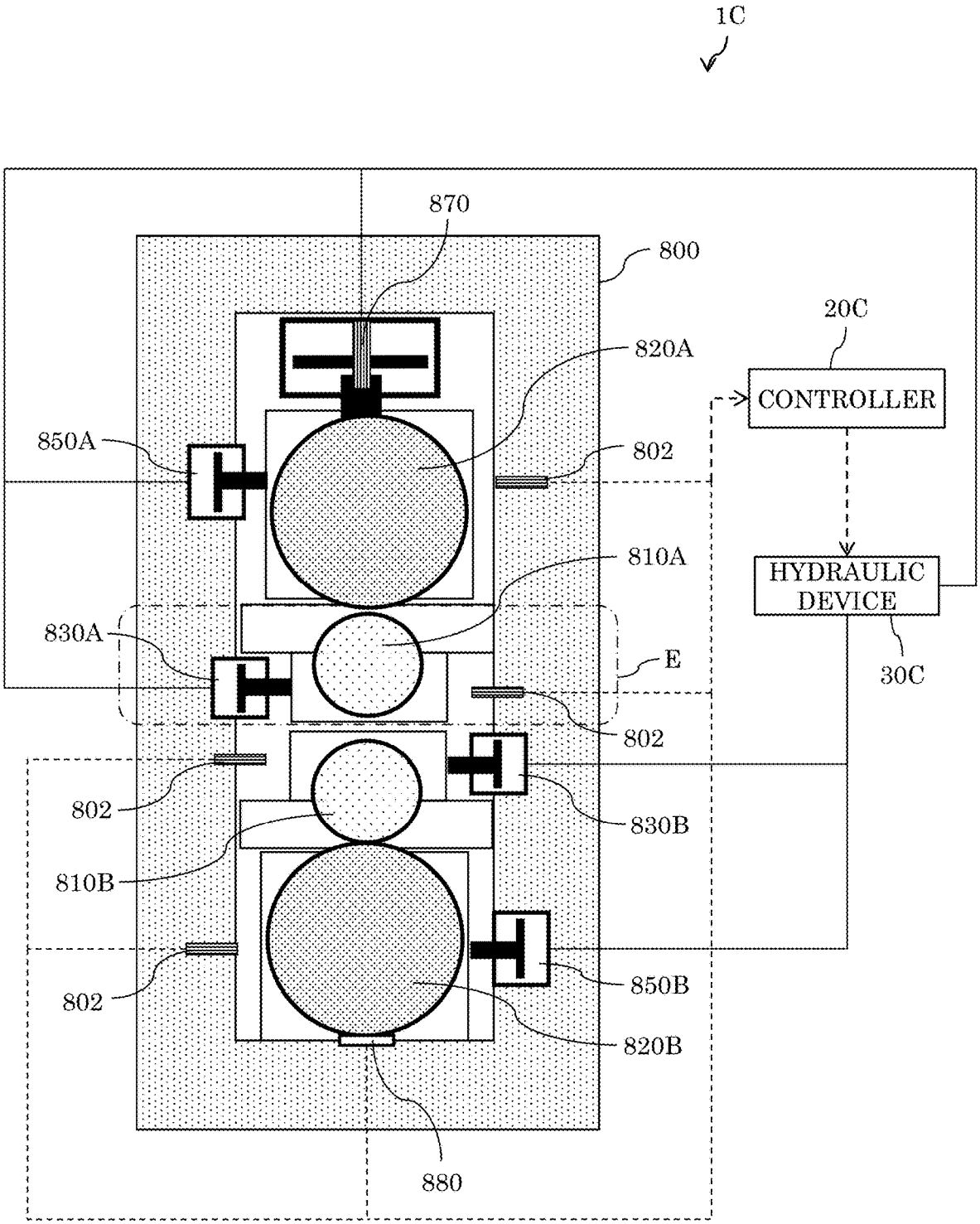
FIG. 26 is a front view of a rolling mill according to embodiment 5 of the present invention, which is a 4-stage rolling mill provided with a hydraulic device equipped with a position measurement device.
Figure 27:
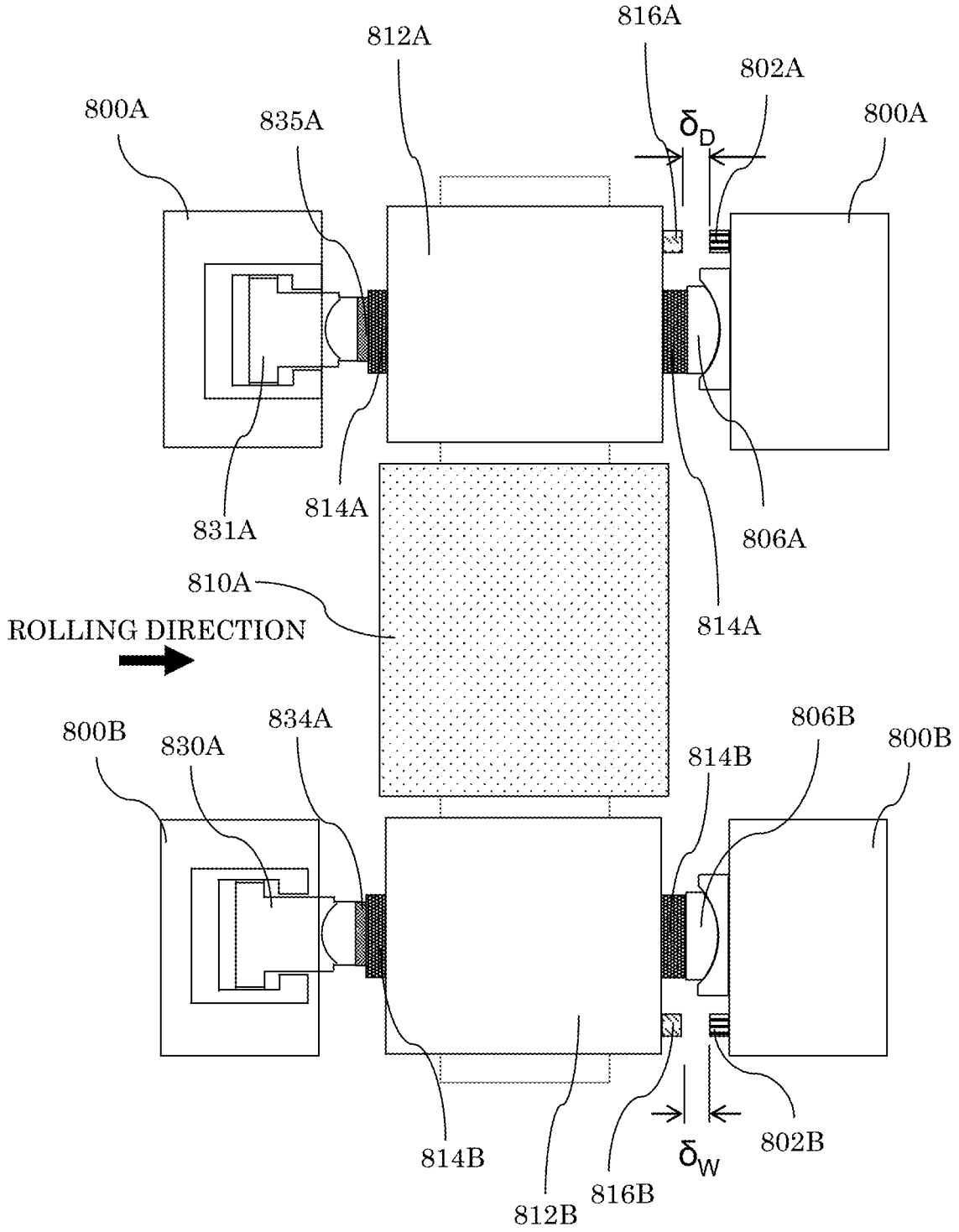
FIG. 27 is a partially enlarged top view of the rolling mill of embodiment 5.
Figure 28:
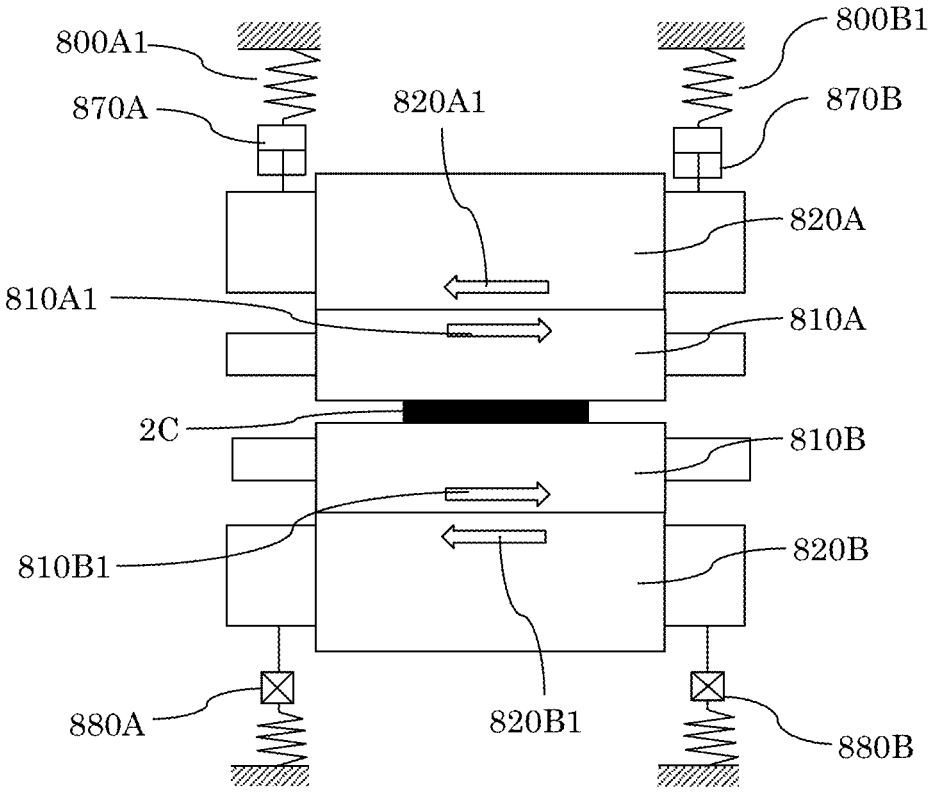
FIG. 28 is a diagram illustrating a strip wedge prediction model used in the rolling mill of embodiment 5.
Figure 29:
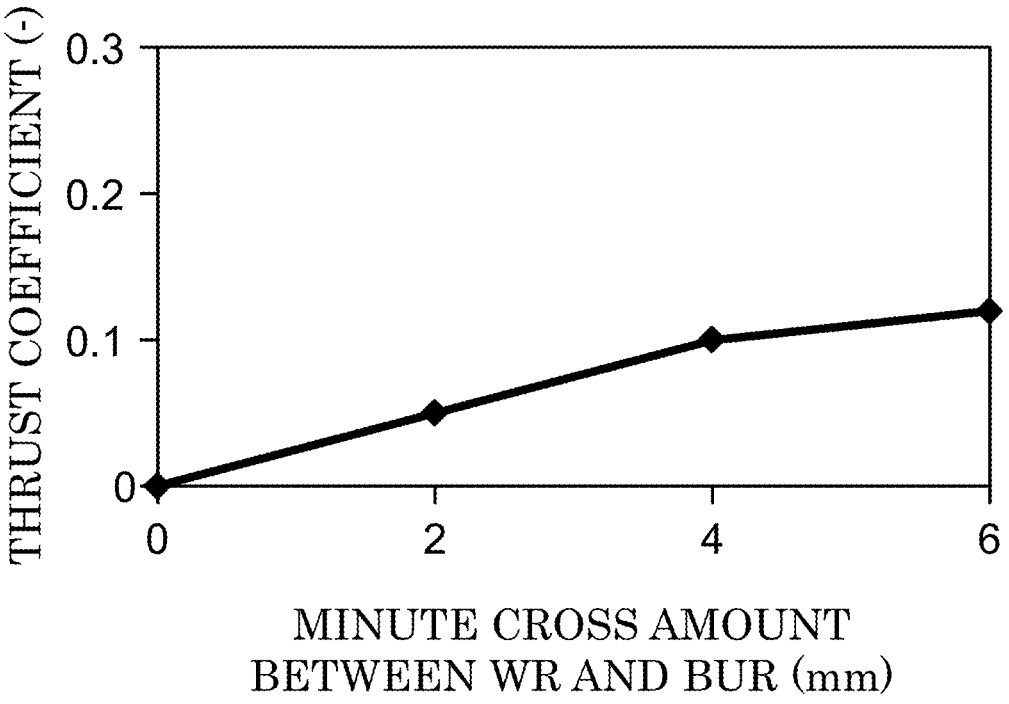
FIG. 29 is a diagram illustrating the relationship between a minute crossing amount of the working rolls and the backup rolls and a thrust coefficient in embodiment 5.
Figure 30:
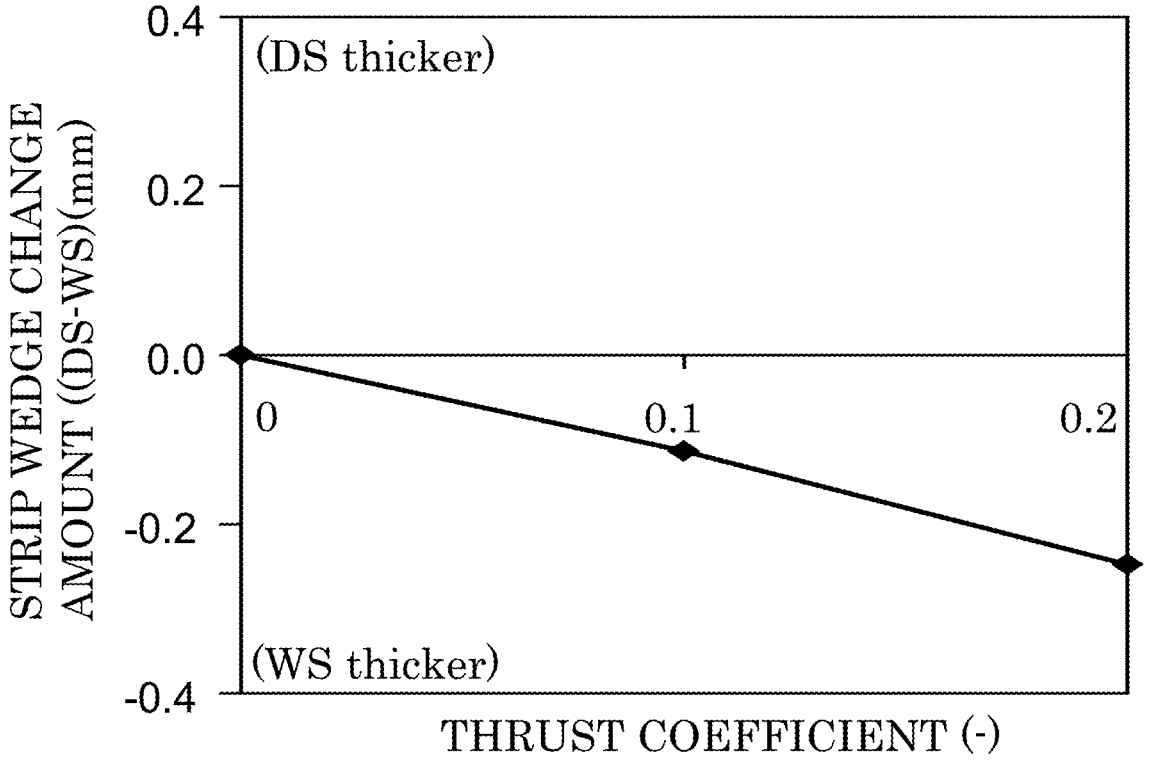
FIG. 30 is a diagram illustrating the relationship between the thrust coefficient and the strip wedge change amount in embodiment 5.
Figure 31:
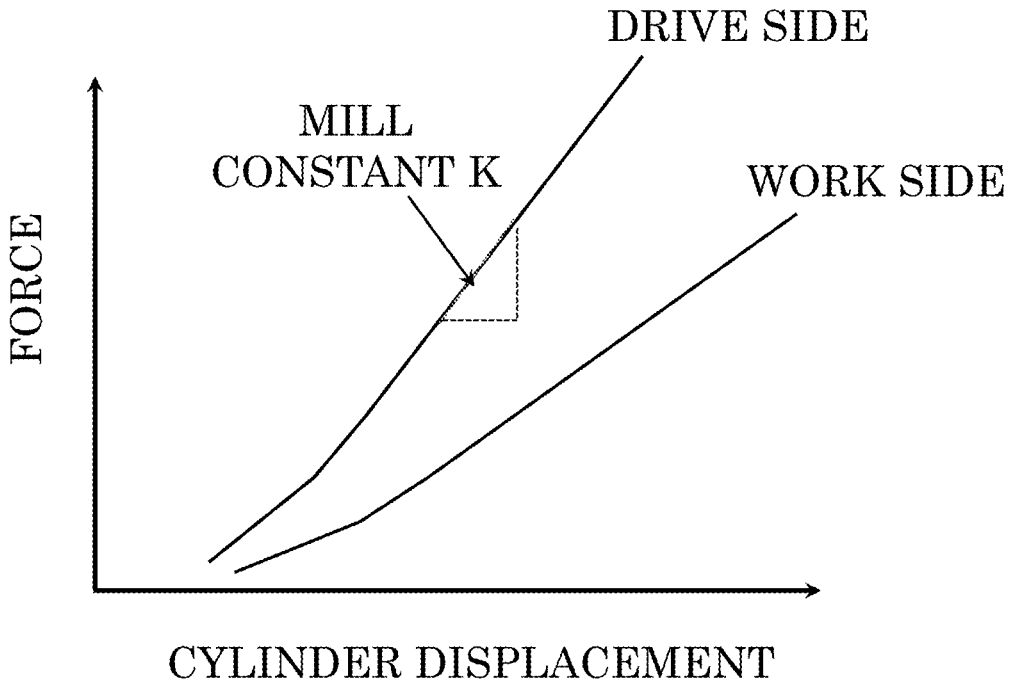
FIG. 31 is a diagram illustrating a mill constant calculation method according to embodiment 5.
Figure 32:
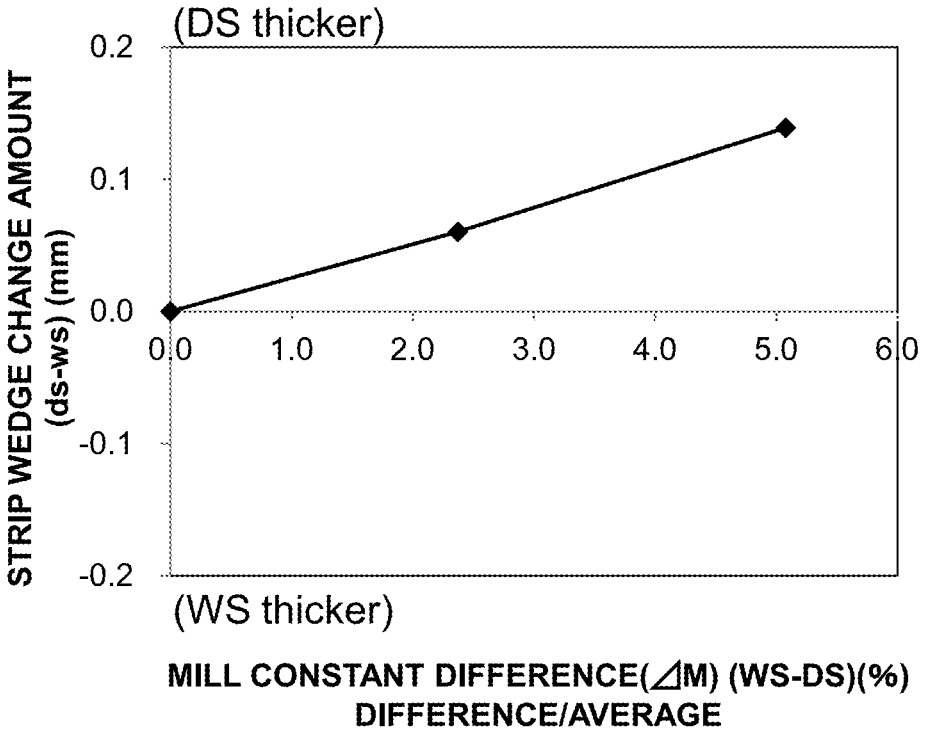
FIG. 32 is a diagram illustrating the relationship between a bilateral difference in the mill constant and the strip wedge change amount in embodiment 5.
Figure 33:
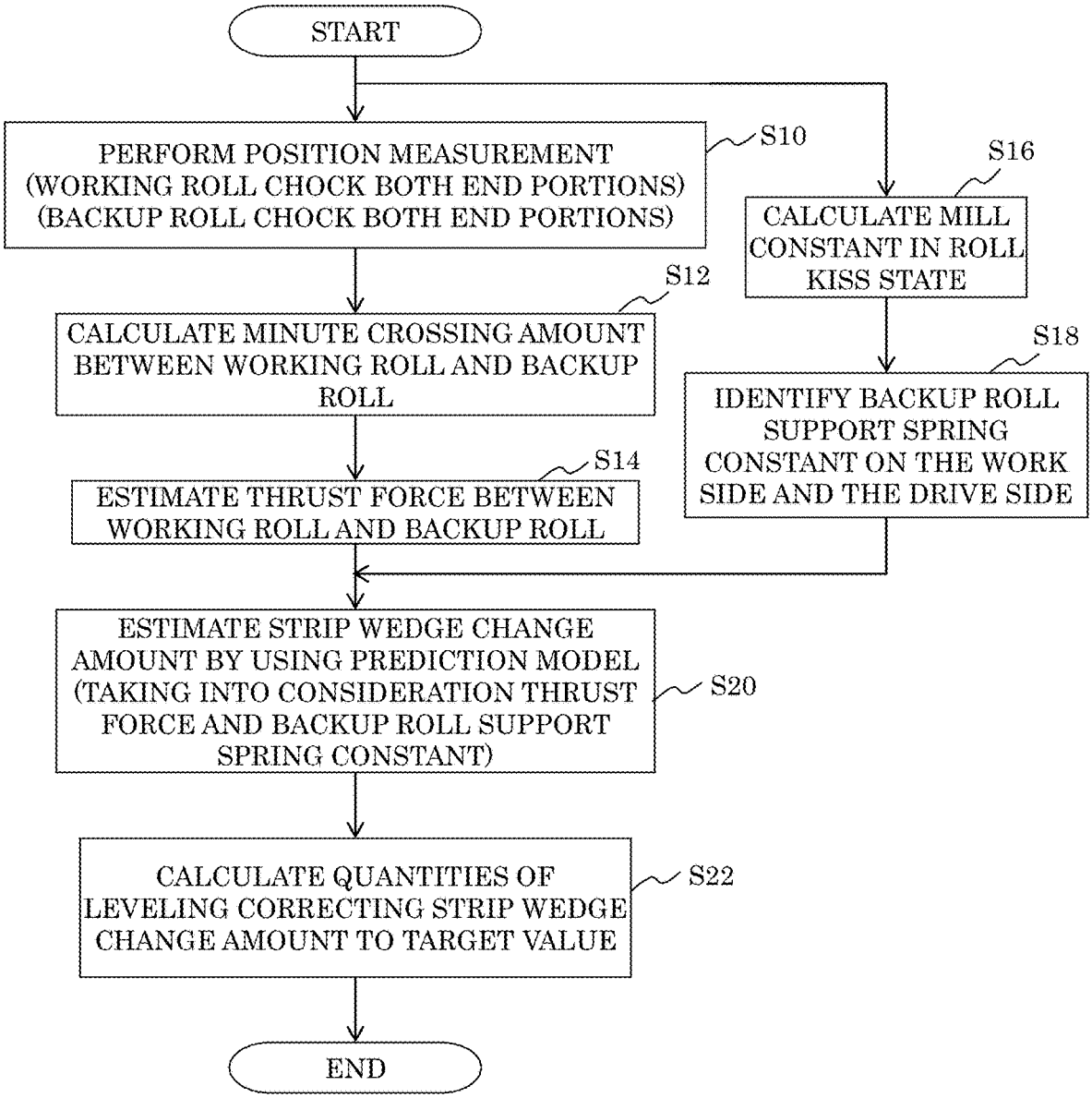
FIG. 33 is a flowchart illustrating the flow of a leveling adjustment method at the time of minute crossing of the working rolls and the backup rolls in the rolling mill according to embodiment 5.

FIG. 26 is a front view of a 4-stage rolling mill according to the present embodiment, and FIG. 27 is a top view of the region E of FIG. 26. FIG. 28 is a diagram illustrating a strip wedge prediction model used when an axial thrust force is generated between the working roll and the backup roll, FIG. 29 is a diagram illustrating the relationship between a minute crossing amount of the working rolls and the backup rolls and a thrust coefficient, FIG. 30 is a diagram illustrating the relationship between the thrust coefficient and the strip wedge change amount, FIG. 31 is a diagram illustrating a mill constant calculation method, FIG. 32 is a diagram illustrating the relationship between a bilateral difference in the mill constant and the strip wedge change amount, and FIG. 33 is a flowchart illustrating the flow of a leveling adjustment method at the time of minute crossing of the working rolls and the backup rolls.

In FIG. 26, a rolling mill 1C is a 4-stage cross roll rolling mill rolling a rolled material, and has a housing 800, a controller 20C, and a hydraulic device 30C.

The housing 800 is equipped with an upper working roll 810A and a lower working roll 810B and upper and lower backup rolls 820A and 820B supporting the upper and lower working rolls 810A and 810B.

A rolling reduction cylinder 870 is a cylinder imparting a rolling reduction force to the rolls 810A, 810B, 820A, and 820B by pressing the upper backup roll 820A. The rolling reduction cylinder 870 is composed of a work-side rolling reduction cylinder device 870A provided on the work-side housing 800A (see FIG. 28) and a drive-side rolling reduction cylinder device 870B provided on the drive-side housing 800B (see FIG. 28).

A load cell 880 is provided at the bottom portion of the housing 800 as rolling force measurement means measuring the rolling force with which the rolled material is rolled by the upper and lower working rolls 810A and 810B, and outputs the measurement results to the controller 20C. The load cell 880 is composed of a work-side load cell 880A provided on the work-side housing 800A (see FIG. 28) and a drive-side load cell 880B provided on the drive-side housing 800B (see FIG. 28).

The hydraulic device 30C is connected to working roll pressing devices 830A and 830B and backup roll pressing devices 850A and 850B.

Input to the controller 20C are measurement signals from the load cell 880 and a short-range position measurement device 802.

The controller 20C controls the operation of the hydraulic device 30C, and supplies and discharges the hydraulic fluid to and from the hydraulic cylinders of the working roll pressing devices 830A and 830B and the backup roll pressing devices 850A and 850B, thereby controlling the operation of the working roll pressing devices 830A and 830B and the backup roll pressing devices 850A and 850B. Each of the pressing devices constitutes a pressing device.

Further, the controller 20C obtains the axes of the upper and lower working rolls 810A and 810B and of the upper and lower backup rolls 820A and 820B based on the measurement results of the work-side position measurement device and the drive-side position measurement device described below. Further, it computes the minute crossing amount of the axes of the upper working roll 810A and the upper backup roll 820A and the minute crossing amount of the axes of the lower working roll 810B and the lower backup roll 820B, computing the thrust force between the working rolls 810A and 810B and the backup rolls 820A and 820B generated due to the minute crossing amount. At the same time, taking into consideration the influence of the difference in rigidity between the work-side housing 800A and the drive-side housing 800B supporting the upper and lower backup rolls 820A and 820B, it estimates the strip wedge change amount after the rolling, and controls the work-side rolling reduction cylinder device 870A and the drive-side rolling reduction cylinder device 870B such that the strip wedge change amount is equal to or less than a predetermined value. In the following, the principle thereof will be described in detail.

Next, the structure around the upper working roll 810A will be described with reference to FIG. 27. The upper backup roll 820A, the lower working roll 810B, and the lower backup roll 820B are of a structure equivalent to that of the upper working roll 810A, so a detailed description thereof will be left out.

As shown in FIG. 27, the work-side housing 800A and the drive-side housing 800B are at both end sides of the upper working roll 810A of the rolling mill 1C, and the work-side housing 800A and the drive-side housing 800B are erected perpendicularly with respect to the roll shaft of the upper working roll 810A.

The upper working roll 810A is supported rotatable by the work-side housing 800A and the drive-side housing 800B via the work-side roll chock 812A and the drive-side roll chock 812B, respectively.

The working roll pressing device 831A is arranged between the input side of the work-side housing 800A and the work-side roll chock 812A, and presses the roll chock 812A of the upper working roll 810A in the rolling direction. At the contact portions of the working roll pressing device 831A and the work-side roll chock 812A, there are respectively provided a pressing device liner 835A and a roll chock side liner 814A.

A pivot block 806A is arranged between the output side of the work-side housing 800A and the work-side roll chock 812A, and retains the working roll 810A pressed toward the work-side housing 800A by the working roll pressing device 831A via the roll chock side liner 814A of the work-side roll chock 812A.

The working roll pressing device 830A is arranged between the input side of the drive-side housing 800B and the drive-side roll chock 812B, and presses the roll chock 812B of the upper working roll 810A in the rolling direction. At the contact portions of the working roll pressing device 830A and the drive-side roll chock 812B, there are respectively provided a pressing device liner 834A and a roll chock side liner 814B.

A pivot block 806B is arranged between the output side of the drive-side housing 800B and the drive-side roll chock 812B, and retains the working roll 810A pressed toward the drive-side housing 800B by the working roll pressing device 830A via the roll chock side liner 814B of the drive-side roll chock 812B.

With respect to the work-side roll chock 812A, there is provided a work-side position measurement device configured to measure the position in the rolling direction of the work-side roll chock 812A between the work-side roll chock 812A and the work-side housing 800A including wear of the roll chock side liner 814A, the pressing device liner 835A, and the pivot block 806A at a position free from an influence of the wear of the roll chock side liner 814A and the pivot block 806A.

The work-side position measurement device is formed by a roll reference member 816A provided on the work-side roll chock 812A and having a reference surface, and a short-range position measurement device (short-range position sensor) 802A provided on the work-side housing 800A and measuring a distance to a reference surface of the roll reference member 816A.

The roll reference member 816A and the short-range position measurement device 802A are provided within the rolling mill 1C, and are arranged at positions where they do not suffer wear even during rolling. The roll reference member 816A is formed of a material which is very hard and which is resistant to corrosion such as stainless steel. They do not suffer wear even if the reference surfaces come into contact with each other or if they are exposed to steam and heat for a long period of time. The short-range position measurement device 802A is, for example, an eddy current type distance measurement device.

Also with respect to the drive-side roll chock 812B, there is provided a drive-side position measurement device which measures the position in the rolling direction of the drive-side roll chock 812B between the drive-side roll chock 812B and the drive-side housing 800B including wear of the roll chock side liner 814B, the pressing device liner 834A, and the pivot block 806B at a position free from an influence of the wear of the roll chock side liner 814B and the pivot block 806B.

The drive-side position measurement device is formed by a roll reference member 816B provided on the drive-side roll chock 812B and having a reference surface, and a short-range position measurement device (short-range position sensor) 802B provided on the drive-side housing 800B and measuring a distance to a reference surface of the roll reference member 816B.

The roll reference member 816B and the short-range position measurement device 802B are provided within the rolling mill 1C and are arranged at positions where they do not suffer wear even during rolling. The roll reference member 816B is also formed of a material which is very hard and which is resistant to corrosion such as stainless steel. It does not suffer wear even if the reference surfaces come into contact with each other or if they are exposed to steam and heat for a long period of time. The short-range position measurement device 802B is also, for example, an eddy current type distance measurement device.

Next, the rolling mill adjustment method according to the present modification will be described. In the present modification, neither the work side nor the drive side has a position control device, so that the controller 20C suppresses strip wedge of the rolled material through adjustment of the roll reduction cylinder 870.

First, as shown in FIG. 27, the distance $\delta_D$ to the reference surface of the roll reference member 816A is measured by the work-side short-range position measurement device 802A. Similarly, the distance $\delta_W$ to the reference surface of the roll reference member 816B is measured by the drive-side short-range position measurement device 802B. From these measurement values, both roll chock end positions are connected by a straight line, whereby the axis of the upper working roll 810A is calculated.

Similarly, also with respect to the lower working roll 810B and the upper and lower backup rolls 820A and 820B, the roll axes are calculated by the same method.

Here, as described above, if there is axial deviation in the rolling direction of the upper and lower working rolls, there is generated a bilateral roll gap difference due to cross point deviation at the time of roll cross rolling, and there is the possibility of strip wedge being generated in the rolled material. Further, also in the case where roll crossing is not performed, there is generated a thrust force in the axial direction between the rolls due to axial deviation of the working rolls 810A and 810B and the backup rolls 820A and 820B. Due to this thrust force, strip wedge is generated. The rolling mill of the present embodiment, however, is not provided with a position control device, so that it is impossible to correct axial deviation. In view of this, strip wedge generated due to axial deviation is suppressed by some other means. As briefly described in connection with embodiments 3 and 4 described above, as means for suppressing strip wedge, the rolling reduction cylinder hydraulic fluid column positions (quantities of leveling) of the work-side rolling reduction cylinder device 870A and the drive-side rolling reduction cylinder device 870B are adjusted. Here, the term "strip wedge" means strip wedge generated at the strip trailing edge portion.

For this purpose, it is necessary, first, to predict the strip wedge generation amount. A strip wedge prediction model as shown in FIG. 28 will be considered. This strip wedge prediction model is a strict model in which strip deformation analysis and roll elastic deformation analysis are combined. In the present model, in roll elastic deformation, there are considered the axial flexible deformation due to the force from the rolled material 2C to the upper and lower working rolls 810A and 810B, the backup roll axial flexible deformation due to the force from the upper and lower working rolls 810A and 810B to the upper and lower backup rolls 820A and 820B, the roll flat deformation between the strip and the working roll, and the flat deformation between the working roll and the backup roll. In this model, there are further considered the work-side backup roll support spring constant 800A1, the drive-side backup roll support spring constant 800B1, and the thrust forces in the axial direction between the rolls (the thrust force 820A1 acting on the upper backup roll, the thrust force 810A1 acting on the upper working roll, the thrust force 810B1 acting on the lower working roll, and the thrust force 820B1 acting on the lower backup roll).

Usually, as the strip wedge generation factors, there are mechanical factors and factors due to the rolled material. The mechanical factors include the thrust force generated due to the minute crossing between the upper and lower working rolls 810A and 810B and the upper and lower backup rolls 820A and 820B, the difference between the drive-side mill constant and the work-side mill constant generated due to the difference in asymmetry in the rigidity of each device in the work-side housing 800A and the drive-side housing 800B, and the support spring constant difference of the upper backup roll 820A. The factors due to the rolled material include factors due to the input side strip wedge, the strip width direction temperature difference, and off-center. Here, the adjustment of the rolling mill 1C conducted by the controller 20C is due to the mechanical factors and is executed at the stage before the rolling.

| | | |
|---|---|---|
| Strip width | mm | 1200 |
| Strip thickness | mm | 10 |
| Rolling reduction ratio | % | 30 |
| Rolling force | kN | 29400 |
| Backup roll support spring constant | kN/mm/side | 16170 |
| Mill constant | kN/mm | 5880 |
| Working roll diameter/length | mm/mm | Φ680 × 1770 |
| Backup roll diameter/length | mm/mm | Φ1450 × 1750 |
| Working roll neck diameter | mm | Φ390 |
| Backup roll neck diameter | mm | Φ900 |
| Bearing span | mm | 3220 |

The influence on the strip wedge generated at the strip trailing edge portion due to the thrust force, the mill constant difference between the right and left sides (drive side and work side), or the backup roll support spring constant difference was organized. First, the strip wedge change amount in the case where the axial thrust force between the working roll and the backup roll is exerted was calculated. The calculation condition is shown in table 1, and the result is shown in FIG. 29. Here, the minute crossing amount between the working roll and the backup roll is a deviation amount in the rolling direction of the working roll axis and the backup roll axis at the work-side pressing device position and the drive-side pressing device position.

As shown in FIG. 29, when the minute crossing amount between the working roll and the backup roll increases, the thrust coefficient increases. As has been found out, when the minute crossing amount is 4 mm, the thrust coefficient is approximately 0.1.

Next, the relationship between the thrust coefficient and the strip wedge change amount in the case where the thrust force is generated from the drive side toward the work side in the backup roll as shown in FIG. 28 was organized. The result is shown in FIG. 30. In FIG. 30, the thrust force was imparted as the rolling force×the thrust coefficient. As a result, as shown in FIG. 30, the strip wedge on the work side increased. The strip wedge was generated approximately 113 μm, and as has been found out, it attains a significant magnitude of 1.6% as the strip wedge ratio change.

Next, the strip wedge change amount due to the difference between the right and left of the backup roll support spring constant calculated from the right and left mill constant measurement values in the actual mill was organized. FIG. 31 shows the mill constant calculation method. Usually, the mill constant K is obtained as follows: in the roll kiss state, the relationship between the rolling reduction cylinder displacement and the forces measured by the work-side load cell 880A and the drive-side load cell 880B is organized, and the mill constants K on the work side and the drive side are obtained from the gradient thereof. With respect to the mill constants obtained on the right and left sides, by using the upper and lower backup roll support spring and the rigidity of the upper and lower working rolls as a serial spring, it is possible to obtain the right and left backup roll support spring constants which are unknowns. As in the above-described case, at this time, calculation is performed strictly taking into consideration the working roll axis flexible deformation, the backup roll axis flexible deformation due to the force from the working roll to the backup roll, the deformation due to the contact force between the upper and lower working rolls, the flat deformation between the working roll and the backup roll, the right and left backup roll support spring constants, etc.

Next, by using the measured right and left mill constants, the right and left backup roll support spring constants were respectively obtained, and, by using the strip wedge prediction model shown in FIG. 28, the relationship between the difference between the right and left backup roll support spring constants and the strip wedge change amount. FIG. 32 shows the resultant strip wedge change amount obtained. At this time, there is no thrust force between the working roll and the backup roll.

As shown in FIG. 32, it was found out that when the difference between the right and left mill constants increases, the strip wedge change amount also increases. In the case where the difference between the right and left mill constants is 5%, the strip wedge is 139 μm, and the strip wedge ratio change generated is 2.0%. As has been found out, this is approximately the same as the strip wedge generated due to the thrust force described above.

It can be seen from FIGS. 30 and 32 that both the thrust force and the difference between the right and left backup roll support springs greatly affect the strip wedge change, and that, to control the strip wedge, it is necessary to predict the strip wedge taking into consideration in detail the influence of both.

Next, the flow of leveling control when there is a minute crossing between the working roll and the backup roll will be described with reference to FIG. 33 based on the above findings.

First, the controller 20C measures the positions of both end portions of the working roll chock and both end portions of the backup roll chock (step S10).

Then, based on the measurement values of the positions in the rolling direction of both ends of the working roll chock and both ends of the backup roll chock obtained in step S10, the controller 20C calculates the minute crossing amount between the working roll and the backup roll (step S12).

After this, the controller 20C estimates the thrust force exerted between the working roll and the backup roll (step S14).

Simultaneously with these steps S12 and S14, the force applied to the work-side housing 800A and the force applied to the drive-side housing 800B are measured by using the work-side load cell 880A and the drive-side load cell 880B, and the controller 20C calculates the mill constant in the roll kiss state by utilizing the measurement results (step S16).

Next, by using the mill constant obtained in step S16, the controller 20C identifies the backup roll support spring constants on the work side and the drive side (step S18).

Taking into consideration the thrust force obtained in step S14 and the backup roll support spring constants on the work side and the drive side identified in step S18, the strip wedge change amount is calculated by the strip wedge prediction model (step S20).

Subsequently, the controller 20C calculates the rolling reduction cylinder hydraulic fluid column positions (quantities of leveling) of the work-side rolling reduction cylinder device 870A and the drive-side rolling reduction cylinder device 870B for correcting the obtained wedge change amount to a target value (step S22).

The controller 20C adjusts the rolling reduction cylinders 870A and 870B such that the calculated quantities of leveling are obtained, thereby suppressing generation of strip wedge.

Otherwise, the present embodiment is substantially of the same structure and operation as the rolling mill and the rolling mill adjustment method of embodiment 4 described above, so a detailed description thereof will be left out.

Also in the rolling mill and the rolling mill adjustment method of embodiment 5 of the present invention, it is possible to achieve substantially the same effect as that of the rolling mill and the rolling mill adjustment method of embodiment 1 described above. That is, it is possible to install a position measurement device directly measuring the position in the rolling direction of the roll chock, making it possible to accurately grasp the roll chock position. Further, it is possible to calculate the working roll axis and the backup roll axis, making it possible to evaluate the minute crossing amount of the axes of the working roll and the backup roll. Further, in rolling equipment having no position control device, the strip wedge change amount generated due to the minute crossing of the axes of the working roll and the backup roll is calculated, and the quantities of leveling are adjusted to a level where the strip wedge is equal to or less than a predetermined value, whereby also in a rolling mill having no position control device, it is possible to suppress the strip wedge generated due to deviation between the axes of the working roll and the backup roll, making it possible to achieve an improvement in terms of the strip passing property.

Sixth Embodiment

The rolling mill and the rolling mill adjustment method according to embodiment 6 of the present invention will be described with reference to FIG. 34.

Figure 34:
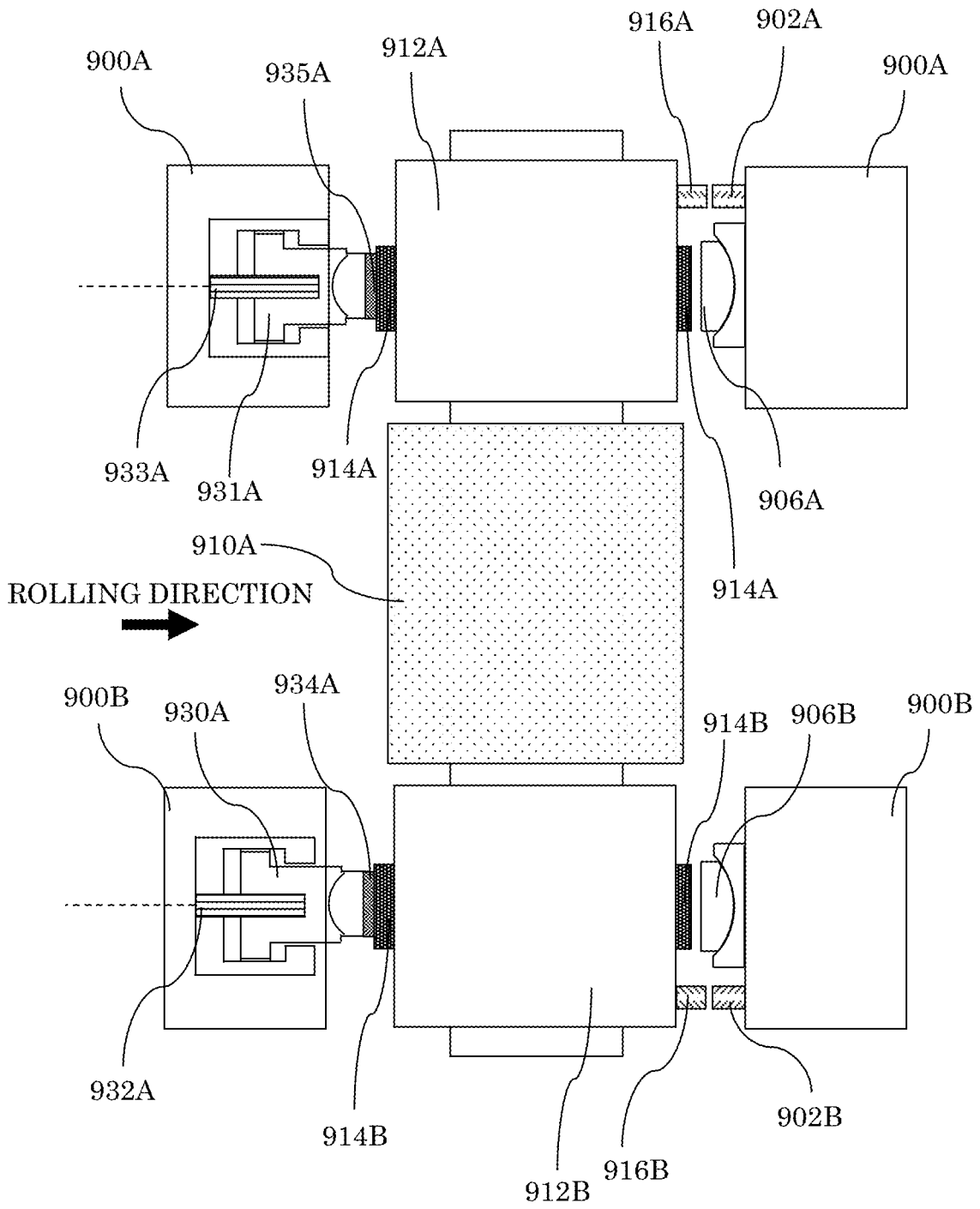
FIG. 34 is a diagram illustrating a reference surface positional relationship at the time of roll adjustment in a rolling mill according to embodiment 6 of the present invention in which one of the work-side roll chock and the drive-side roll chock is provided with a hydraulic device solely on the input side or the output side, with a reference surface being provided inside the 4-stage rolling mill.

As shown in FIG. 34, the rolling mill of the present embodiment is equipped with a work-side housing 900A, a drive-side housing 900B, a working roll 910A, working roll pressing devices 930A and 931A, pivot blocks 906A and 906B, roll chocks 912A and 912B, roll chock side liners 914A and 914B, roll reference members 916A and 916B, pressing device liners 934A and 935A, position measurement devices 932A and 933A, and rolling mill reference members 902A and 902B.

In the rolling mill of the present embodiment, in the rolling mill of embodiment 5, the working roll pressing device 931A is arranged between the input side of the work-side housing 900A and the work-side roll chock 912A, and presses the roll chock 912A of the upper working roll 910A in the rolling direction. The working roll pressing device 931A is equipped with the position measurement device 933A measuring the operation amount of the hydraulic cylinder. Similarly, the working roll pressing device 930A is arranged between the input side of the drive-side housing 900B and the drive-side roll chock 912B, and presses the roll chock 912B of the upper working roll 910A in the rolling direction. The working roll pressing device 930A is equipped with the position measurement device 932A measuring the operation amount of the hydraulic cylinder.

Further, instead of the roll reference member 816A and the short-range position measurement device 802A, the work-side position measurement device is composed of a roll reference member (fourth reference member) 916A provided on the work-side roll chock 912A and having a fourth reference surface, a rolling mill reference member (fifth reference member) 902A provided on the work-side housing 900A and having a fifth reference surface capable of coming into contact with the fourth reference surface of roll reference member 916A, and the above-mentioned position measurement device 933A.

The roll reference member 916A and the rolling mill reference member 902A are provided within the rolling mill and at roll cross positions that are not usually used at the time of rolling (When the cross angle is −0.1°, the first reference surface of the roll reference member 916A and the second reference surface of the rolling mill reference member 902A come into contact with each other). Further, the roll reference member 916A is detachable with respect to the work-side roll chock 912A. It is also possible to make the rolling mill reference member 902A detachable with respect to the work-side housing 900A, and to make both reference members detachable. Due to this arrangement, the reference surfaces do not come into contact with each other during rolling. The roll reference member 916A and the rolling mill reference member 902A are formed of a material which is very hard and which is resistant to corrosion such as stainless steel. They do not suffer wear if the reference surfaces come into contact with each other or if they are exposed to steam and heat for a long period of time.

The drive-side position measurement device is formed by a roll reference member (fourth reference member) 916B provided on the drive-side roll chock 912B and having a fourth reference surface, a rolling mill reference member (fifth reference member) 902B provided on the drive-side housing 900B and having a fifth reference surface capable of coming into contact with the fourth reference surface, and the above-mentioned position measurement device 932A.

The roll reference member 916B and the rolling mill reference member 902B are provided within the rolling mill and the roll reference member 916B is detachable with respect to the drive-side roll chock 912B. It is also possible to make the rolling mill reference member 902B detachable with respect to the drive-side housing 900B, and to make both reference members detachable. Due to this arrangement, the reference surfaces do not come into contact with each other during rolling. The roll reference member 916B and the rolling mill reference member 902B are formed of a material which is very hard and which is resistant to corrosion such as stainless steel. They do not suffer wear if the reference surfaces come into contact with each other or if they are exposed to steam and heat for a long period of time.

Otherwise, the rolling mill and the rolling mill adjustment method are substantially of the same structure as the rolling mill and the rolling mill adjustment method of embodiment 5 described above, and a detailed description thereof will be left out.

Next, the rolling mill adjustment method according to the present embodiment will be described.

More specifically, first, in the state in which the upper working roll 910A has been replaced, the cross angle is 0° (temporary).

Next, after the roll reference member 916A is mounted to the work-side roll chock 912A, the work-side roll chock 912A is pressed by the working roll pressing device 931A in a direction opposite the direction in which roll crossing is usually effected until the fourth reference surface of the roll reference member 916A and the fifth reference surface of the rolling mill reference member 902A come into contact with each other to thereby set the reference position, and the stroke of the hydraulic cylinder at the time of contact is measured by the position measurement device 933A to thereby measure the position of the roll chock 912A. Similarly, after the roll reference member 916B is mounted to the drive-side roll chock 912B, the drive-side roll chock 912B is pressed by the working roll pressing device 930A in the direction in which roll crossing is usually effected until the fourth reference surface of the roll reference member 916B and the fifth reference surface of the rolling mill reference member 902B come into contact with each other to thereby set the reference position, and the stroke of the hydraulic cylinder at the time of contact is measured by the position measurement device 932A to thereby measure the position of the roll chock 912B.

After this, the upper working roll 910A is extracted out of the rolling mill. Then, the roll reference member 916A is detached from the work-side roll chock 912A, and the roll reference member 916B is detached from the drive-side roll chock 912B.

Next, the upper working roll 910A is mounted again to the rolling mill, and the roll chock 912A is pressed by the working roll pressing device 931A until the roll chock 912A provided with the roll reference member 916A comes into contact with the work-side housing 900A to thereby set the reference position again, and the stroke of the hydraulic cylinder at the time of contact is measured by the position measurement device 933A to thereby measure the position of the roll chock 912A. From the stroke of the hydraulic cylinder at this time, the deviation amount of the actual roll center position from the correct roll center position is obtained. Similarly, the roll chock 912B is pressed by the working roll pressing device 930A until the roll chock 912B provided with the roll reference member 916B comes into contact with the drive-side housing 900B to thereby set the reference position again, and the stroke of the hydraulic cylinder at the time of contact is measured by the position measurement device 932A to thereby measure the position of the roll chock 912B. From the stroke of the hydraulic cylinder at this time, the deviation amount of the actual roll center position from the correct roll center position is obtained. From these measurement values, the roll chock both end positions are connected by a straight line, whereby the axis of the upper working roll 910A is calculated.

Similarly, also with respect to the lower working roll and the upper and lower backup rolls, the roll axes are calculated by the same method.

After this, as in embodiment 5, there is the possibility of the axial deviation in the rolling direction of the upper working roll and the lower working roll being generated, so that the strip wedge change amount generated due to the roll gap difference between the work side and the drive side generated due to the axial deviation in the rolling direction of the upper and lower working rolls is estimated, and the rolling reduction cylinder positions (leveling) on the work side and the drive side are adjusted such that the strip wedge change amount is equal to or less than a predetermined value.

Otherwise, the operation of this embodiment is substantially the same as that of the rolling mill and the rolling mill adjustment method of embodiment 5 described above, so a detailed description thereof will be left out.

Also in the rolling mill and the rolling mill adjustment method of embodiment 6 of the present invention, it is possible to achieve substantially the same effect as that of the rolling mill and the rolling mill adjustment method of embodiment 5 described above.

[Others]

The present invention is not restricted to the embodiments described above but includes various modifications. The above embodiments have been described in detail in order to facilitate the understanding of the present invention, and the present invention is not always restricted to a structure equipped with all the components. Further, a part of a certain embodiment may be replaced by the structure of another embodiment, and the structure of a certain embodiment may be added to the structure of another embodiment. Further, with respect to a part of the structure of each embodiment, addition, deletion, and replacement of another structure is possible.

REFERENCE SIGNS LIST

1, 1A, 1B, 1C: Rolling mill
2C: Rolled material
20, 20A, 20B, 20C: controller (strip wedge suppression device)
30, 30A, 30B, 30C: Hydraulic device
32A: Motor controller
100, 300, 400, 800: Housing
100A, 200A, 300A, 400A, 500A, 600A, 700A, 800A, 900A: Work-side housing
100B, 200B, 300B, 400B, 500B, 600B, 700B, 800B, 900B: Drive-side housing
102A, 102B, 202A, 202B, 504A, 702A: Rolling mill reference member (second reference member)
110A, 210A, 310A, 410A, 510A, 610A, 710A, 810A, 910A: Upper working roll
110B, 310B, 410B, 810B: Lower working roll
112A, 212A, 312A, 412A, 512A, 612A, 712A, 812A, 912A: Work-side roll chock
112B, 212B, 312B, 412B, 512B, 612B, 712B, 812B, 912B: Drive-side roll chock
114A, 114B, 214A, 214B, 314A, 314B, 414A, 414B, 514A, 514B,
614A, 614B, 714A, 714B, 814A, 814B, 914A, 914B: Roll chock side liner
116A, 116B, 216A, 216B, 516A, 716A: Roll reference member (first reference member)
120A, 320A, 420A, 820A: Upper backup roll
120B, 320B, 420B, 820B: Lower backup roll
130A, 130B, 131A, 230A, 231A, 330A, 330B, 331A, 430A, 430B,
431A, 530A, 531A, 630A, 631A, 731A, 830A, 831A: Working roll pressing device
134A, 135A, 234A, 235A, 334A, 335A, 434A, 435A, 534A, 535A,
634A, 635A, 734A, 735A, 834A, 835A, 934A, 935A: Pressing device liner
140A, 140B, 141A, 240A, 241A, 340A, 340A1, 340B, 440A, 440B,
441A, 540A, 640A, 740A: Working roll position control device
142A, 143A, 242A, 243A, 442A, 443A, 542A, 642A, 742A: Position measurement device
144A, 145A, 244A, 245A, 345A1, 345A2, 444A, 445A, 544A,
644A, 744A: Position control device liner
150A, 150B, 350A, 350B, 450A, 450B, 850A, 850B: Backup roll pressing device
160A, 160B, 360A, 360B, 460A, 460B: Backup roll position control device
170, 370, 470, 870: Rolling reduction cylinder device
180, 380, 480, 880: Load cell
302, 302A, 302B, 402, 402A, 402B, 502B, 602A, 602B, 802,
802A, 802B: Short-range position measurement device (short-range position sensor)
316A, 316B, 416A, 416B, 516B, 616A, 616B, 816A, 816B: Roll reference member (third reference member)
341A, 341B, 361A, 361B: Screw
342A, 342B, 362A, 362B: Nut
343A, 343A1, 343B, 363A, 363B: Motor
344A, 344A1, 344B, 364A, 364B: Rotational angle measurement device
345A, 345B, 365A, 365B: Shaft
346A, 346B, 366A, 366B: Cogwheel
506, 606, 706, 806A, 806B, 906A, 906B: Pivot block
702B, 902A, 902B: Rolling mill reference member (fifth reference member)
716B, 916A, 916B: Roll reference member (fourth reference member)
730A, 930A, 931A: Working roll pressing device (with position measurement device)
732A, 932A, 933A: Position measurement device
870A: Work-side rolling reduction cylinder device
870B: Drive-side rolling reduction cylinder device
880A: Work-side load cell
880B: Drive-side load cell

The invention claimed is:

1. A rolling mill comprising:

a work-side housing and a drive-side housing;

a pair of upper and lower working rolls each supported rotatably by the work-side and drive-side housings via a work-side roll chock and a drive-side roll chock;

a plurality of pressing devices respectively arranged on the pair of upper and lower working rolls at positions between an input side in a rolling direction of the work-side housing and the work-side roll chock, between an output side in the rolling direction of the work-side housing and the work-side roll chock, between an input side in the rolling direction of the drive-side housing and the drive-side roll chock and between an output side in the rolling direction of the drive-side housing and the drive-side roll chock, for pressing corresponding ones of the work-side and drive-side roll chocks at each of the positions in the rolling direction or an anti-rolling direction;

liners each provided at contact portions of the plurality of pressing devices and the corresponding ones of the work-side and drive-side roll chocks;

position control devices arranged on each roll of the pair of upper and lower working rolls at two positions: at one of positions between the input side of the work-side housing and the work-side roll chock and between the output side of the work-side housing and the work-side roll chock, and at one of positions between the input side of the drive-side housing and the drive-side roll chock and between the output side of the drive-side housing and the drive-side roll chock;

each of the position control devices being equipped with at least a part of a corresponding pressing device of the plurality of pressing devices as a drive section and being equipped with a measurement device that measures an operation amount of the corresponding pressing device, to perform positional control on the corresponding pressing device;

a work-side position measurement device, including a first reference member provided on the work-side roll chock and having a first reference surface, and a second reference member provided on the work-side housing and having a second reference surface capable of coming into contact with the first reference surface;

the work-side position measurement device being configured to:

set a work-side reference position during pressing of a first surface of the work-side roll chock opposite to a second surface of the work-side roll chock on which the first reference member is provided by a pressing device of the plurality of pressing devices so that the first reference surface of the first reference member contacts the second reference surface of the second reference member, and measure a position of the work-side roll chock at the work-side reference position by the measurement device of a work-side position control device of the position control devices in a rolling direction of the work-side roll chock between the work side roll chock and the work side housing, including a wear of a work-side liner of the liners with reference to a position that is not affected by the wear of the work-side liner; and a drive-side position measurement device including a first reference member provided on the drive-side roll chocks and having a first reference surface, and a second reference member provided on the drive-side housings and having a second reference surface capable of coming into contact with the first reference surface;

the drive-side position measurement device being configured to:

set a drive-side reference position during pressing of a first surface of the drive-side roll chock opposite to a second surface of the drive-side roll chock on which the first reference member is provided by a pressing device of the plurality of pressing devices so that the first reference surface of the first reference member contacts the second reference surface of the second reference member, and measure a position of the drive-side roll chock at the drive-side reference position by the measurement device of a drive-side position control device of the position control devices in a rolling direction of the drive-side roll chock between the drive-side roll chock and the drive-side housing, including a wear of the drive-side liner of the liners with reference to a position that is not affected by the wear of the drive-side liner.

2. A rolling mill, comprising:

a work-side housing and a drive-side housing;

a pair of upper and lower working rolls each supported rotatably by the work-side and drive-side housings via a work-side roll chock and a drive-side roll chock;

a pair of upper and lower backup rolls each supported rotatably by the work-side and drive-side housings via a work-side roll chock and a drive-side roll chock and each supporting the pair of upper and lower working rolls;

a plurality of pressing devices respectively arranged on the pair of upper and lower working rolls and the pair of upper and lower backup rolls at positions between an input side in a rolling direction of the work-side housing and the work-side roll chock, between an output side in the rolling direction of the work-side housing and the work-side roll chock, between an input side in the rolling direction of the drive-side housing and the drive-side roll chock and between an output side in the rolling direction of the drive-side housing and the drive-side roll chock, for pressing corresponding ones of the work-side and drive-side roll chocks at each of the positions in the rolling direction or an anti-rolling direction;

liners each provided at contact portions of the plurality of pressing devices and the corresponding ones of the work-side and drive-side roll chocks;

position control devices arranged on each roll of the pair of upper and lower working rolls and on each roll of the pair of upper and lower backup rolls at two positions: at one of positions between the input side of the work-side housing and the work-side roll chock and between the output side of the work-side housing and the work-side roll chock, and at one of positions between the input side of the drive-side housing and the drive-side roll chock and between the output side of the drive-side housing and the drive-side roll chock;

each of the position control devices being equipped with at least a part of a corresponding pressing device of the plurality of pressing devices as a drive section and being equipped with a measurement device that measures an operation amount of the corresponding pressing device, to perform positional control on the corresponding pressing device;

a work-side position measurement device, including a first reference member provided on the work-side roll chock and having a first reference surface, and a second reference member provided on the work-side housing and having a second reference surface capable of coming into contact with the first reference surface;

the work-side position measurement device being configured to:

set a work-side reference position during pressing of a first surface of the work-side roll chock opposite to a second surface of the work-side roll chock on which the first reference member is provided by a pressing device of the plurality of pressing devices so that the first reference surface of the first reference member contacts the second reference surface of the second reference member, and measure a position of the work-side roll chock at the work-side reference position by the measurement device of a work-side position control device of the position control devices in a rolling direction of the work-side roll chock between the work side roll chock and the work side housing, including a wear of a work-side liner of the liners with reference to a position that is not affected by the wear of the work-side liner; and a drive-side position measurement device including a first reference member provided on the drive-side roll chocks and having a first reference surface, and a second reference member provided on the drive-side housings and having a second reference surface capable of coming into contact with the first reference surface;

the drive-side position measurement device being configured to:

set a drive-side reference position during pressing of a first surface of the drive-side roll chock opposite to a second surface of the drive-side roll chock on which the first reference member is provided by a pressing device of the plurality of pressing devices so that the first reference surface of the first reference member contacts the second reference surface of the second reference member, and measure a position of the drive-side roll chock at the drive-side reference position by the measurement device of a drive-side position control device of the position control devices in a rolling direction of the drive-side roll chock between the drive-side roll chock and the drive-side housing, including a wear of the drive-side liner of the liners with reference to a position that is not affected by the wear of the drive-side liner.

3. The rolling mill according to claim 2, wherein a controller is configured to control a strip wedge change amount after rolling to be equal to or less than a predetermined value on the basis of measurement results of the work-side and drive-side position measurement devices.

4. The rolling mill according to claim 2, further comprising a controller configured to control the corresponding rolling direction position of at least one of the work-side and drive-side roll chocks on the basis of measurement results obtained by the work-side and drive-side position measurement devices.

5. The rolling mill according to claim 4, wherein the controller is configured to control the position control devices in order to adjust roll positions of the pair of upper and lower working rolls and the pair of upper and lower backup rolls to a zero point.

6. A rolling mill adjustment method for adjusting a rolling mill, the rolling mill comprising:

a work-side housing and a drive-side housing;

a pair of upper and lower working rolls each supported rotatably by the work-side and drive-side housings via a work-side roll chock and a drive-side roll chock;

a pair of upper and lower backup rolls each supported rotatably by the work-side and drive-side housings via a work-side roll chock and a drive-side roll chock and each supporting the pair of upper and lower working rolls;

a plurality of pressing devices respectively arranged on the pair of upper and lower working rolls and the pair of upper and lower backup rolls at positions between an input side in a rolling direction of the work-side housing and the work-side roll chock, between an output side in the rolling direction of the work-side housing and the work-side roll chock, between an input side in the rolling direction of the drive-side housing and the drive-side roll chock and between an output side in the rolling direction of the drive-side housing and the drive-side roll chock, for pressing corresponding ones of the work-side and drive-side roll chocks at each of the positions in the rolling direction or an anti-rolling direction;

liners each provided at contact portions of the plurality of pressing devices and the corresponding ones of the work-side and drive-side roll chocks, position control devices arranged on each roll of the pair of upper and lower working rolls and on each roll of the pair of upper and lower backup rolls at two positions: at one of positions between the input side of the work-side housing and the work-side roll chock and between the output side of the work-side housing and the work-side roll chock, and at one of positions between the input side of the drive-side housing and the drive-side roll chock and between the output side of the drive-side housing and the drive-side roll chock, each of the position control devices being equipped with at least a part of a corresponding pressing device of the plurality of pressing devices as a drive section and being equipped with a measurement device that measures an operation amount of the corresponding pressing device, to perform positional control on the corresponding pressing device, a work-side position measurement device, including a first reference member provided on the work-side roll chock and having a first reference surface, and a second reference member provided on the work-side housing and having a second reference surface capable of coming into contact with the first reference surface and a drive-side position measurement device including a first reference member provided on the drive-side roll chocks and having a first reference surface, and a second reference member provided on the drive-side housings and having a second reference surface capable of coming into contact with the first reference surface;

the method comprising the steps of:

measuring with the work-side position measurement device, including setting a work-side reference position during pressing of a first surface of the work-side roll chock opposite to a second surface of the work-side roll chock on which the first reference member is provided by a pressing device of the plurality of pressing devices so that the first reference surface of the first reference member contacts the second reference surface of the second reference member, and operating the pressing device which is the drive section of a work-side position control device of the position control devices to measure a position of the work-side roll chock at the work-side reference position by the measurement device of the work-side position control device in a rolling direction of the work-side roll chock between the work side roll chock and the work side housing, including a wear of the work-side liner of the liners with reference to a position that is not affected by the wear of the work-side liner; and measuring with the drive-side position measurement device, including setting a drive-side reference position during pressing of a first surface of the drive-side roll chock opposite to a second surface of the drive-side roll chock on which the first reference member is provided by a pressing device of the plurality of pressing devices so that the first reference surface of the first reference member contacts the second reference surface of the second reference member, and operating the pressing device which is the drive section of a drive-side position control device of the position control devices to measure a position of the drive-side roll chock at the drive-side reference position by the measurement device of the drive-side position control device in a rolling direction of the drive-side roll chock between the drive-side roll chock and the drive-side housing, including a wear of the liner of the liners with reference to a position that is not affected by the wear of the drive-side liner.

7. The rolling mill adjustment method according to claim 6, further comprising controlling the corresponding rolling direction position of at least one of the work-side and drive-side roll chocks on the basis of measurement results obtained by the work-side and drive-side position measurement devices.

8. The rolling mill adjustment method according to claim 7, further comprising controlling the position control devices in order to adjust roll positions of the pair of upper and lower working rolls and the pair of upper and lower backup rolls to a zero point.

9. The rolling mill adjustment method according to claim 6, further comprising controlling a strip wedge change amount after rolling to be equal to or less than a predetermined value on the basis of measurement results of the work-side and drive-side position measurement devices.

* * * * *